US011920310B1

(12) United States Patent
Mills et al.

(10) Patent No.: US 11,920,310 B1
(45) Date of Patent: Mar. 5, 2024

(54) REMOVABLE BOLLARD

(71) Applicant: Ameristar Perimeter Security USA Inc., Tulsa, OK (US)

(72) Inventors: Douglas E. Mills, Tulsa, OK (US); Christopher M. Tabler, Sperry, OK (US); John D. Bell, Broken Arrow, OK (US); Bradley M. Chandler, Owasso, OK (US)

(73) Assignee: Ameristar Perimeter Security USA Inc., Tulsa, OK (US)

( * ) Notice: Subject to any disclaimer, the term of this patent is extended or adjusted under 35 U.S.C. 154(b) by 129 days.

(21) Appl. No.: 17/729,101

(22) Filed: Apr. 26, 2022

Related U.S. Application Data

(60) Provisional application No. 63/283,470, filed on Nov. 28, 2021.

(51) Int. Cl.
*E01F 13/04* (2006.01)
*E01F 9/685* (2016.01)
*E01F 13/02* (2006.01)

(52) U.S. Cl.
CPC ..... *E01F 13/026* (2013.01); *E01F 9/685* (2016.02)

(58) Field of Classification Search
CPC . E01F 9/658; E01F 9/673; E01F 9/685; E01F 13/024; E01F 13/026; E01F 13/04; E01F 13/046
See application file for complete search history.

(56) References Cited

U.S. PATENT DOCUMENTS

| | | | | |
|---|---|---|---|---|
| 3,660,935 | A * | 5/1972 | Boots | E01F 13/046 49/35 |
| 4,919,563 | A * | 4/1990 | Stice | E01F 13/046 404/6 |
| 8,742,949 | B2 * | 6/2014 | Chang | G08G 1/149 340/932.2 |
| 8,794,865 | B2 * | 8/2014 | Stadler | E01F 13/046 404/6 |
| 9,127,423 | B2 | 9/2015 | Ball | |
| 9,133,589 | B2 | 9/2015 | Ball | |
| 9,909,271 | B2 * | 3/2018 | Wiegel | E01F 15/003 |
| 11,174,606 | B1 * | 11/2021 | Lamore | E01F 13/026 |
| 11,359,341 | B2 * | 6/2022 | Demaria | E01F 13/046 |
| 2013/0175422 | A1 * | 7/2013 | Clarke | E04H 12/2269 248/523 |
| 2014/0147201 | A1 * | 5/2014 | Ball | E01F 13/048 404/6 |
| 2014/0161521 | A1 * | 6/2014 | Ball | E01F 13/046 404/6 |
| 2022/0205198 | A1 * | 6/2022 | Neusch | E01F 13/046 |

* cited by examiner

*Primary Examiner* — Gary S Hartmann
(74) *Attorney, Agent, or Firm* — Gary Peterson

(57) ABSTRACT

A bollard assembly is formed from a bollard that resides in a tubular socket. The socket has an internal core that is separated from the tube walls by annular recess. The lower end of the bollard is received within the recess. Lifting elements inside the bollard engage the upper surface of the core, and are internally biased in favor of extension. A locking system prevents extension of the lifting elements. When the locking system is unlocked, the pressure of the lifting elements against the core causes the bollard to rise out of and slightly above the socket, without external assistance. Once raised, the bollard may easily be removed from the site of the socket.

14 Claims, 40 Drawing Sheets

REMOVABLE BOLLARD

SUMMARY OF THE INVENTION

A bollard assembly is formed from a foundation, a bollard and a locking system. The foundation has a socket that includes a hollow shell and a core. The shell is supported by a base. The core is also supported by the base and is coaxially disposed within the shell. The core has an upper surface spaced above the base. An annular recess is coaxially disposed between the shell and the core. The bollard is formed from a body and a lift assembly. The body has opposed upper and lower ends and a body axis, with the lower end receivable within the recess and engagable with the base. The lift assembly is engagable with the upper surface of the core and has a less extended state, configured to urge increased axial separation between the body and the core, and a more extended state. The locking system has a locked state, in which the lift assembly is restrained in a less extended state, and an unlocked state in which the less extended lift assembly is released from restraint.

BRIEF DESCRIPTION OF THE DRAWINGS

FIG. 6 is a perspective view of a partition.

FIG. 26 is a front cross-sectional view of the bollard assembly of FIG. 1. It has been formed by assembling the base of FIG. 4 with the bollard of FIG. 23. The lifting elements are in their less extended states.

FIG. 33 is a perspective view of the structure formed by assembling the framework and shell of FIG. 31 with the socket core of FIG. 32.

FIG. 35 is a perspective view of a blocking member.

FIG. 36 is a top plan view of the blocking member of FIG. 35.

FIG. 38 is a perspective view of the structure formed by assembling the structure of FIG. 33, the lock receiver of FIG. 34, the blocking member of FIG. 35, and retaining fasteners.

FIG. 48 is a perspective view of a utility platform.

FIG. 56 is a front cross-sectional view of the bollard assembly of FIG. 30. It has been formed by assembling the base of FIG. 40 with the bollard of FIG. 54. The lifting elements are in their less extended states.

FIG. 59 is an enlarged and detailed view of the bollard assembly of FIG. 58, showing the lower end of the bollard and its interface with the socket.

FIG. 60 is a sectional elevation view of the bollard assembly of FIG. 30 embedded in a ground area.

DETAILED DESCRIPTION

A bollard assembly 10, shown in FIGS. 1-29, is formed from a foundation 12 that supports a bollard 14.

Figure 2:
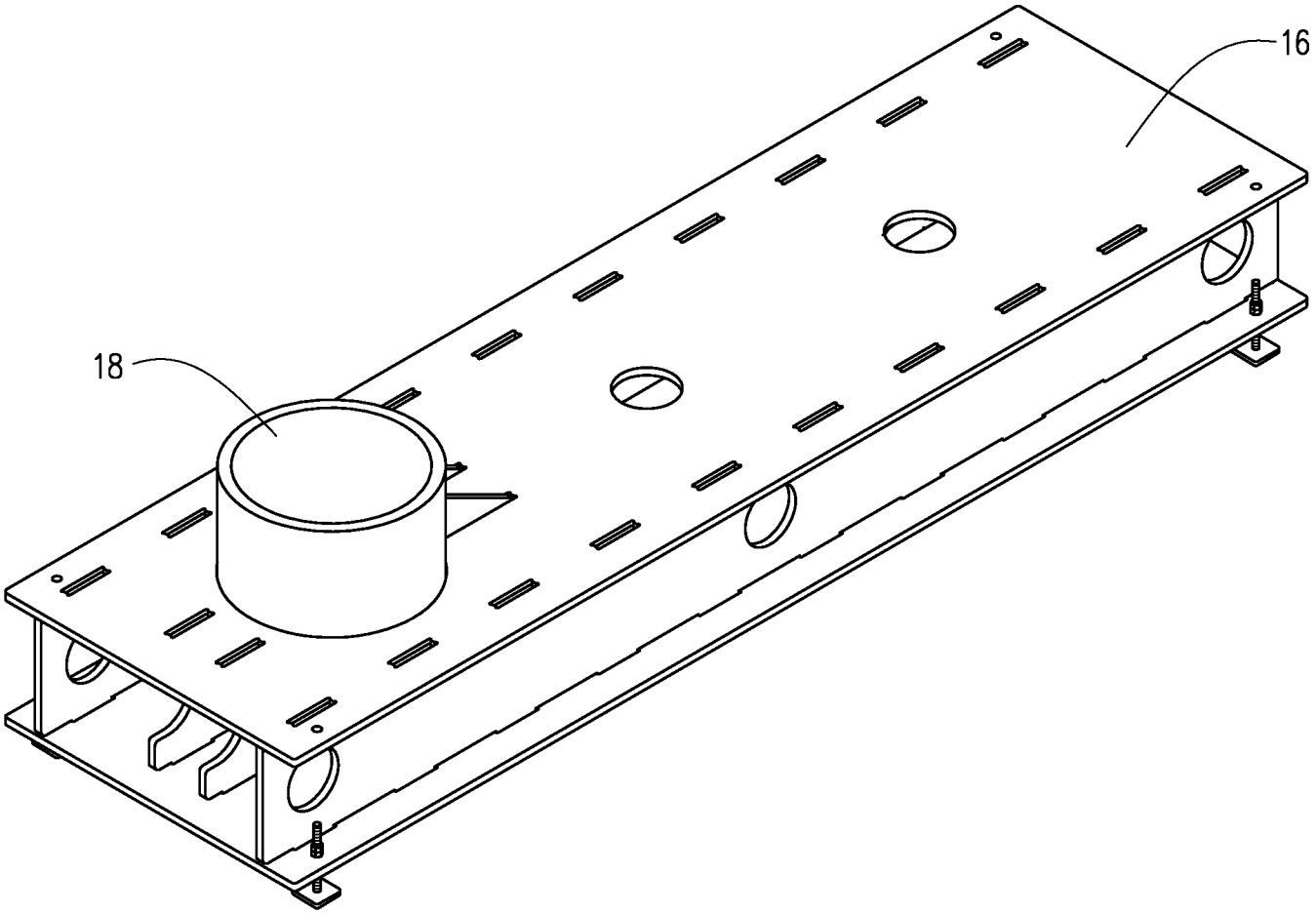
FIG. 2 is a perspective view of a framework and shell.

The foundation 12 is formed from a shallow framework 16 having the general shape of a rectangular prism. The framework 16, shown in FIG. 2, is traversed orthogonally by an elongate and hollow shell 18 having opposed upper and lower ends. Preferably, the shell 18 is cylindrical in shape, open at each of its ends, and sized to receive one end of the bollard 14. The shell 18 is preferably formed from a strong and durable material, such as steel, and is permanently joined to the framework 16, preferably by welding.

Figure 3:
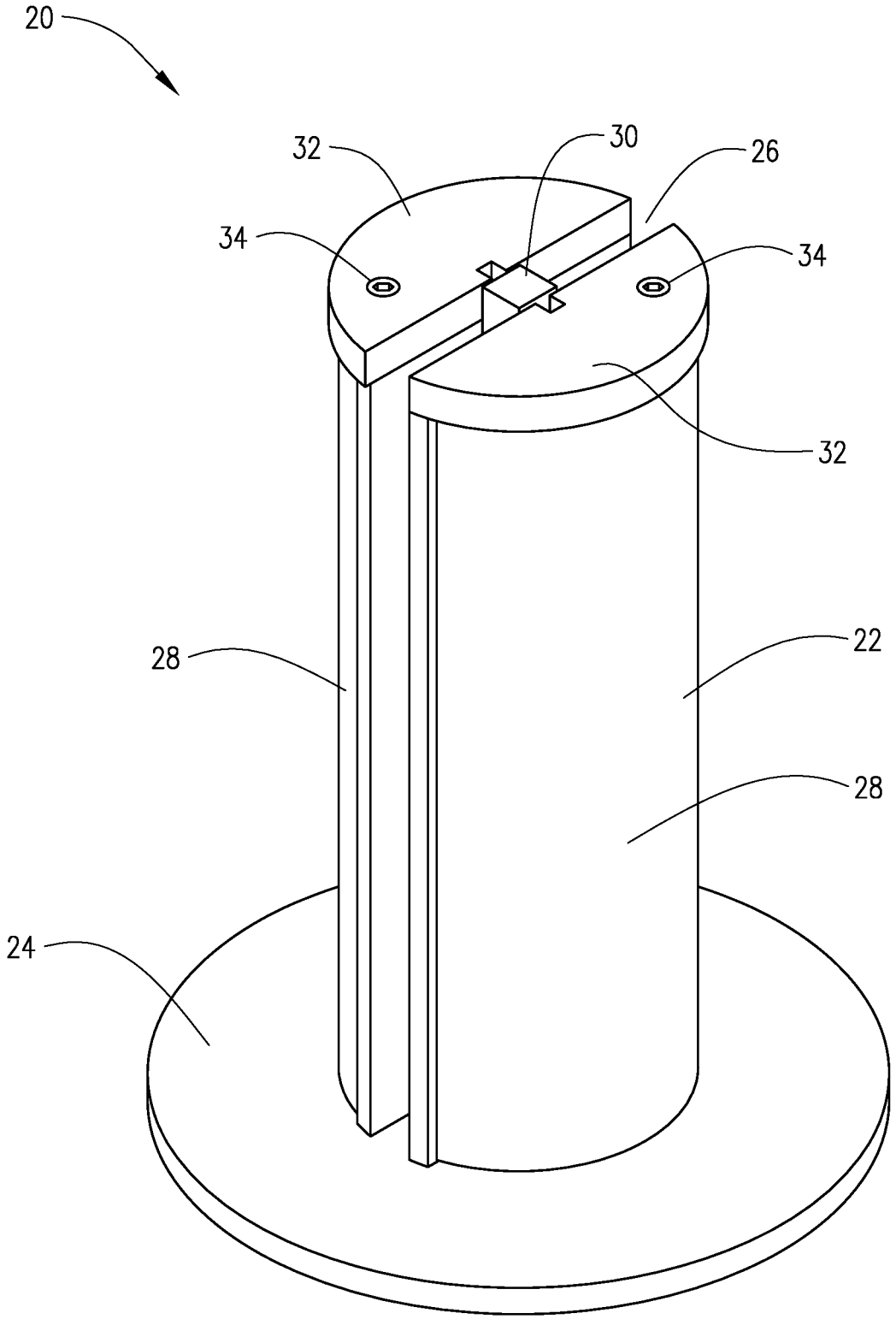
FIG. 3 is a perspective view of a socket core.

Further comprising the foundation 12 is a core assembly 20, shown in FIG. 3. The core assembly 20 comprises a core 22 supported by a flat base 24. Preferably, the base 24 has maximum dimensions that exceed those of the lower end of the shell 18. In the embodiment of the Figures, the base 24 is circular in shape.

The core 22 is generally cylindrical in shape, and sized to be axially receivable within the shell 18. A diametric gap 26 splits the core 22 into two halves 28 that are joined by an elongate and centrally-disposed rib 30. The exposed upper surface 32 of the core 22 is planar, spaced above the base 24, and extends parallel to the base 24. Preferably, the core 22 has the same height as the shell 18.

At least one, and preferably more than one, lock receiver 34 is formed in the upper surface 32 of the core 22. In the embodiment of the Figures, two lock receivers 34 are formed, one in each halve 28. In the same embodiment, each lock receiver 34 comprises an internally-threaded hole drilled into the upper surface 32.

Figure 4:
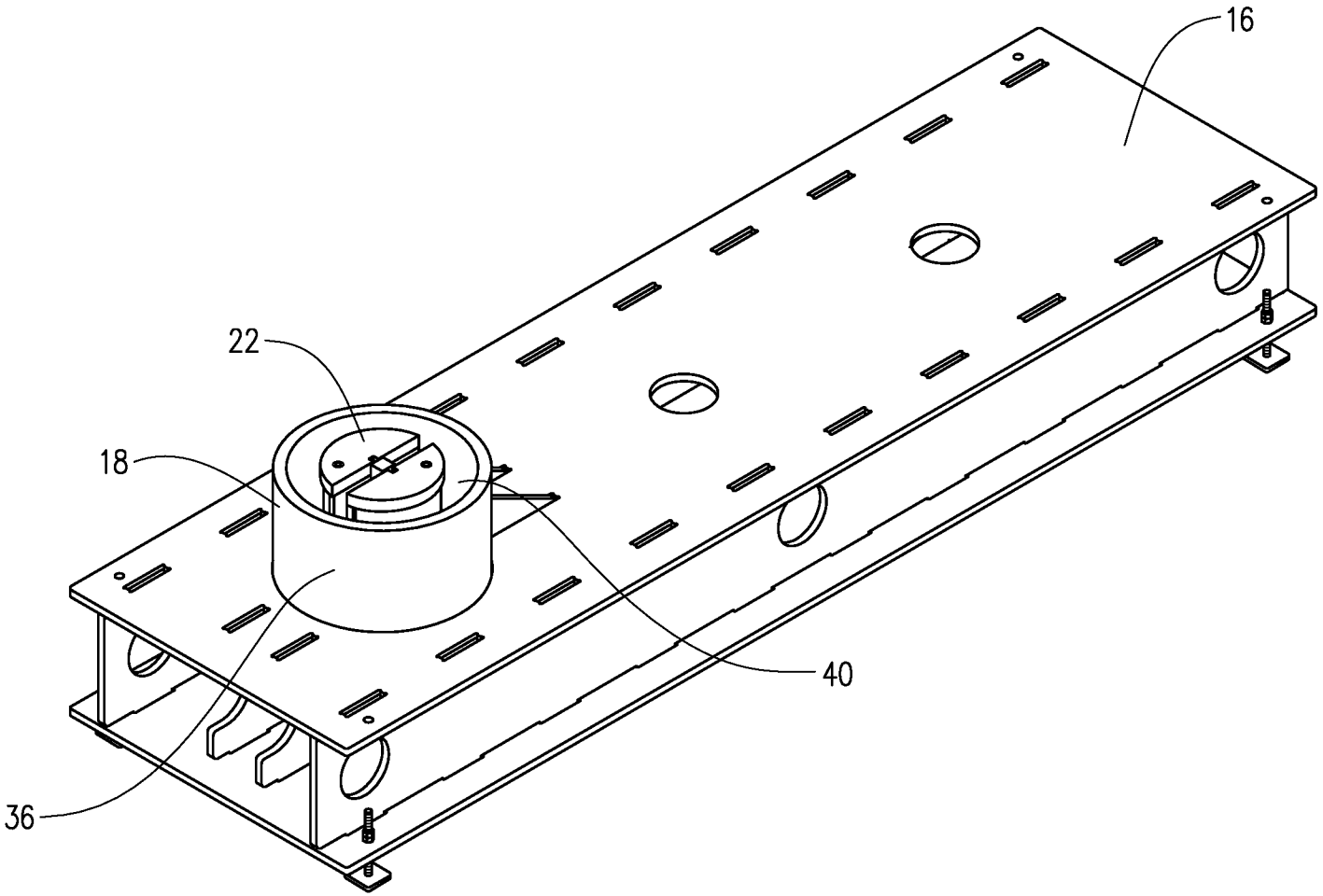
FIG. 4 is a perspective view of the base of the bollard assembly of FIG. 1. It has been formed by assembling the framework and shell of FIG. 2 with the socket core of FIG. 3.

The foundation 12 is formed by joining the core assembly 20 to the framework 16 and shell 18. The core 22 is inserted into the lower end of the shell 18, so that the core 22 and shell 18 extend coaxially. The base 24 is then permanently joined to the lower end of the shell 18, preferably by welding. The resulting structure is shown in FIG. 4.

The shell 18 and core 22 cooperate to form a socket 36 having an open upper end 38. The socket 36 is bounded at the upper end 38 by the upper surface 32 of the core 22, and is coplanar with the upper surface of the shell 18. An annular recess 40, best shown in FIG. 28, extends coaxially between the shell 18 and the core 22. The lower end of the bollard 14 is concentrically receivable within the socket 36 at the recess 40. When so received, the lower end of the bollard 14 engages the base 24.

In one embodiment of the bollard assembly 10, the foundation 12 is formed from a framework 16 having a length of 80 inches, a width of 23 inches, and a depth of 9 inches. The shell 18 has an external diameter of 12.75 inches, a wall thickness of 0.843 inches and a height of 18 inches. The shell 18 is formed from schedule 100 seamless steel pipe satisfying ASTM specification A106, grade B. The core 22 has a maximum diameter of 6.99 inches and a height of 18 inches. The base 24 is circular, with a diameter of 13.75 inches and a thickness of 0.5 inches.

Figure 5:
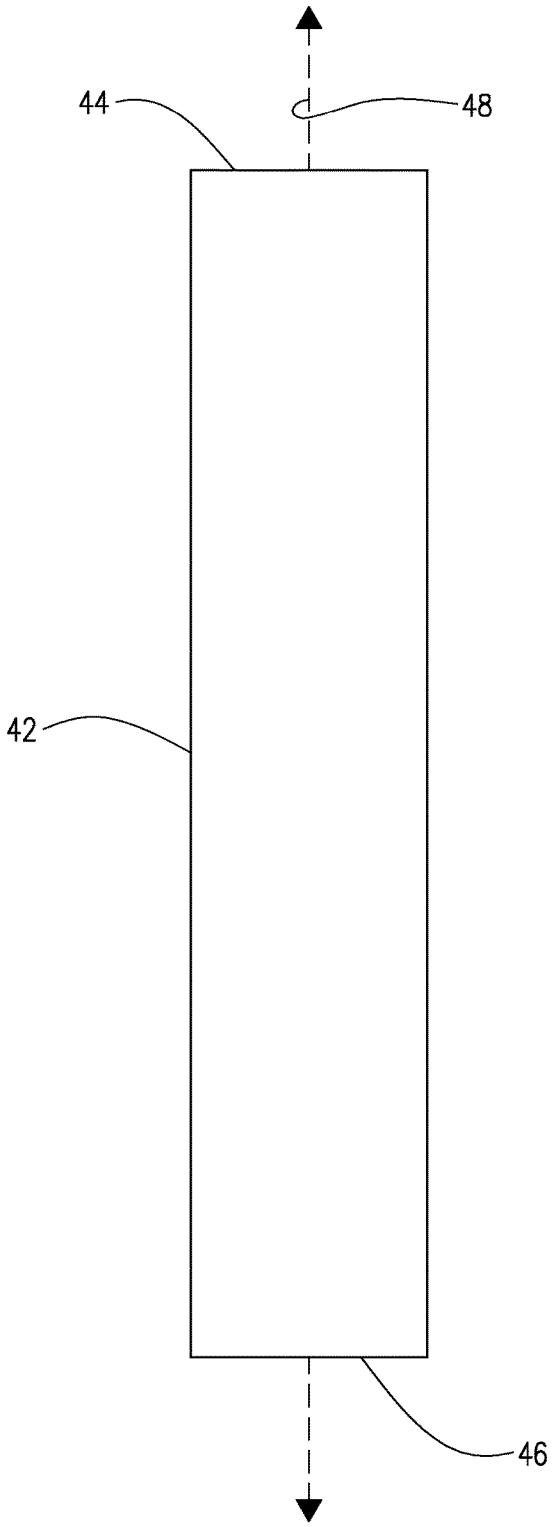
FIG. 5 is a front elevation view of a body.
Figure 5:
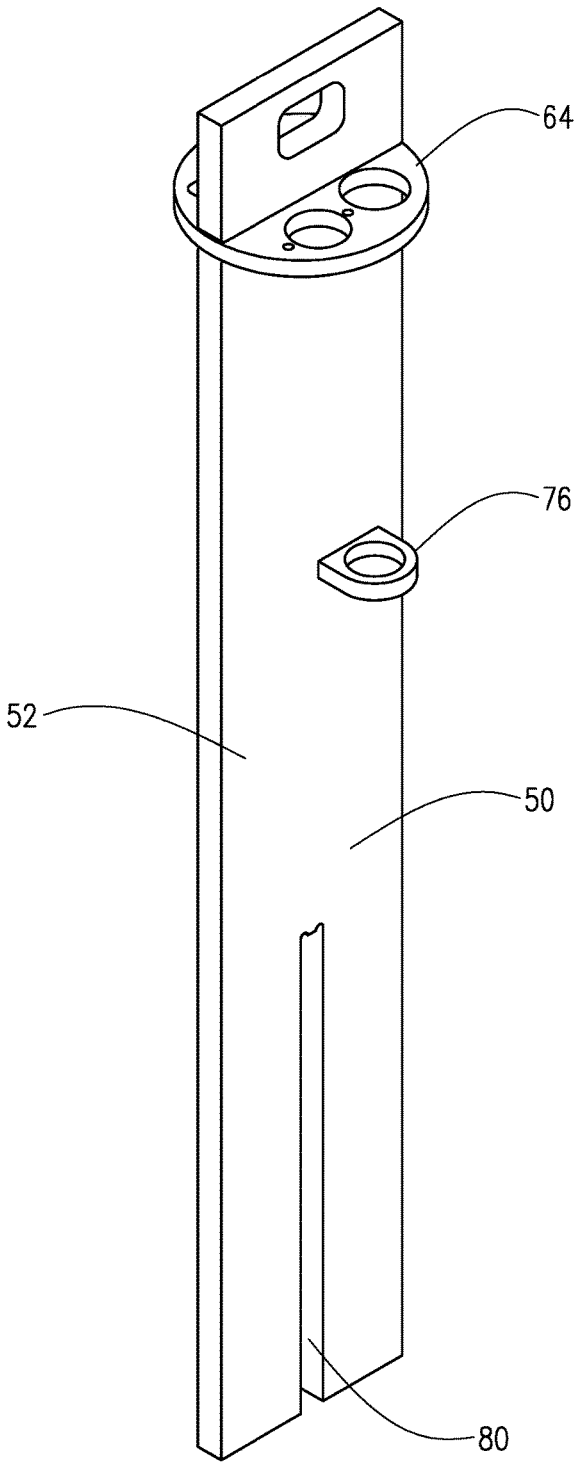

The bollard 14 is formed from an elongate and hollow body 42 having an upper end 44, an opposed lower end 46 and a centrally-disposed longitudinal axis 48. The body 42, shown in FIG. 5, is a tubular structure characterized by a uniform cross-sectional shape along its length. Preferably, that cross-sectional shape is circular. The body 42 is preferably formed from a strong and durable material, such as steel, and preferably from the same material as the shell 18.

In the previously-described embodiment of the bollard assembly 10, the body 42 is a hollow and cylindrical structure having a length of 54 inches, an external diameter of 10.75 inches, and a wall thickness of 1.125 inches. The body 42 is formed from schedule 160 seamless steel pipe satisfying ASTM specification A106, grade B.

Further comprising the bollard 14 is a partition 50, shown in FIGS. 6-10. The partition 50 comprises an elongate and flat wall 52, which preferably has the same length as the body 42, and a width equalling the internal diameter of the body 42. The wall 52 has an upper end 54, an opposed lower end 56, and a pair of parallel and opposed sides 58. Preferably, the wall 52 has a rectangular shape bounded by parallel major edges 60 and parallel minor edges 62. The major edges 60 coincide with the sides 58, and the minor edges 62 coincide with the ends 54 and 56.

Supported by the wall 52 adjacent its upper end 54 is a utility platform 64. The utility platform 64 is a flat and rigid structure that extends adjacent both sides 58 of the wall 52, in transverse, and preferably orthogonal, relationship thereto. The utility platform 64 has a flat upper side 66 and a parallel flat and opposed lower side 68.

Preferably, the utility platform 64 has an external contour that conforms to the internal contour of the body 42. Thus, if the body 42 is a hollow cylinder, the external contour of the utility platform 64 is a circular arc having a radius that matches the internal radius of the body 42.

Figure 9:
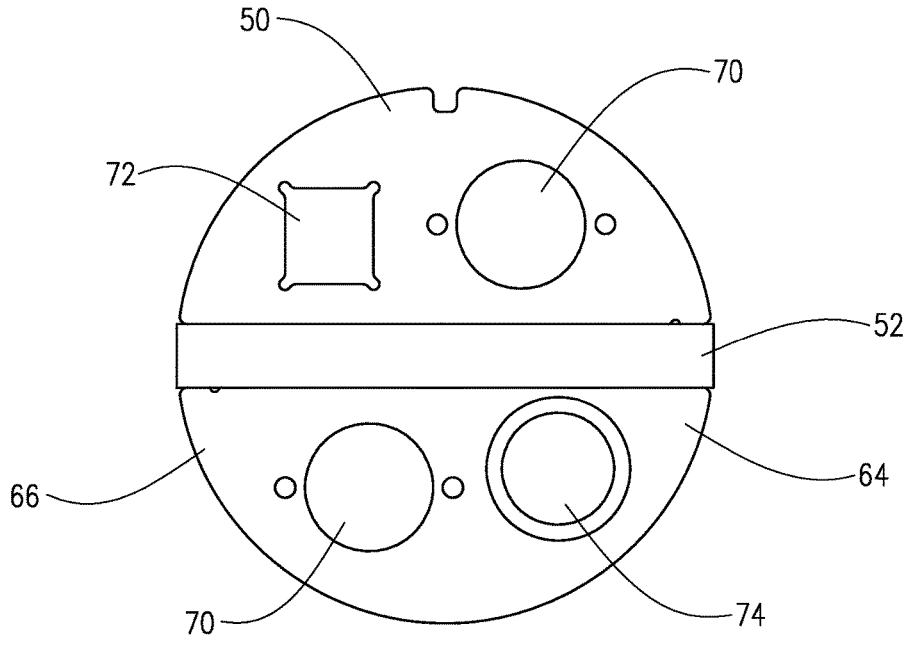
FIG. 9 is a top plan view of the partition of FIG. 7, taken along line 9-9.

As shown in FIG. 9, a plurality of openings are formed in the utility platform 64. The openings are preferably situated away from the platform's edges, and interconnect the opposed sides 66 and 68. The openings include a pair of brace openings 70, a tool extension opening 72, and a core access opening 74. Preferably, the wall 52 separates the two brace openings 70, and separates the tool extension opening 72 from the core access opening 74.

Figure 7:
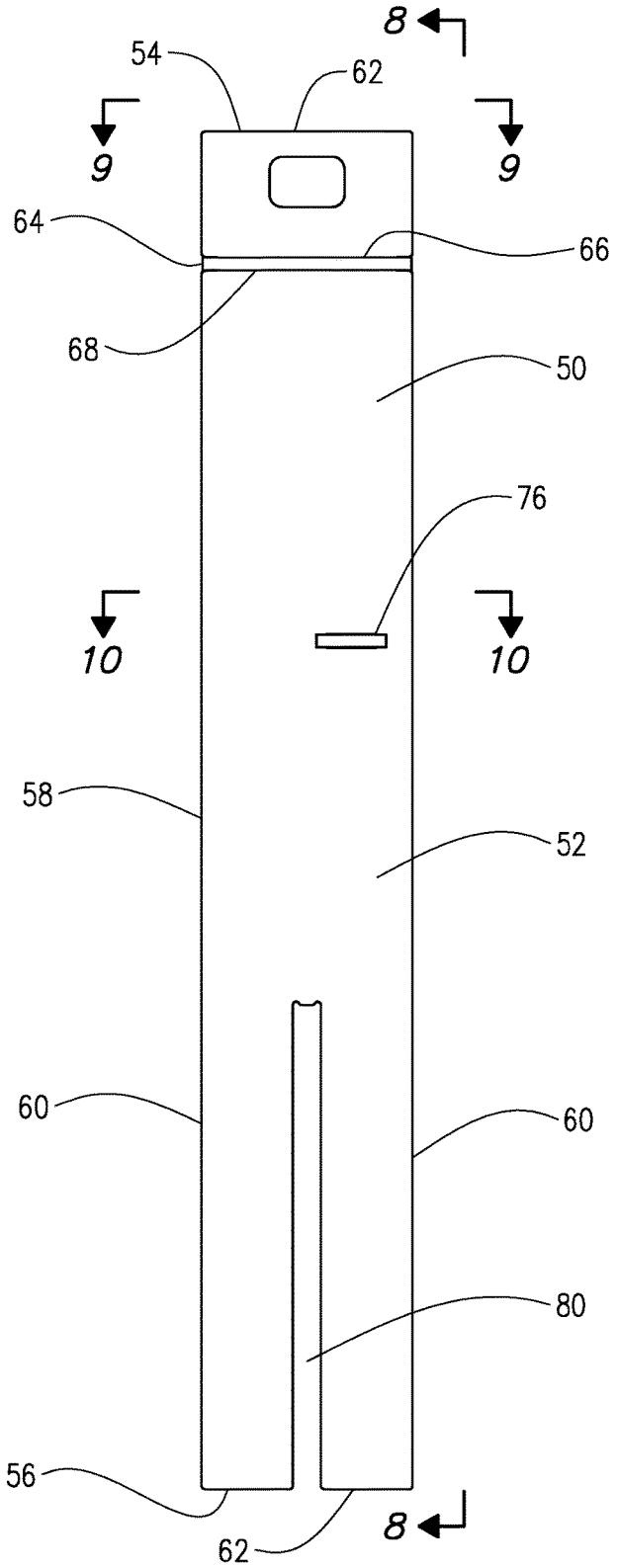
FIG. 7 is a front elevation view of the partition of FIG. 6.
Figure 8:
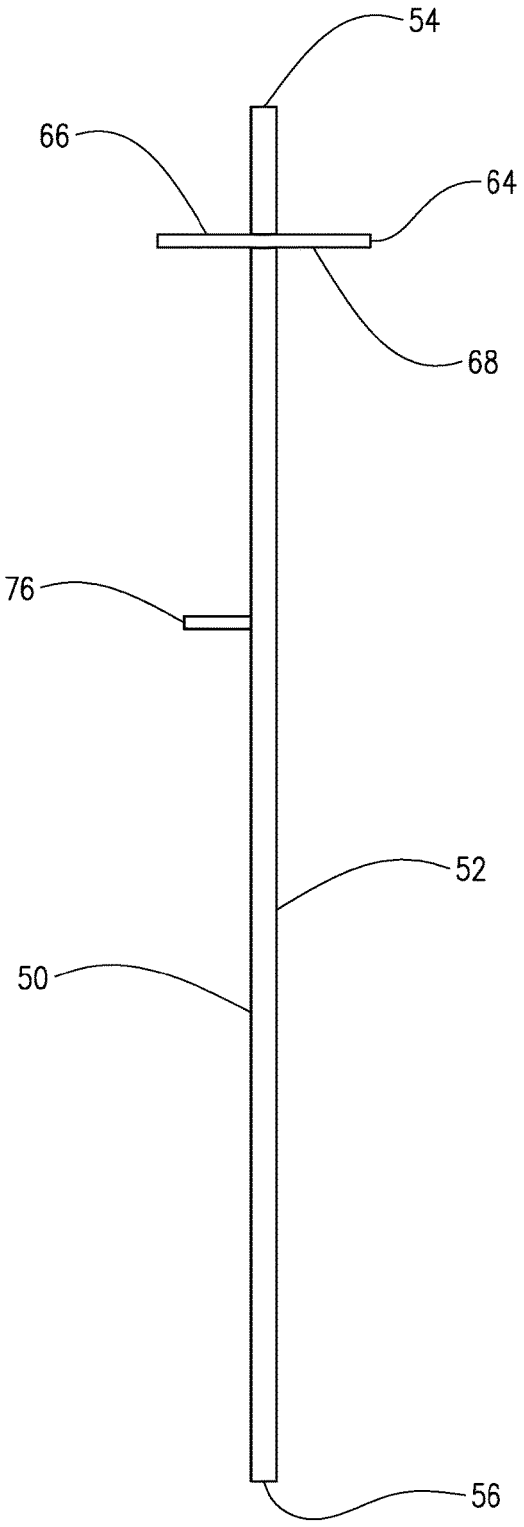
FIG. 8 is a side elevation view of the partition of FIG. 7, taken along line 8-8.
Figure 10:
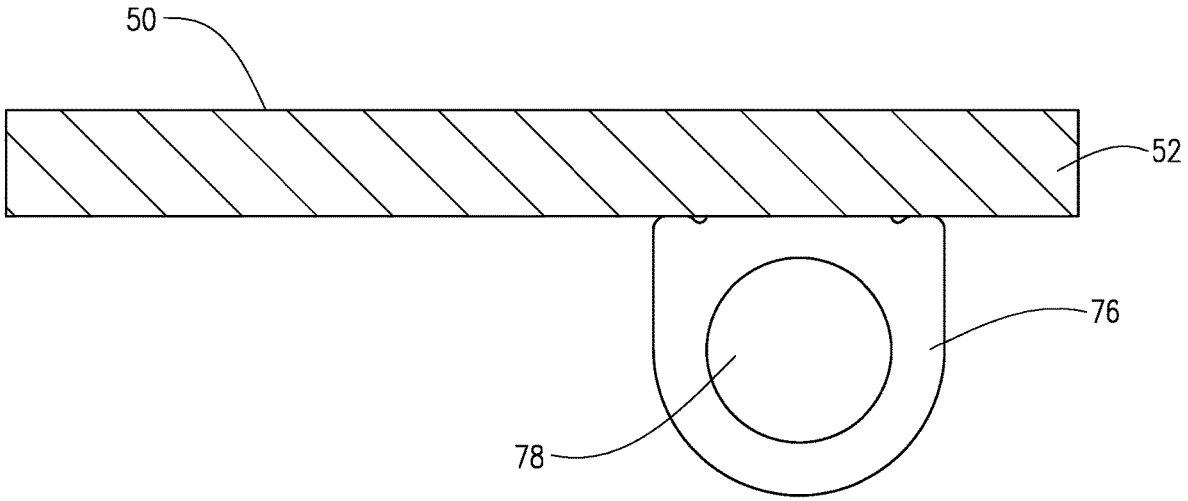
FIG. 10 is a cross-sectional view of the partition of FIG. 7, taken along line 10-10.

Supported by the wall 52 intermediate its upper and lower ends 54 and 56 is a lock support platform 76, visible in FIGS. 7, 8 and 10. Preferably, the lock support platform 76 is situated intermediate the utility platform 64 and the lower end 56. The lock support platform 76 is preferably a flat, rigid and compact structure that extends adjacent only one side 58 of the wall 52, in transverse, and preferably orthogonal, relationship thereto. Formed away from the edges of the lock support platform 76 is a core access opening 78 that interconnects the platform's upper and lower sides. The lock support platform 76 should be positioned such that the core access openings 74 and 78 are situated on the same side of the wall 52, and aligned along a line parallel to the major edges 60.

An elongate slot 80 is formed in the wall 52 and extends from the lower end 56 toward the upper end 54. Preferably, the slot 80 is equidistant from, and extends parallel to, each of the major edges 60.

In the previously-described embodiment of the bollard assembly 10, the shape of each side of the wall 52 is a rectangle having major sides with lengths of 54 inches and minor sides with lengths of 8.38 inches. The slot 80 is 19.25 inches in length and 1.13 inches wide.

In the same embodiment, the utility platform 64 has a thickness of 0.5 inches and is formed from segments having an arcuate contour. The radius of that contour is 4.19 inches. The utility platform 64 is situated 5.25 inches from the upper end 54. Each brace opening 70 is circular in shape, with a diameter of 2 inches. The tool extension opening 72 is rectangular in shape, with major sides of 1.5 inches and minor sides of 1.38 inches. The core access opening 74 is circular in shape, with a diameter of 2.25 inches.

In the same embodiment, the lock support platform 76 has a thickness of 0.5 inches and an approximate length and width of 2.75 inches by 2.64 inches. The core access opening 78 is circular in shape, with a diameter of 1.75 inches. The lock support platform 76 is situated 20.25 inches from the upper end 54.

Figure 12:
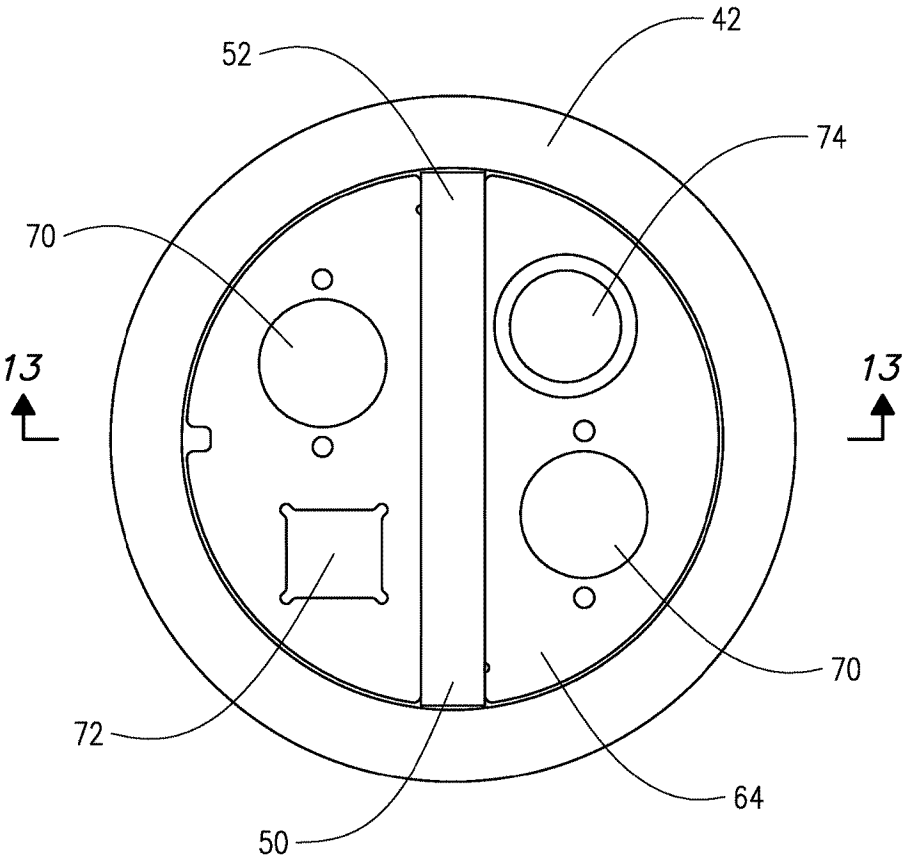
FIG. 12 is a top plan view of the structure of FIG. 11.
Figure 11:
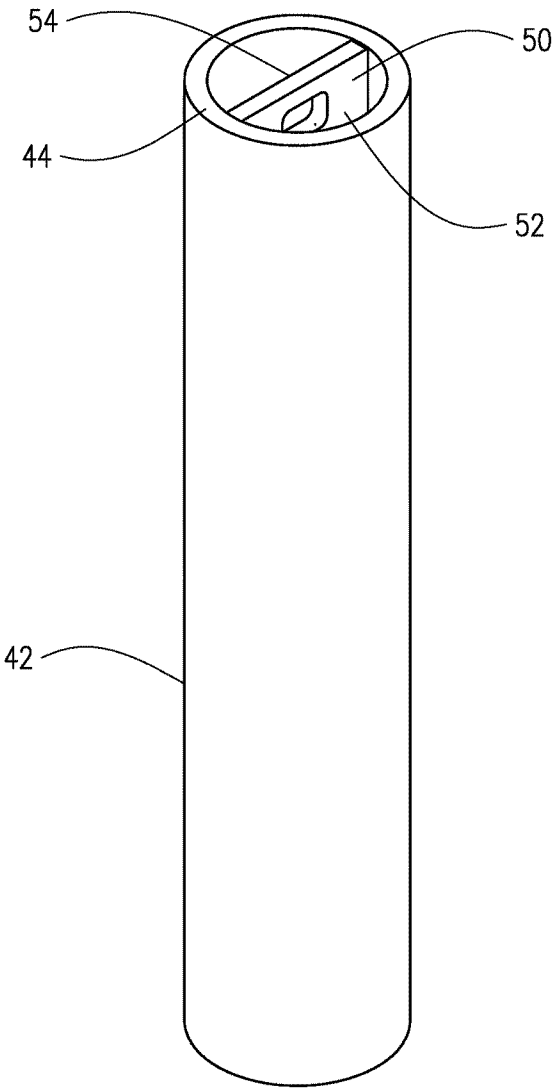
FIG. 11 is a perspective view of the structure formed by assembling the body of FIG. 5 with the partition of FIG. 6.
Figure 13:
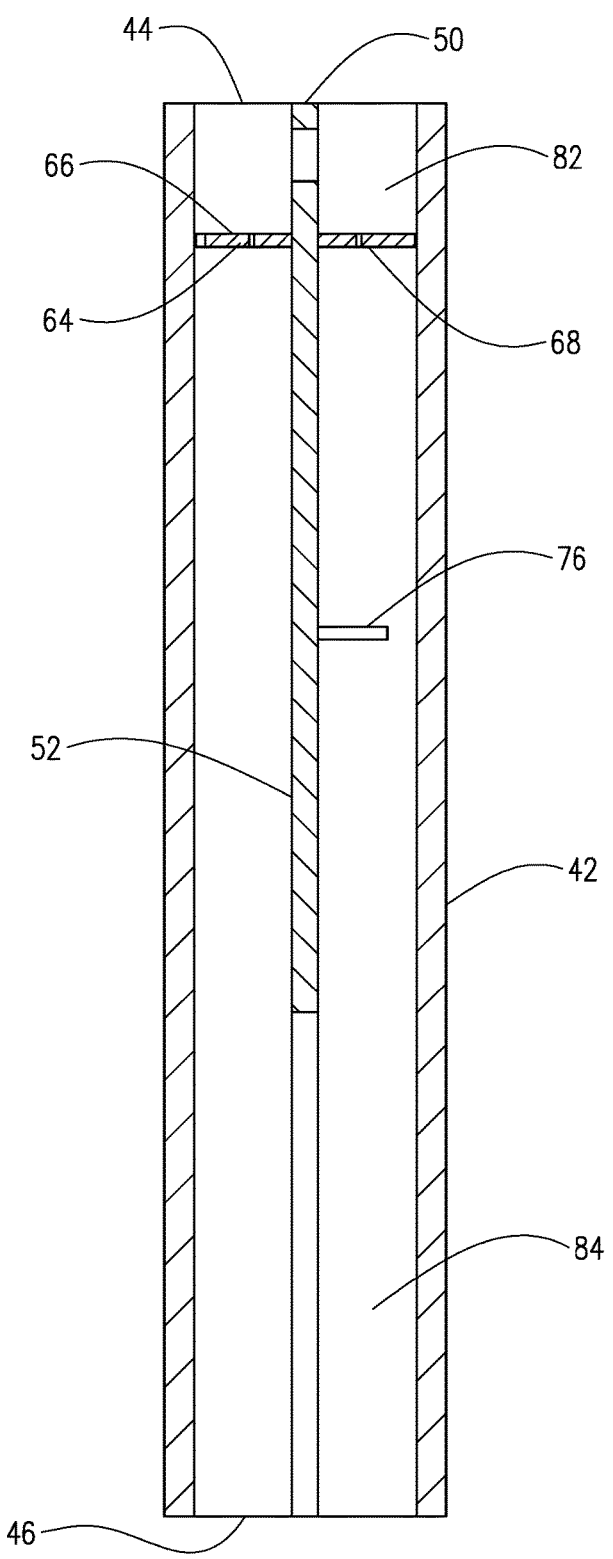
FIG. 13 is a front cross-sectional view of the structure of FIG. 12, taken along line 13-13.

The body 42 and partition 50 are assembled by inserting the partition 50 into the body 42 and positioning the upper ends 44 and 54, and the lower ends 46 and 56, in a coplanar relationship. At multiple areas of contact, the bollard 14 and partition 50 are permanently joined, preferably by welding. The resulting structure is shown in FIGS. 11-13.

Once assembled with the body 42, the partition 50 intersects the axis 48, and divides the body 42 into two halves, each preferably having a semicircular cross-sectional shape. Both the utility platform 64 and the lock support platform 76 extend transversely, and preferably orthogonally, to the axis 48 and wall 52. The utility platform 64 extends transversely, and preferably orthogonally, to the axis 48 and wall 52, and separates the interior of the body 42 into an upper compartment 82 and a lower compartment 84. The upper compartment 82 is accessible from the upper end 44 of the body 42. Optionally, the body 42 may be provided with a removable cap or closure at its upper end 44.

The bollard 14 further comprises a lift assembly 86 that is situated within the bollard 14 and engagable with the core 22, preferably at its upper surface 32. The lift assembly 86 has a less extended state, configured to urge increased axial separation between the body 42 and the core 22, and a more extended state.

Figure 14:
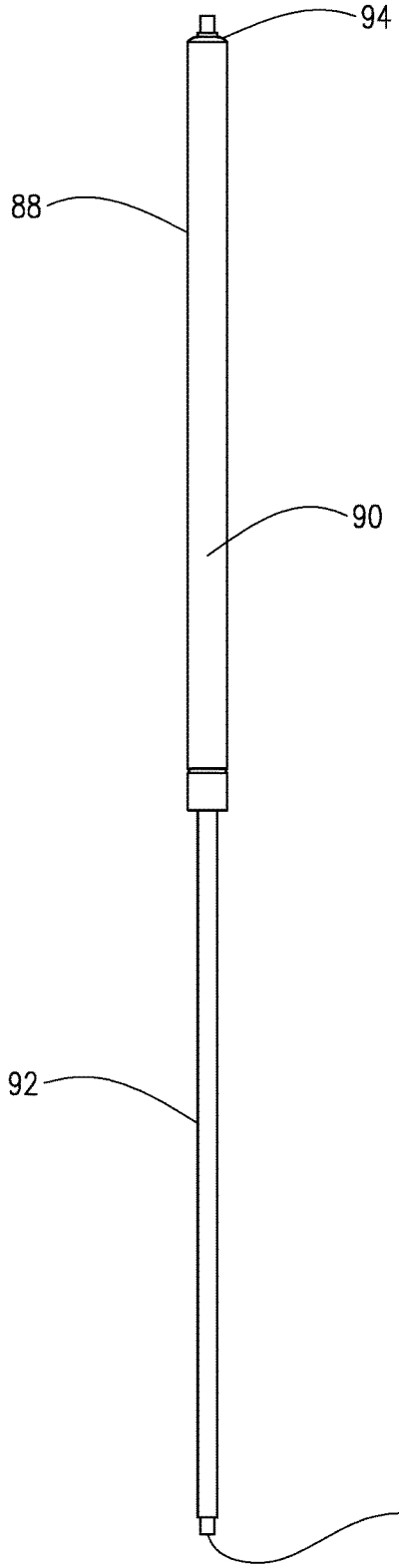
FIG. 14 is a front elevation view of a lifting element.

The lift assembly 86 is formed from at least one, and preferably a plurality of lifting elements 88, one of which is shown in FIG. 14. In the embodiment of the Figures, the lift assembly 86 consists of two lifting elements 88. Each lifting element 88 preferably comprises a static cylinder 90 that receives a telescoping and movable piston rod 92. The cylinder 90 contains a compressible gas and has a base portion 94 situated opposite the rod 92. The rod 92 has a free end 96 that always remains outside the cylinder 90.

In the least extended state of the lift assembly 86, the rod 92 of each lifting element 88 is retracted to the greatest extent possible within the cylinder 90. In the most extended state of the lift assembly 86, the rod 92 of each lifting element 88 extends outside the cylinder 90. The lift assembly 86 has an internal bias in favor of a more extended state.

Preferably, the lifting elements 88 are identical in size, shape and construction. More preferably, each lifting element 88 is a gas spring. In the previously-described embodiment of the bollard assembly 10, each lifting element 88 is a gas spring that produces 1,700 newtons of force, has a compressed length of 22.28 inches, and may be fully extended to a length of 41.97 inches.3

Figure 15:
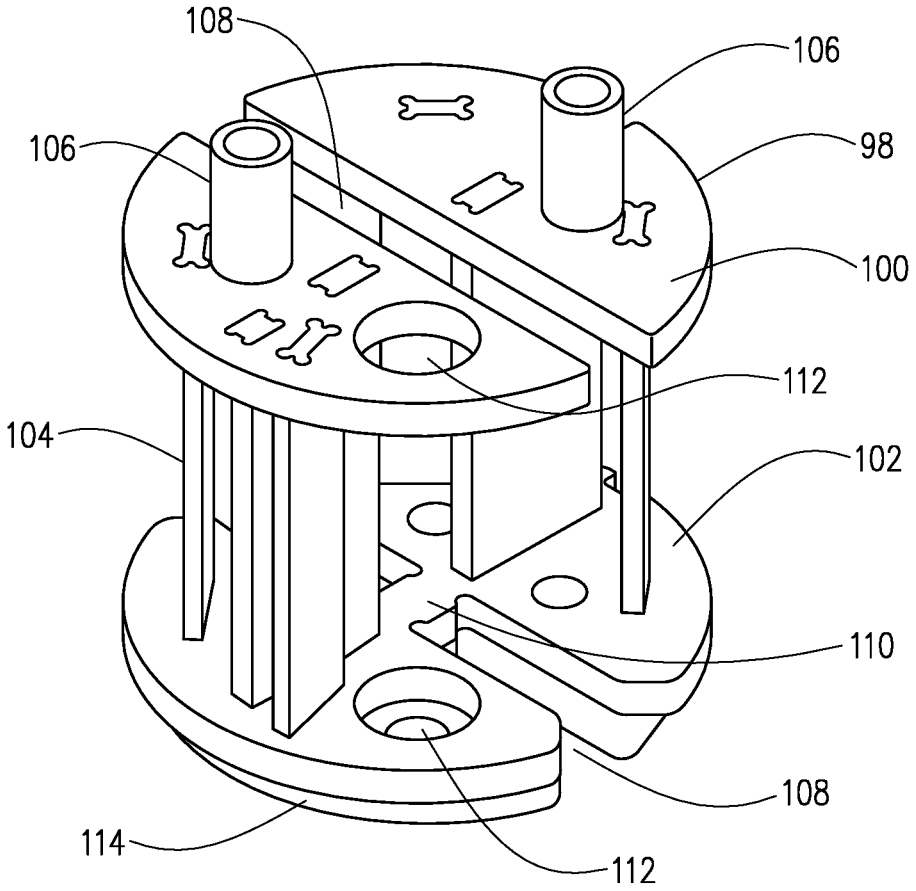
FIG. 15 is a perspective view of an extension fixture.

Further comprising the lift assembly 86, and situated at an extremity thereof, is an extension fixture 98, shown in FIG. 15. Preferably, the extension fixture 98 engages, projects from, and extends the effective reach of, the rods 92. The extension fixture 98 is sized to be axially receivable within the body 42.

The extension fixture 98 comprises a pair of flat and parallel plates 100 and 102 that are joined by a framework 104. Supported on the upper plate 100, opposite the framework 104, are one or more sockets 106, provided in a number that equals the number of lifting elements 88 in the lift assembly 86. In the embodiment of the Figures, two sockets 106 are provided. The pattern formed by the sockets 106 should register with the pattern of formed by the brace openings 70 in the utility platform 64.

Each socket 106 is sized to receive and secure a corresponding one of the rods 92, at its free end 96. Once attached at the sockets 106, the extension fixture 98 joins the rods 92, so that the rods 92 and the extension fixture 98 move together as a unit.

Parallel and aligned diametric gaps 108 are formed in each of the upper and lower plates 100 and 102. Each gap 108 is sufficiently wide to receive the wall 52 of the partition 50. The gap 108 completely bisects the upper plate 100, while the gap 108 in the lower plate 102 is interrupted by a narrow neck 110 that joins the two halves of the extension fixture 98.

A pair of aligned core access openings 112 are formed in the plates 100 and 102.

Figure 16:
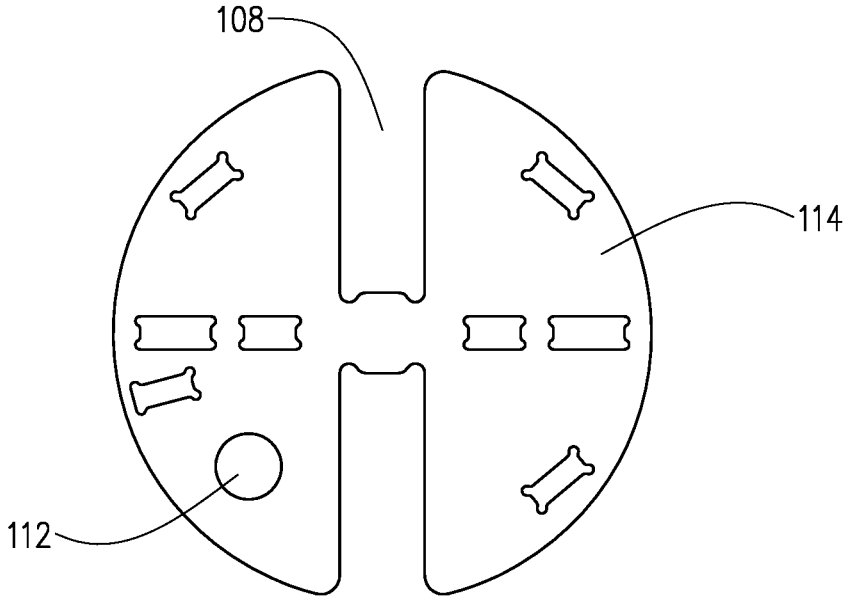
FIG. 16 is a top plan view of the push plate of the extension fixture of FIG. 15.
Figure 17:
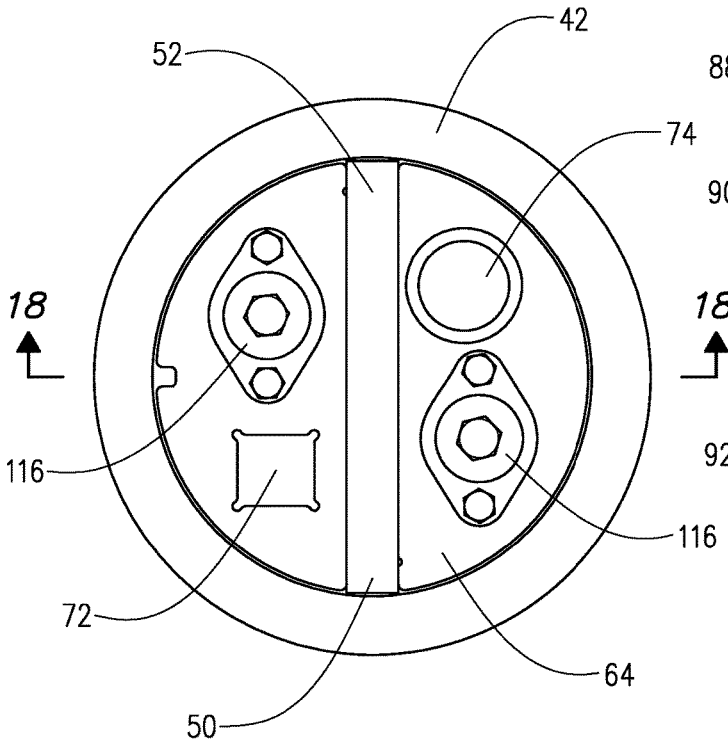
FIG. 17 is a top plan view of the structure formed by assembling the structure of FIG. 11 with two of the lifting elements of FIG. 14 and the extension fixture of FIG. 15.
Figure 18:
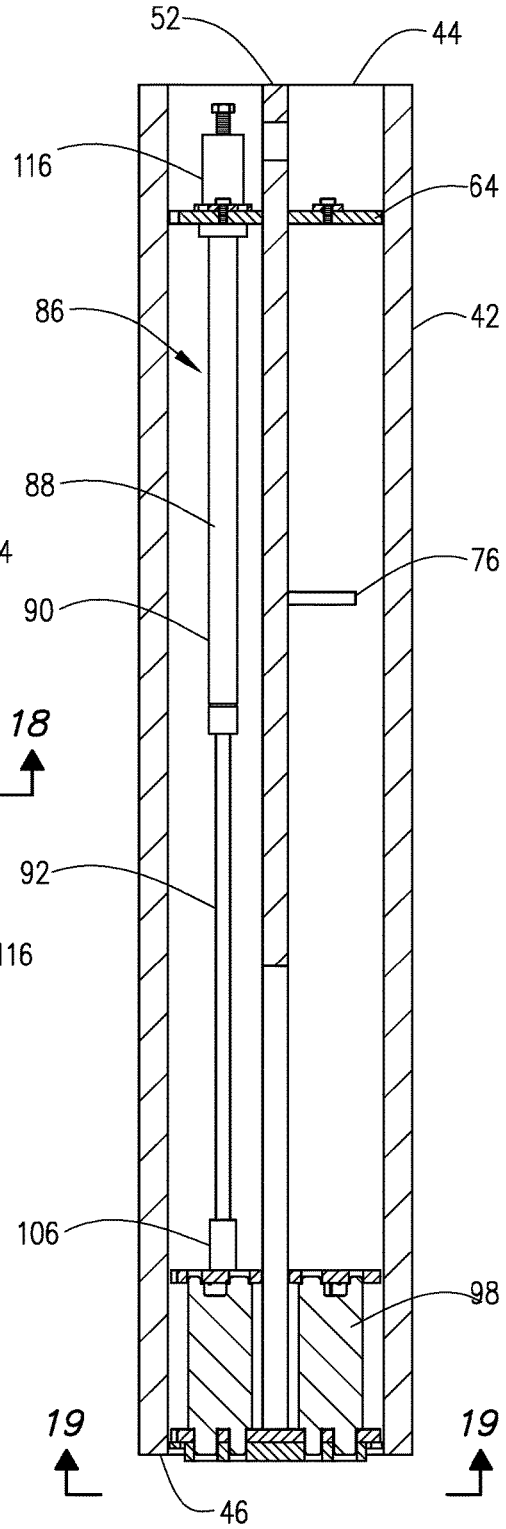
FIG. 18 is a front cross-sectional view of the structure of FIG. 17, taken along line 18-18.

The extension fixture 98 preferably further comprises an externally flat and smooth push plate 114, shown in FIG. 16. The push plate 114 provides a smooth and stable surface that presses against the core 22 as the bollard 14 is lifted.

The push plate 114 is secured to the lower plate 102 opposite the framework 104, preferably by welding. The push plate 114 has a gap 108 and a core access opening 112 that register with the corresponding structures in the lower plate 102. However, the push plate 114 has maximum cross-sectional dimensions that are less than the corresponding dimensions of the lower plate 102.

Each of the plates 100, 102 and 114 has an external cross-sectional shape that closely conforms to the inner contour of the body 42. More preferably, that external contour is circular.

In the previously-described embodiment of the bollard assembly 10, the extension fixture 98 has an overall length of 9.5 inches. Each of the upper and lower plates 100 and 102 is 0.5 inches thick, and has the general shape of a circle. The diameter of that circle is 8.25 inches. The core access opening 112 of each of the plates 100 and 102 is circular, with a diameter of 1.75 inches. The push plate 114 is 0.75 inches thick and has the general shape of a circle. The diameter of that circle is 7.13 inches. The core access opening 112 of the plate 114 is circular, with a diameter of 0.88 inches.

The lift assembly 86 is assembled with the structure of FIGS. 11-13 by inserting a lifting element 88 into the body 42, such that the base portion 94 of its cylinder 90 faces the lower side 68 of the utility platform 64. The base portion 94 is inserted through one of the brace openings 70, and secured to the upper side 66 by an attachment, such as a socket 116. These steps are repeated for each lifting element 88 of the lift assembly 86.

Once a lifting element 88 has been attached at its cylinder 90 to the utility platform 64, its opposite end is attached to the extension fixture 98. Specifically, the extension fixture 98 is inserted, with upper plate 100 forward, into the body 42 at its lower end 46. The free end 96 of each rod 92 is installed in a corresponding one of the sockets 106 carried by the upper plate 100, and secured in place. In the structure thus produced, the core access openings 112 in the extension fixture 98 should align with the core access openings 74 and 78 in the platforms 64 and 76.

Figure 19:
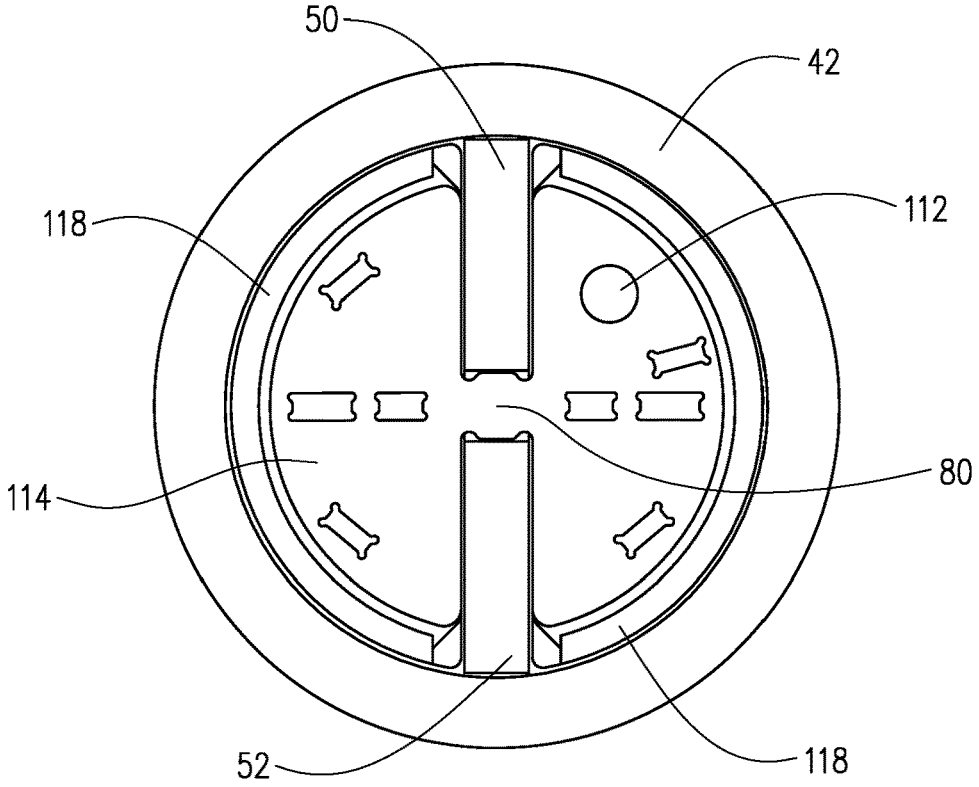
FIG. 19 is a bottom plan view of the structure of FIG. 18, taken along line 19-19.

After the lift assembly 86 has been installed within the body 42, an annular stop element 118, shown in FIG. 19, is attached to the lower end 46 of the body 42, preferably by welding. The stop element 118 is supported by the body 42 and configured to limit extension of the lift assembly 86, while permitting passage of a minor portion, and no more than a minor portion, of the extension fixture 98 therethrough.

Figure 20:
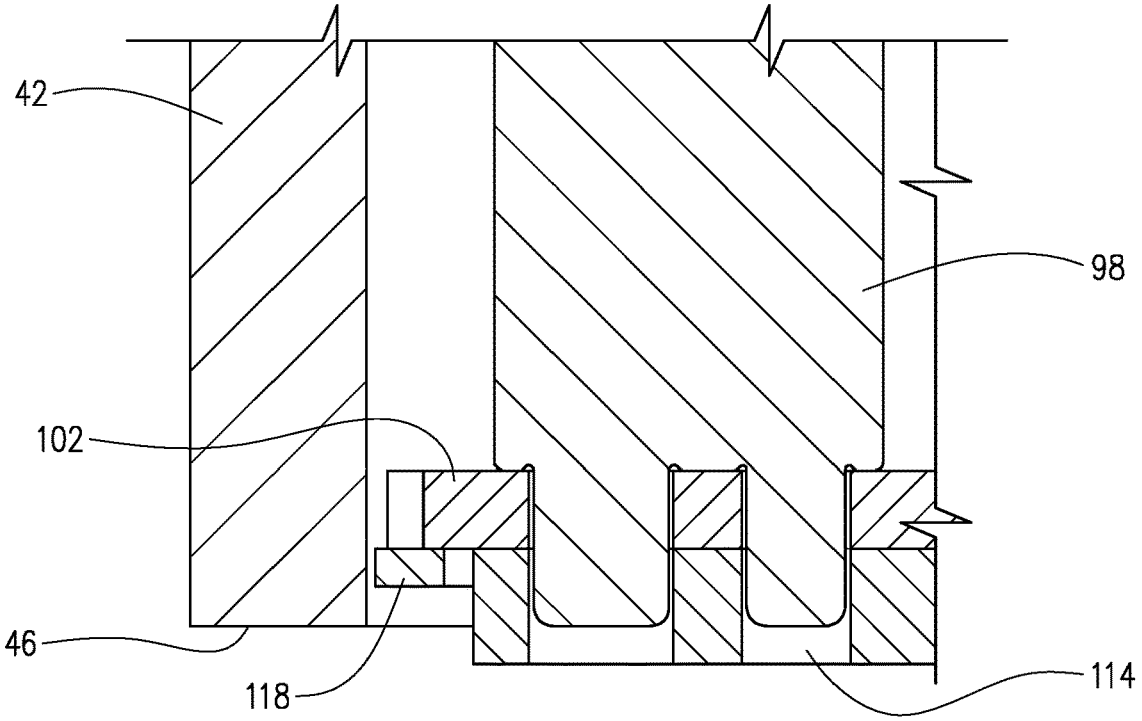
FIG. 20 is an enlarged cross-sectional view of the lower end of the structure of FIG. 18.

More particularly, the opening of the stop element 118 is sized to permit passage of the push plate 114, but not other components of the extension fixture 98. As the lifting elements 88 extend toward the lower end 46, the stop element 118 engages the lower plate 102 of the extension fixture 98, and blocks further extension of the rods 92. With the lower plate 102 thus engaged, only a portion of the push plate 114, and no other part of the lift assembly 86, projects outside the body 42. The foregoing arrangement of components is shown in FIG. 20.

In the previously-described embodiment of the bollard assembly 10, the stop element 118 has an annular shape with an external diameter of 8.375 inches and an opening diameter of 7.5 inches. Gaps are provided in the annulus in order to fit it around the lower end 56 of the wall 52.

In the least extended state of the lifting elements 88, the lift assembly 86 remains wholly contained within the body 42. In the most extended state of the lifting elements 88, the lift assembly 86 remains almost wholly contained within the body 42, the only exception being the projecting portion of the push plate 114.

The bollard assembly 10 further comprises a locking system 120 that has two, and preferably only two, states. In a locked state, the locking system 120 restrains the lift assembly 86 in a less extended state. In an unlocked state, the locking system 120 releases the less extended lift assembly 86 from restraint.

Figure 21:
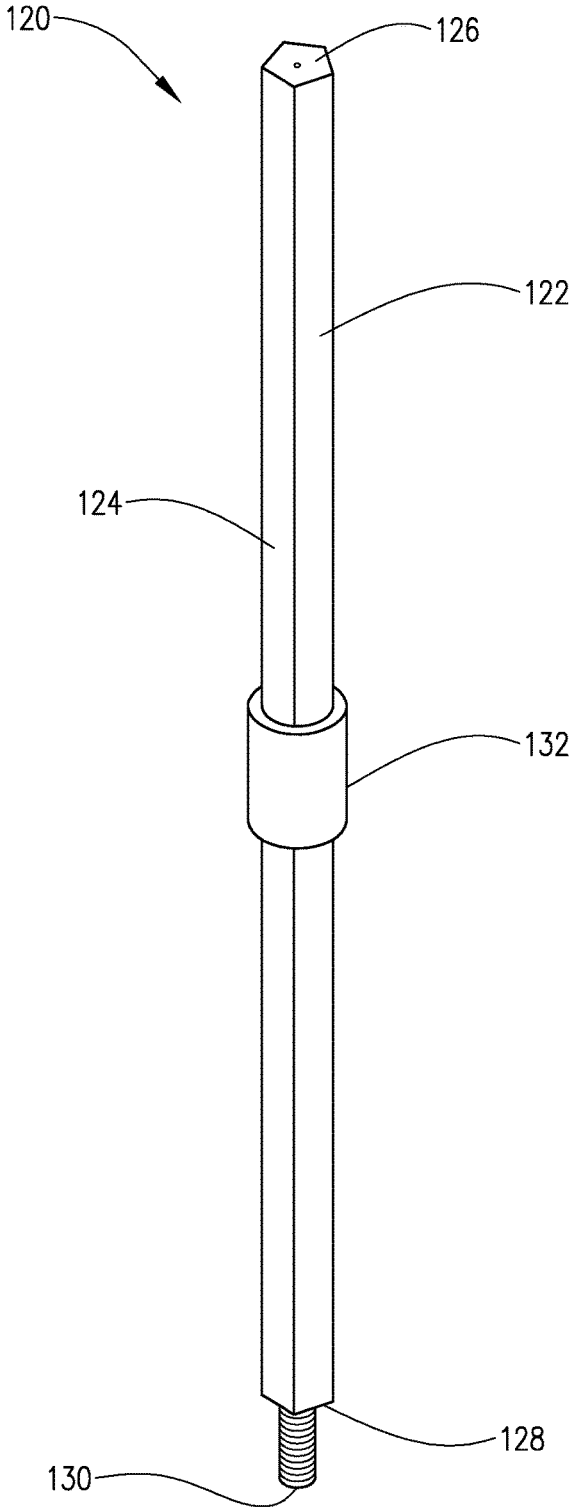
FIG. 21 is a perspective view of a locking structure.

The locking system 120 comprises the aforementioned lock receiver 34 and a rigid and elongate locking structure 122, shown in FIG. 21. Preferably, the locking structure 122 is rotatable, and is configured to produce the locked and unlocked states of the locking system 120 by such rotation.

The locking structure 122 is preferably formed from an elongate and rectilinear rod 124 having opposed upper and lower ends 126 and 128. The rod 124 is preferably characterized by a polygonal, and more preferably pentagonal, cross-sectional shape. A cylindrical stub 130 is attached to the lower end 128 of the rod 124. The stub 130 is provided with external threads that can mate with the internal threads of the lock receiver 34.

The rod 124 and stub 130 are sized to be receivable through each of the core access openings 74, 78 and 112, and have sufficient length, when attached, to permit the stub 130 to reach the lock receiver 34 when the upper end 126 of the locking structure 122 is positioned above the utility platform 64 and the lift assembly 86 is in a less extended state.

Preferably, the locking structure 122 includes a constricted portion and an enlarged portion. The constricted portion is sized to pass through the core access opening 78 in the lock support platform 76. The enlarged portion has cross-sectional dimensions greater than those of the constricted portion, and is sized not to pass through the same opening. In the embodiment of FIGS. 1-29, a collar 132 that may be fitted over the rod 124 establishes an enlarged portion, while the balance of the rod 124, away from the site of the collar 132, remains a constricted portion.

The locking structure 122 is positionable within an elongate and rectilinear core access passage 134 situated within the body 42, and unblocked by any structure therein. The core access passage 134 interconnects the utility platform 64 and the lower end 46 of the body 42, passes through the core access openings 74, 78 and 112, and terminates immediately above the lock receiver 34. Preferably, the core access passage 134 extends parallel to the axis 48. In the embodiment of FIGS. 1-29, the core access passage 134 is laterally offset from the axis 48.

The locking structure 122 is installed by extending the rod 124 through the core access opening 74 in the utility platform 64. Before the rod 124 reaches the core access opening 78, the collar 132 is loosely fitted over the rod's lower end. The rod 124 is then passed through the core access openings 78 and 112, while the collar 132 remains above the lock support platform 76. Once threads on the stub 130 mate with corresponding threads in the lock receiver 34, the collar 132 is tightened onto the rod 124 such that it rests on the lock support platform 76.

With the locking structure 122 resident in the core access passage 134, the locking system 120 may be placed into its locked state by rotating the locking structure 122 until threads on the stub 130 mate with corresponding threads in the lock receiver 34. The locking structure 122 thereby becomes rigidly attached to the core 22. Upward movement of the body 42, urged by the lift assembly 86, is blocked by the engagement between the collar 132 and the lock support platform 76.

With the locking structure 122 resident in the core access passage 134, the locking system 120 may be placed in its unlocked state by rotating the locking structure 122 in the opposite direction until the stub 130 disengages from the lock receiver 34. The locking structure 122 thereby becomes unattached from the core 22. Upward movement of the body 42, urged by the lift assembly 86, causes the body 42 to lift away from the core 22. At least a portion of the locking system 120, namely the locking structure 122, moves as a unit with the body 42 when the locking system 120 is placed in its unlocked state.

In the previously-described embodiment of the bollard assembly 10, the locking structure 122 has a total length of 36.75 inches. A section with a pentagonal cross section has a length of 35.25 inches and a maximum width of 1.5 inches. An adjoining cylindrical stub 130 has an exposed length of 1.5 inches and a diameter of 0.75 inches. The collar 132 has an external diameter of 2.06 inches.

Figure 22:
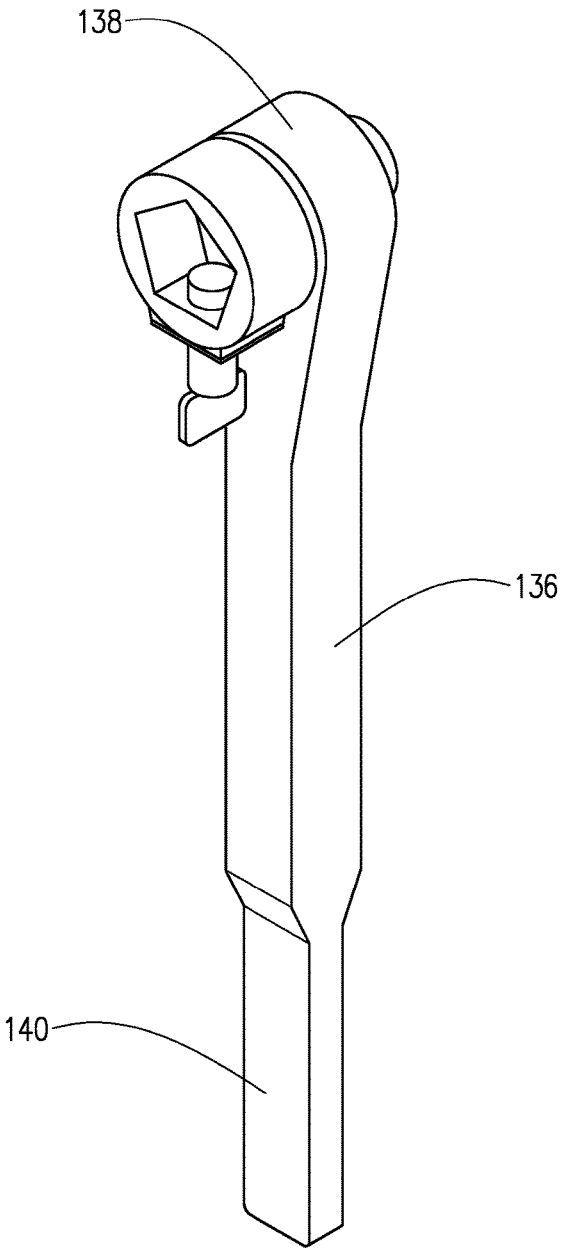
FIG. 22 is a perspective view of a wrench.

The bollard assembly 10 preferably further comprises a wrench 136, shown in FIG. 22. The wrench 136 is configured to drive rotation of the locking structure 122, and comprises a head 138 supported by an elongate handle 140. Preferably the head 138 has a shape configured to conform to the polygonal cross-sectional shape of an end of the locking structure 122. More preferably, that shape is pentagonal. In one embodiment, the wrench 136 is a standard fire department hydrant wrench.

The head 138 is sized to be wholly receivable within the upper compartment 82, while being too large to pass through the tool extension opening 72 in the utility platform 64. The wrench 136 is installed within the bollard 14 by passing its handle 140 through the tool extension opening 72 until the head 138 engages the utility platform 64. The handle 140 extends within the lower compartment 84, while the head 138 resides within the upper compartment 82.

In the previously-described embodiment of the bollard assembly 10, the wrench 136 has an overall length of 18 inches. The head 138 has a maximum cross-sectional dimension of 3.38 inches, while the handle 140 has a maximum cross-sectional dimension of 1.31 inches. The head 138 has a height of 1.81 inches.

Figure 23:
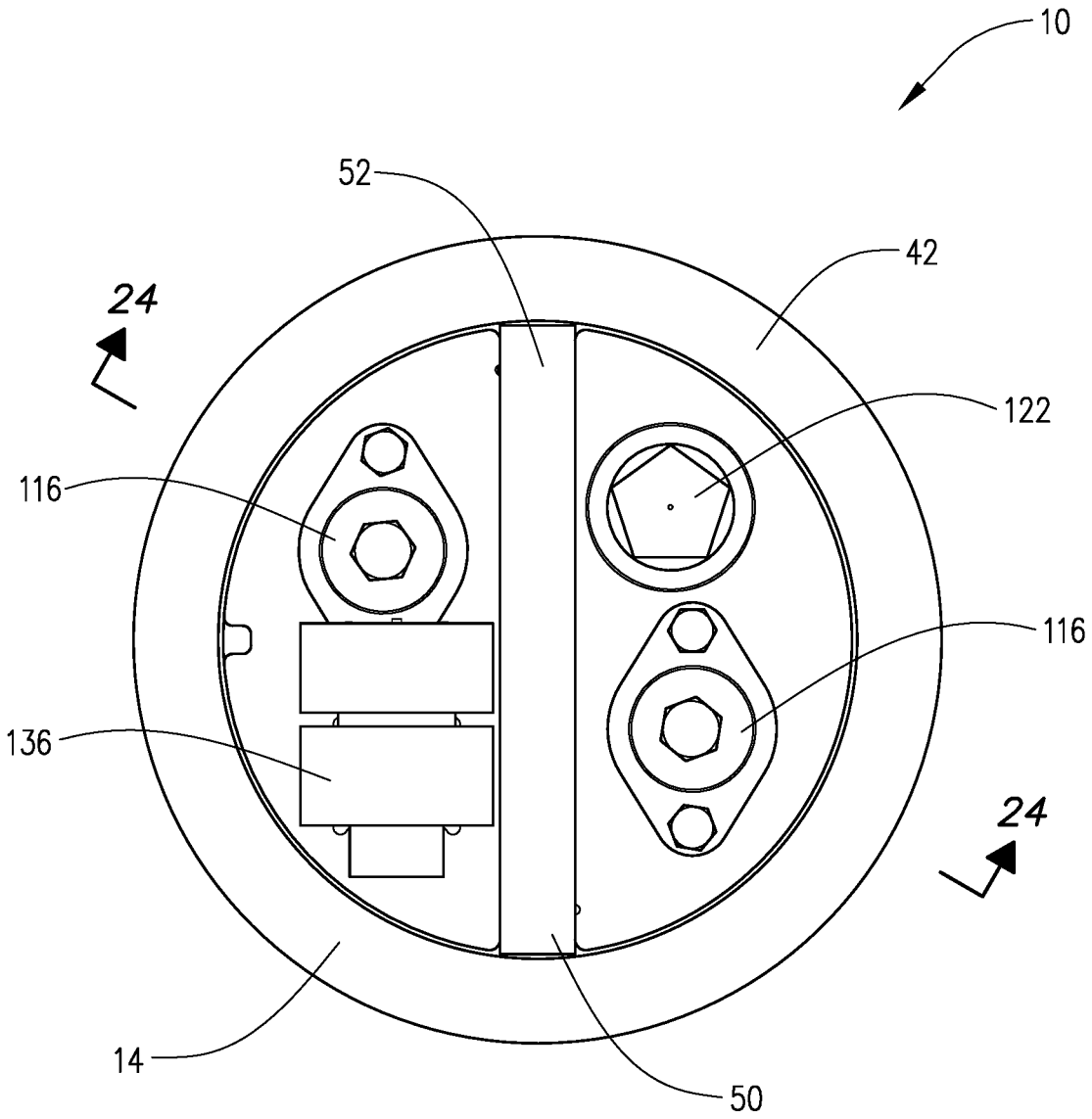
FIG. 23 is a top plan view of the bollard of the bollard assembly of FIG. 1. It has been formed by assembling the structure of FIG. 17 with the locking structure of FIG. 21 and the wrench of FIG. 22.
Figure 24:
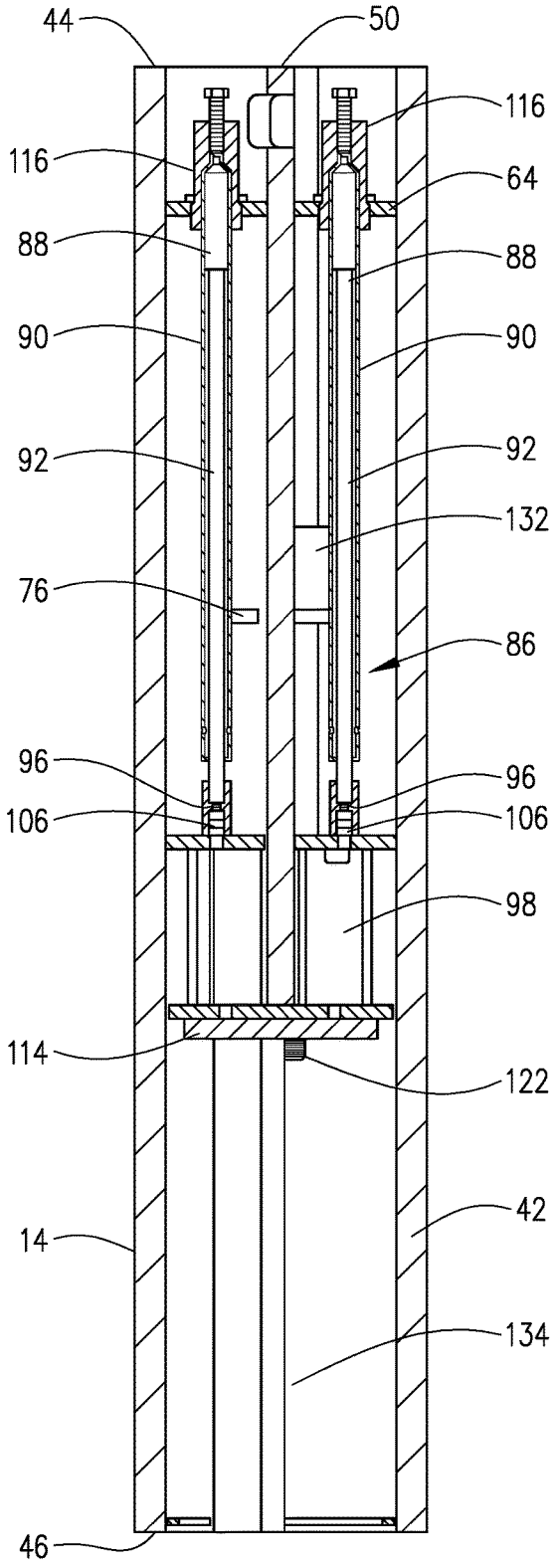
FIG. 24 is a front cross-sectional view of the bollard of FIG. 23, taken along line 24-24. The lifting elements are in their less extended states.
Figure 25:
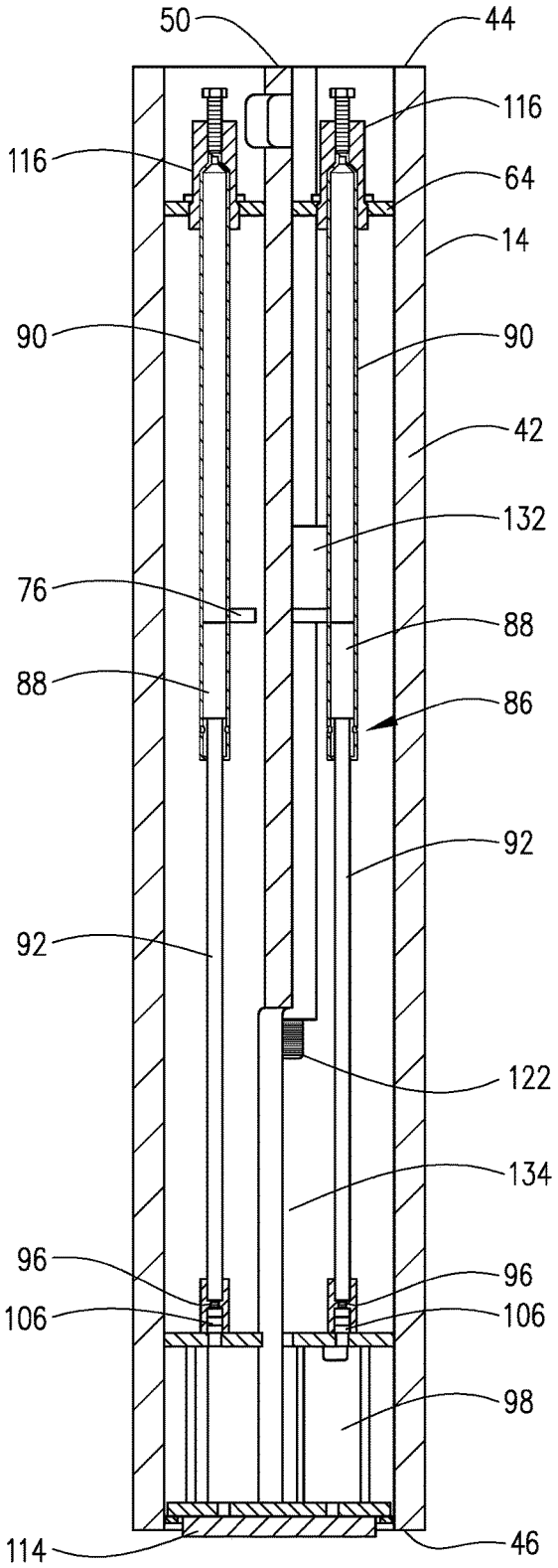
FIG. 25 is a front cross-sectional view similar to FIG. 24, differing in that the lifting elements are in their more extended states.

FIGS. 23-25 show the complete bollard 14. It has been formed by assembling the structure of FIGS. 17-19, the locking structure of FIG. 21 and the wrench of FIG. 22. FIG. 24 shows the bollard 14 with the lifting elements 88 in their unextended states. In FIG. 25, the lifting elements 88 have shifted to their extended states.

Figure 1:
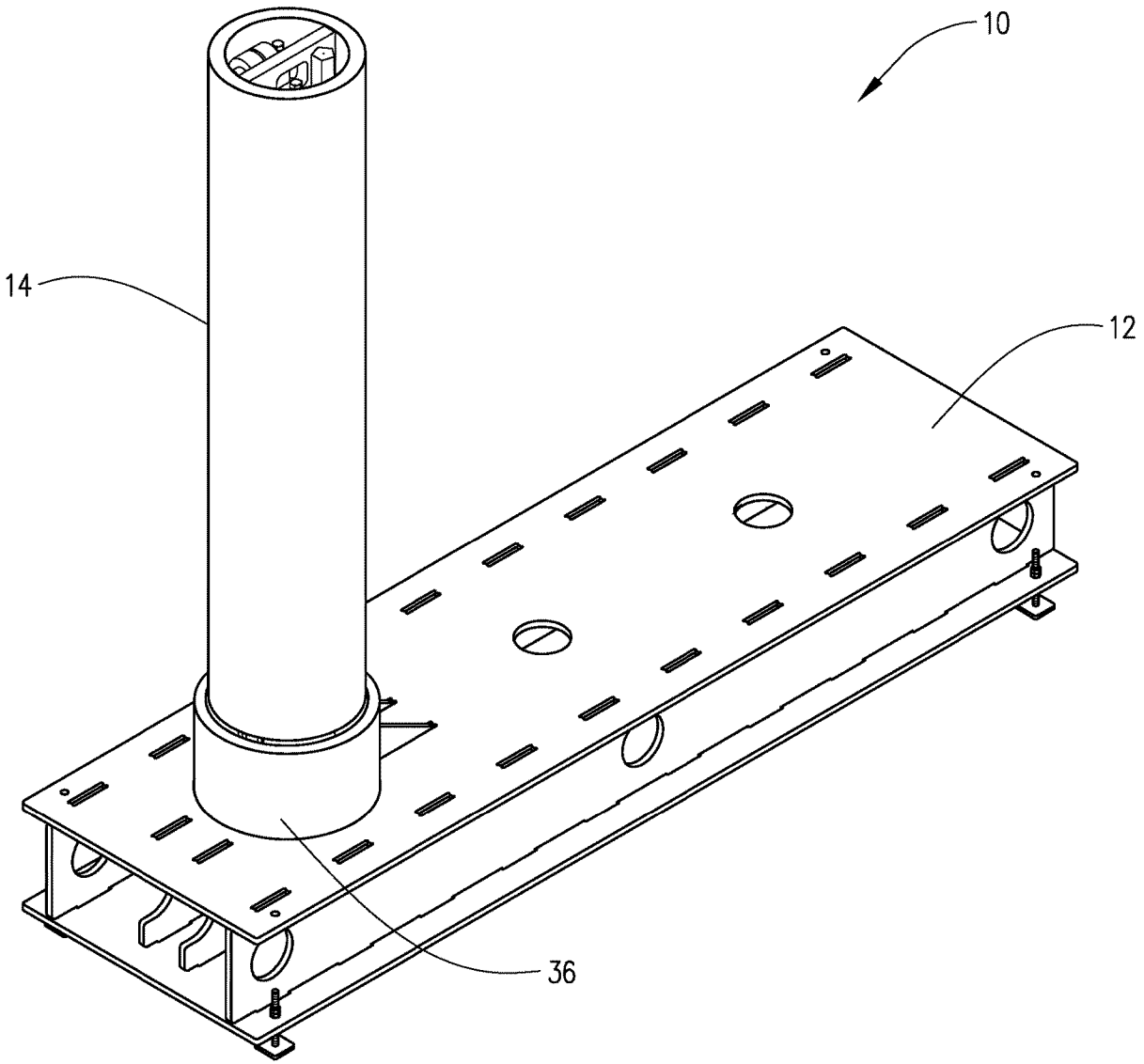
FIG. 1 is a perspective view of a bollard assembly.

The bollard assembly 10 is formed by inserting the bollard 14, shown in FIG. 24, into the annular recess 40 of the socket 36, shown in FIG. 4. The bollard 14 is pushed downward under pressure until the lower end 46 engages the socket base 24. The locking structure 122 is installed, if necessary, and rotated to place the locking system 120 in a locked state. Preferably, rotation of the locking structure 122 is driven by the wrench 136. The lift assembly 86 and core 22 are thereby joined. The resulting configuration of the bollard assembly 10 is shown in FIGS. 1 and 26.

To remove the bollard 14 from the foundation 12, the installed locking structure 122 is rotated to place the locking system 120 in an unlocked state. Preferably, this rotation is driven by the wrench 136. The lift assembly 86 is thereby released from engagement with the core 22, and causes the body 42 to rise from the socket 36. As the lift assembly 86 extends, the locking structure 122 is prevented from falling into the lower compartment 84 of the body 42 by engagement between the collar 132 and the lock support platform 76.

Figure 27:
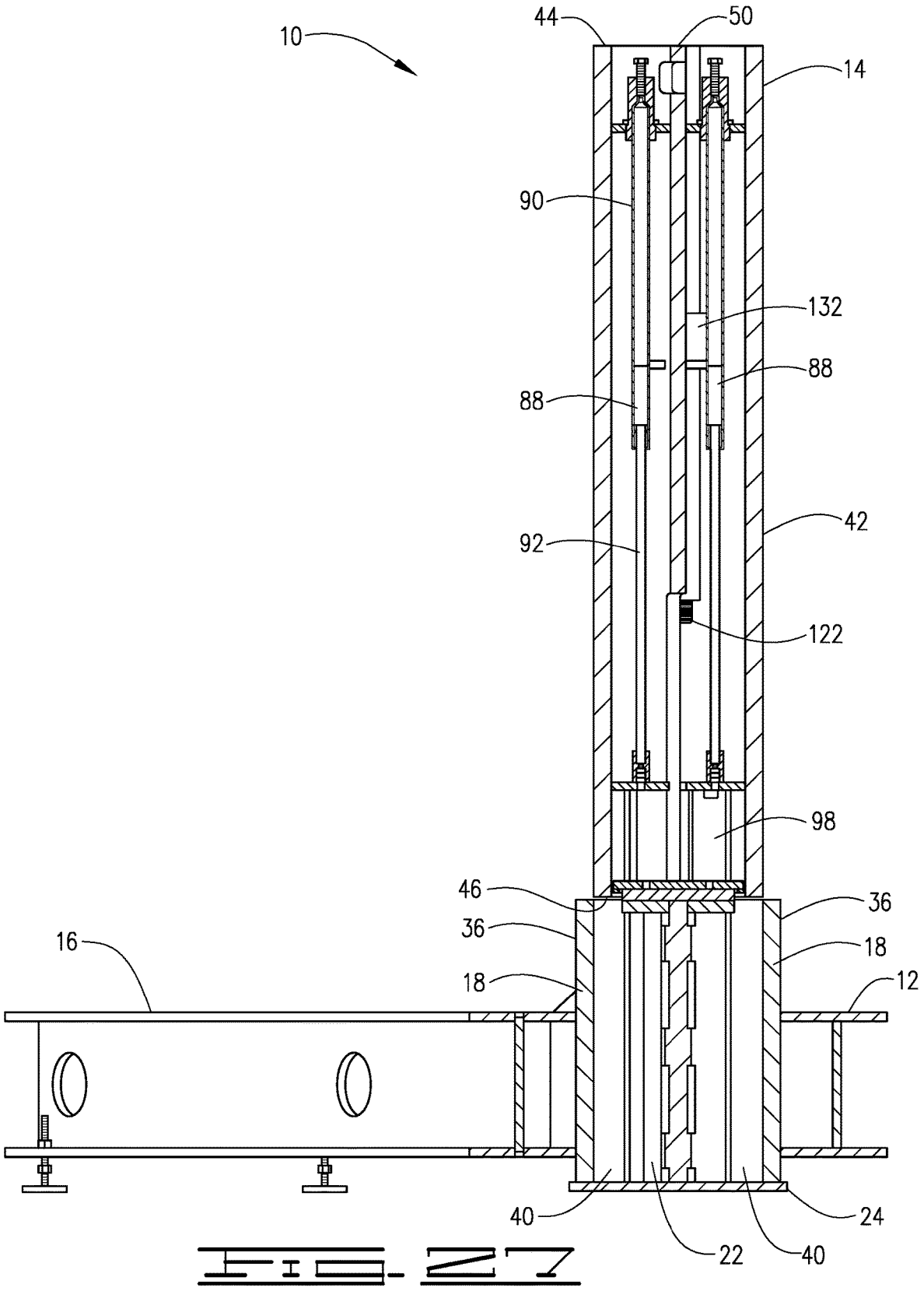
FIG. 27 is a front cross-sectional view similar to FIG. 26, differing in that the lifting elements are in their more extended states.
Figure 28:
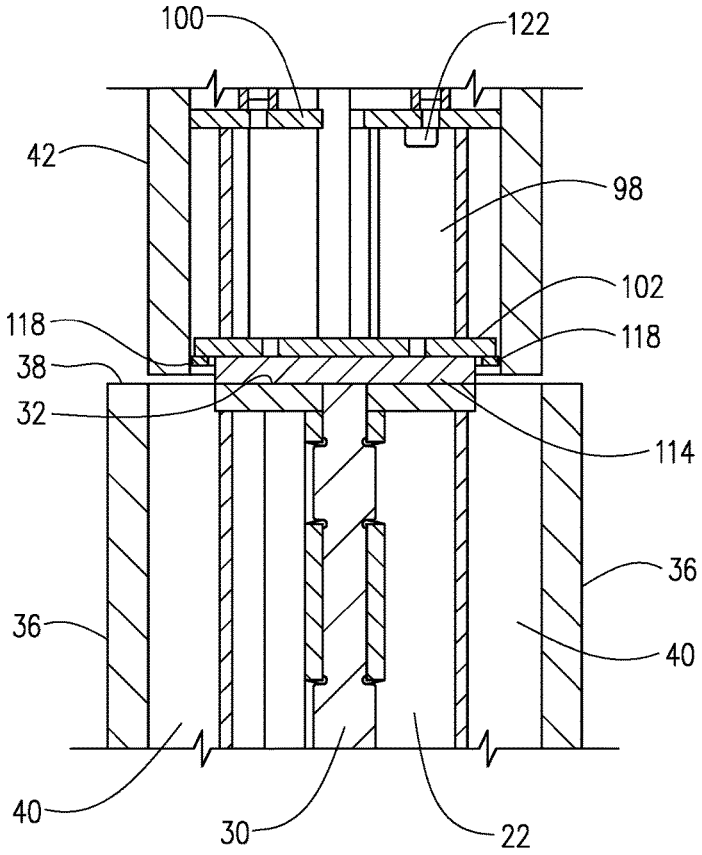

The extension fixture 98 engages the upper surface 32 of the socket core 22 at push plate 114, and the lift assembly 86 causes the body 42 from the socket 36 without external assistance. Lifting stops when the extension fixture 98 engages the stop element 118, thereby blocking further extension of the rods 92. The resulting configuration of the bollard assembly 10 is shown in FIG. 27. Because the lifted bollard 14 is unfastened to the foundation 12, it is easily removed from the site of the foundation 12, without need for special tools or external lifting equipment.

Figure 28:
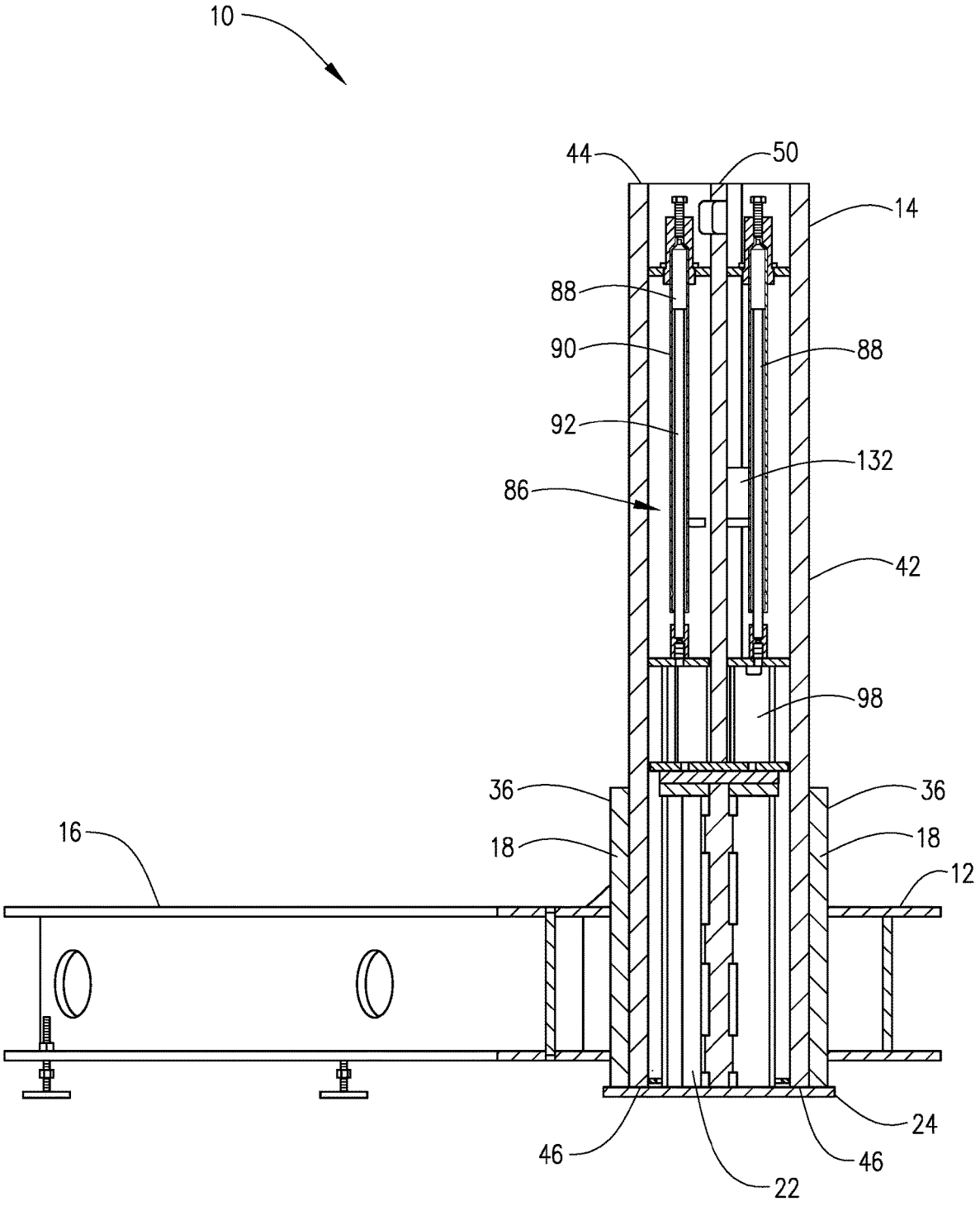
FIG. 28 is an enlarged and detailed view of the bollard assembly of FIG. 27, showing the lower end of the bollard and its interface with the socket.

When the extension fixture 98 engages the stop element 118, the push plate 114 passes through the central opening of the stop element 118, and projects outside the lower end 46 of the body 42, as shown in FIG. 28. Preferably, the extent that the push plate 114 projects from the body 42 is greater than zero. Also preferably, the extent of projection is less than or equal to about 1.0 inch. More preferably, the extent of projection is less than or equal to about 0.5 inches. Most preferably, the extent of projection is less than or equal to about 0.25 inches. In the embodiment of the Figures, the extent of projection by the push plate 114 is 0.25 inches.

Projection of the push plate 114 from the bollard 14 causes the bollard 14 to raise slightly above and slightly outside the socket 36. Such positioning assists in preventing the foundation 12 from interfering with removal.

Figure 29:
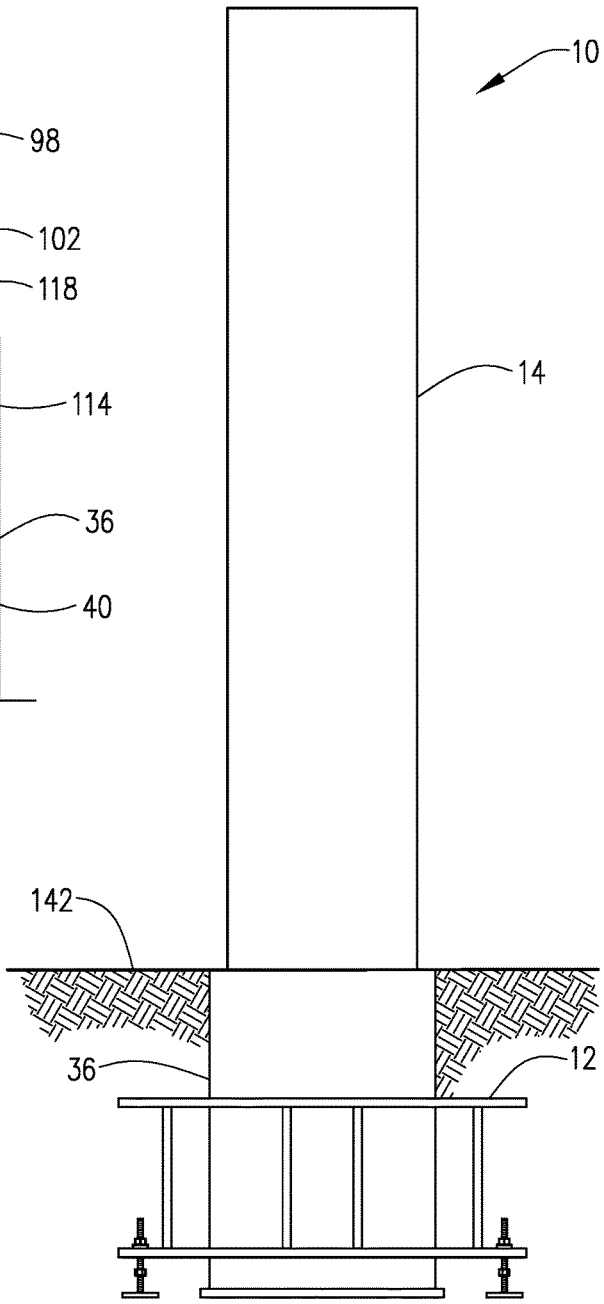
FIG. 29 is a sectional elevation view of the bollard assembly of FIG. 1 embedded in a ground area.

The bollard assembly 10 may be installed in a ground area 142, as shown in FIG. 29. The ground area 142 may comprise soil or some other substrate, such as concrete. The socket 36 is at least partially buried within the ground area 142, and the bollard 14 received in the socket 36. More preferably, the foundation 12 is embedded within the ground area 142 such that the upper end 38 of the socket 36 coincides the ground surface. While the lift assembly 86 is unextended, the lower end of the bollard 14 resides below the ground surface. When the lift assembly 86 is extended, the bollard 14 sits slightly above the ground surface, where it may be removed.

Another embodiment of a bollard assembly 144, shown in FIGS. 30-60, is formed from a foundation 146 that supports a bollard 148.

Figure 31:
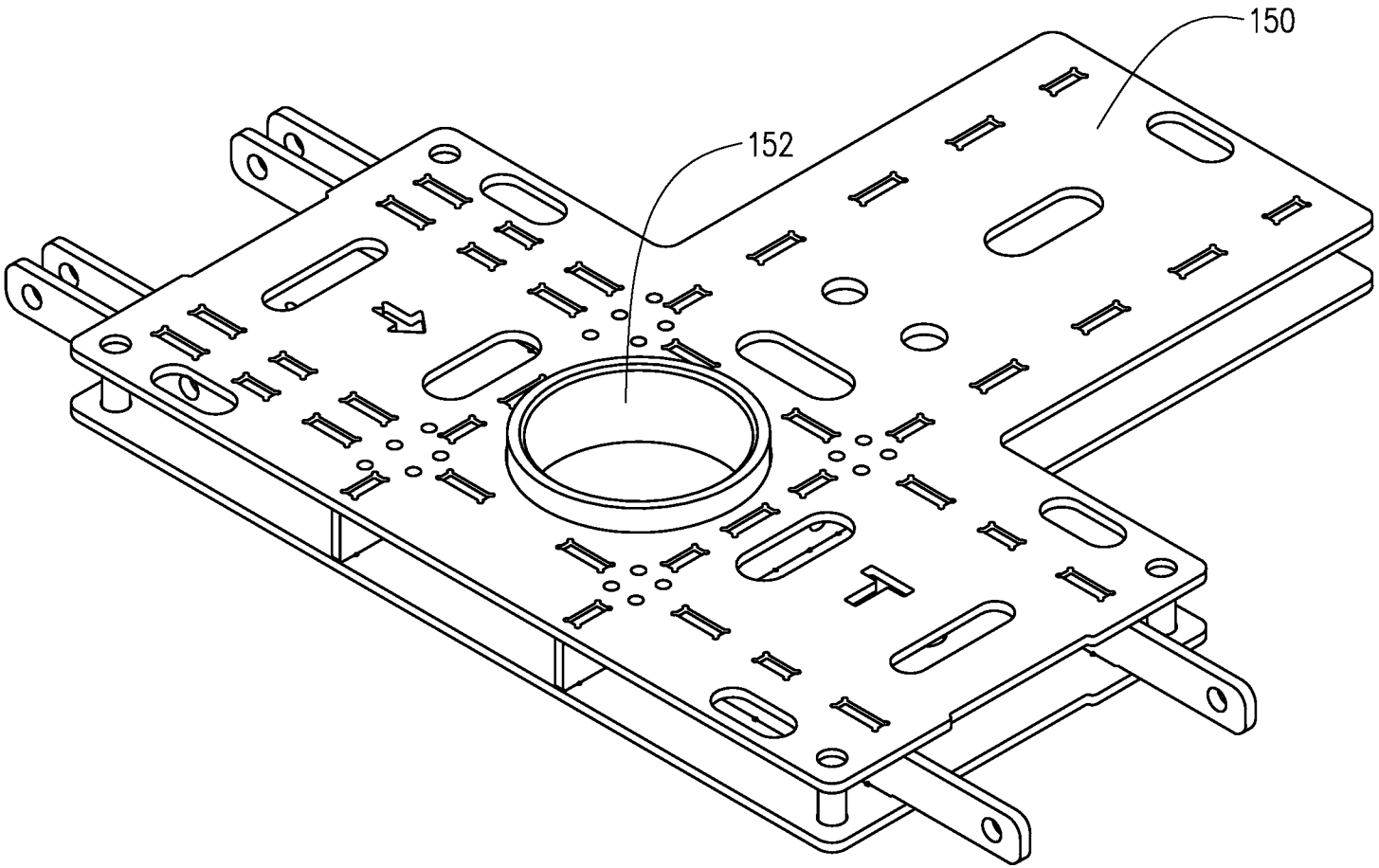
FIG. 31 is a perspective view of a framework and shell.

The foundation 146 is formed from a shallow framework 150, shown in FIG. 31. In one embodiment, the framework 150 is formed from a pair of intersecting legs arranged in shape of the letter "L." In other embodiments, the foundation may have a different shape, such as that of the letter "T."

At the intersection of the legs, the framework 150 is traversed orthogonally by an elongate and hollow shell 152 having opposed upper and lower ends. Preferably, the shell 152 is cylindrical in shape, open at each of its ends, and sized to receive one end of the bollard 148.

The shell 152 is preferably formed from a strong and durable material, such as steel, and is permanently joined to the framework 150, preferably by welding. Construction of the shell 152, and its installation and arrangement in relationship to the framework 150, are preferably identical to those described with reference to the shell 18 of the embodiment of FIGS. 1-29.

Figure 32:
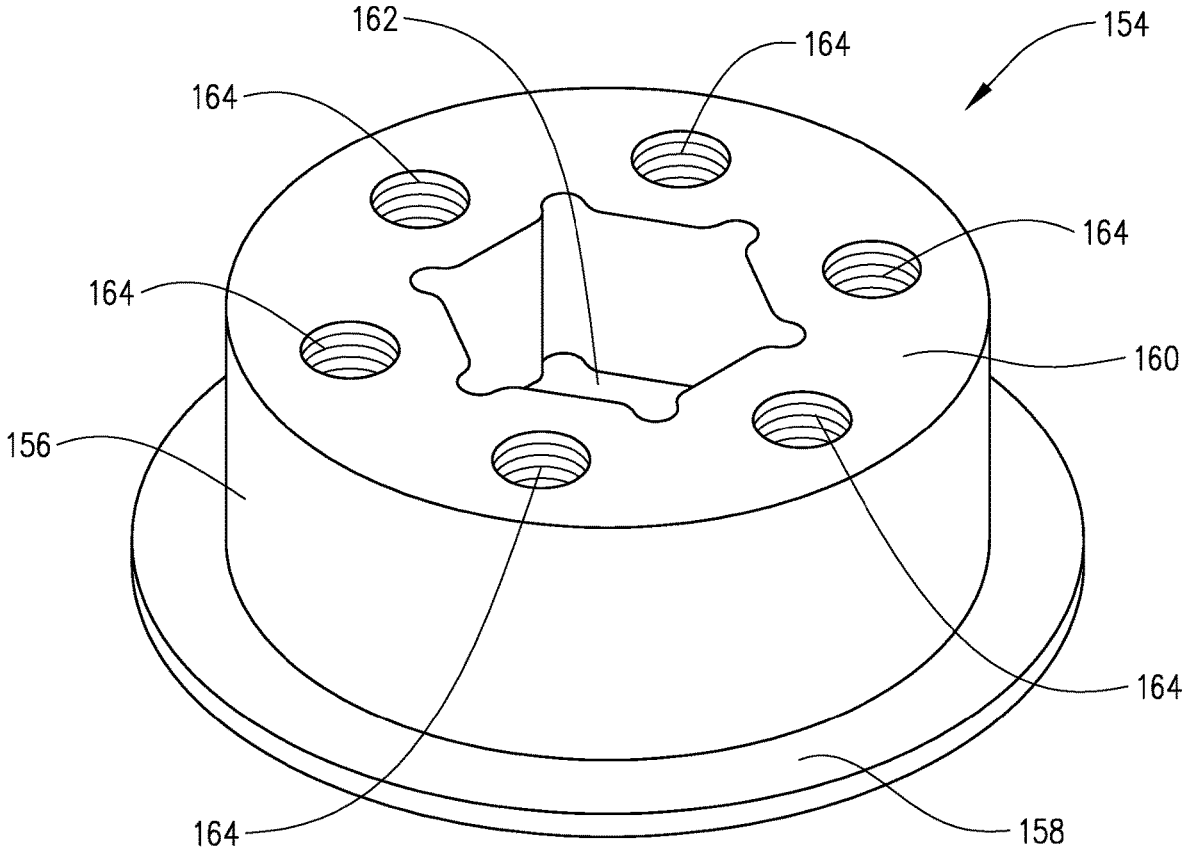
FIG. 32 is a perspective view of a socket core.

Further comprising the foundation 146 is a core assembly 154, shown in FIG. 32. The core assembly 154 comprises a core 156 supported by a flat base 158. Preferably, the base 158 is sized and shaped to be closely but clearingly received within the lower end of the shell 152. In the embodiment of the Figures, the base 158 is circular in shape.

The core 156 is generally cylindrical in shape, and is sized to be axially receivable within the shell 152. The exposed upper surface 160 of the core 156 is planar, spaced above the base 158, extends parallel to the base 158, and is preferably circular in shape. Preferably, the core 156 has a lesser height than the shell 152.

A centrally-disposed recess 162 is formed in the upper surface 160 of the core 156. Preferably, the recess has a polygonal, and more preferably hexagonal, cross-sectional shape. A plurality of fastener openings 164, preferably internally threaded, are formed in the upper surface 160 and arranged peripherally around the recess 162. In the embodiment of the Figures, the number of fastener openings 164 is six.

The core assembly 154 is joined to the framework 150 and shell 152 by inserting the core 156 into the lower end of the shell 152, so that the core 156 and shell 152 extend coaxially. The base 158 is then inserted within and permanently joined to the lower end of the shell 152, preferably by welding. The resulting structure is shown in FIG. 33.

The shell 152 and core 156 cooperate to form a socket 166 having an open upper end 168. An annular recess 170, best shown in FIG. 59, extends coaxially between the shell 152 and the core 156. The lower end of the bollard 148 is concentrically receivable within the socket 166 at the recess 170. When so received, the lower end of the bollard 148 engages the base 158.

In one embodiment of the bollard assembly 144, the foundation 146 is formed from a T-shaped framework 150 having a maximum length and maximum width of 57.875 inches. Each leg of the "T" has a width of 28.75 inches. The depth of the framework 150 is 4.5 inches. The shell 152 is formed from steel pipe, and has an external diameter of 14 inches, a wall thickness of 0.91 inches and a height of 6 inches. The core 156 has a diameter of 9.75 inches and a height of 3.63 inches. The base 158 is circular, with a diameter of 12.125 inches and a thickness of 0.5 inches. The depth of the recess 162 and fastener openings 164 is 2 inches.

Figure 34:
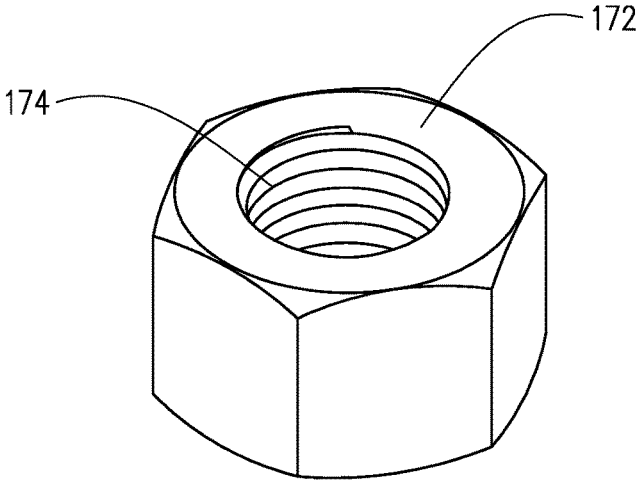
FIG. 34 is a perspective view of a lock receiver.
Figure 22:
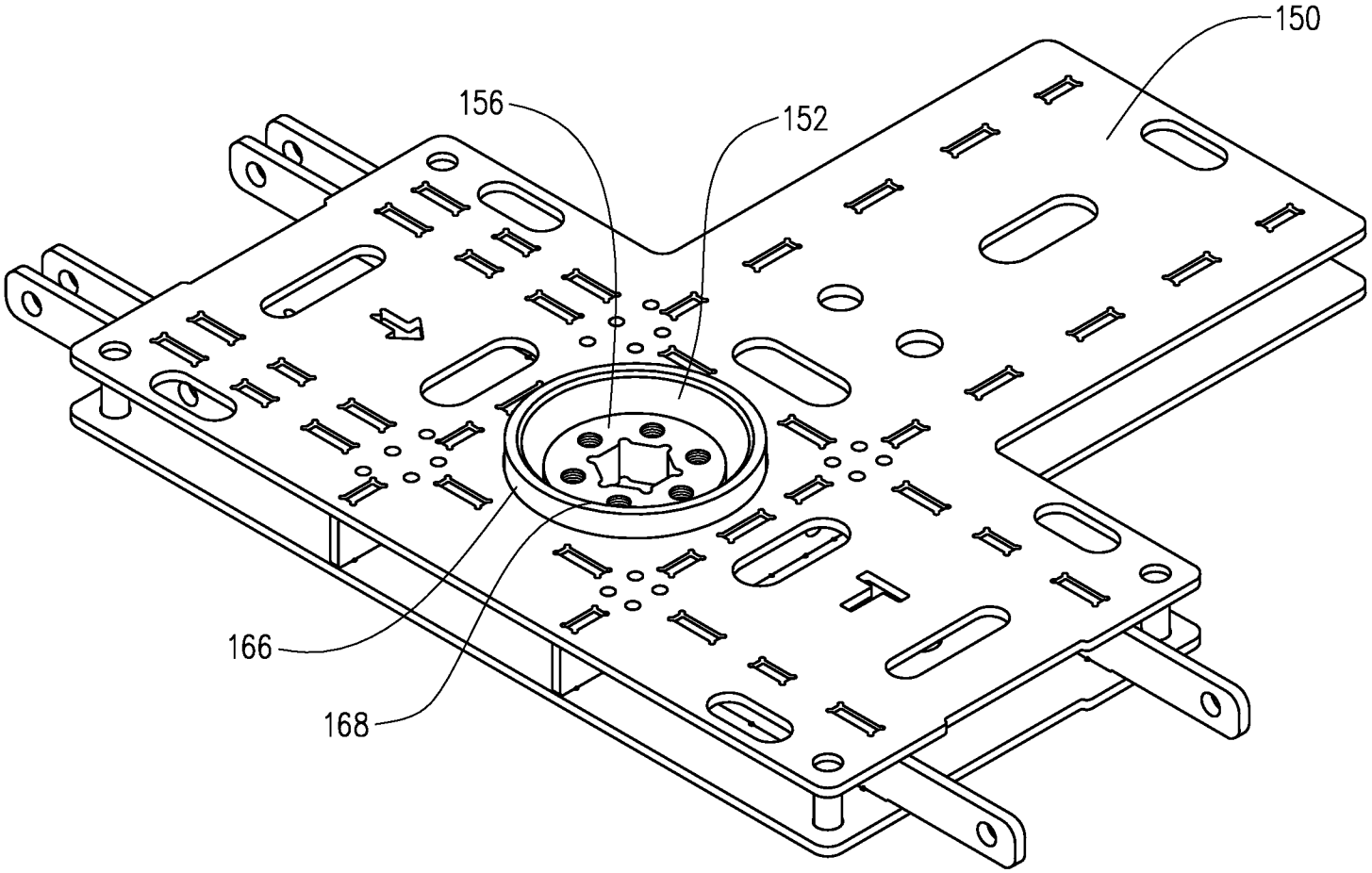
Figure 3S:
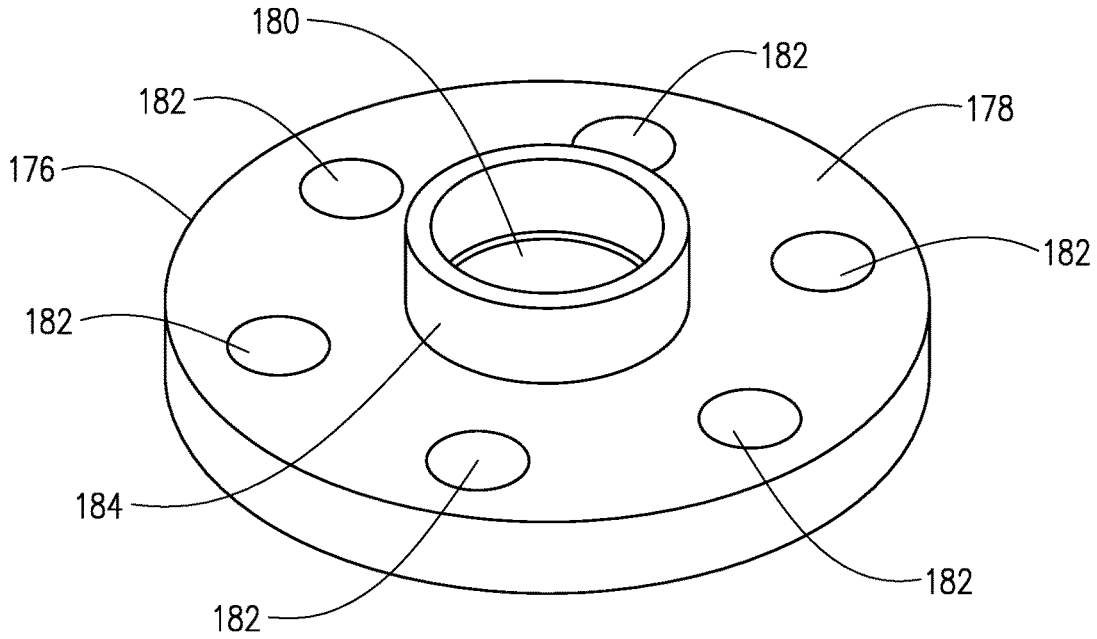
Figure 3T:
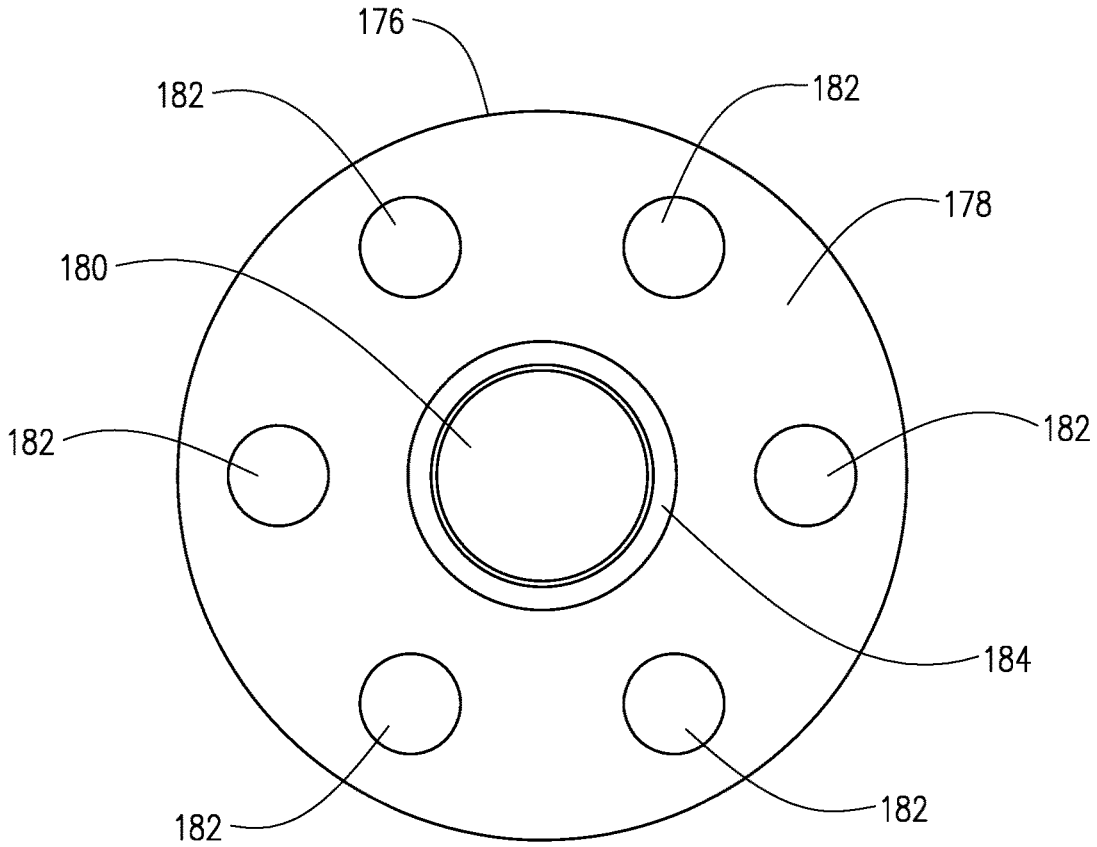

Further comprising the core assembly 154 is a lock receiver 172, shown in FIG. 34. The lock receiver 172 is traversed by an axially-extending and internally threaded opening 174, and has a cross-sectional shape that conforms to the shape of the recess 162. The cross-sectional shape of the lock receiver 172 is preferably polygonal, and more preferably hexagonal. At least the lower portion of the lock receiver 172 is sized to be closely but clearingly received in the recess 162. Preferably, the lock receiver 172 comprises an enlarged nut.

Further comprising the core assembly 154 is a blocking member 176, shown in FIGS. 35 and 36. The blocking member 176 comprises a flat, disc-shaped plate 178 having an external shape that matches the internal contour of the shell 152. Preferably, that external shape is circular. A centrally-disposed core access opening 180, surrounded by a plurality of attachment openings 182, are formed in the plate 178. The openings 180 and 182 are preferably of circular shape, and pass through the entirety of the plate 178. The pattern of the attachment openings 182 should register with the pattern of the fastener openings 164. A centrally-disposed and annular alignment boss 184 fits around the core access opening 180 and projects from the plate 178.

Figure 37:
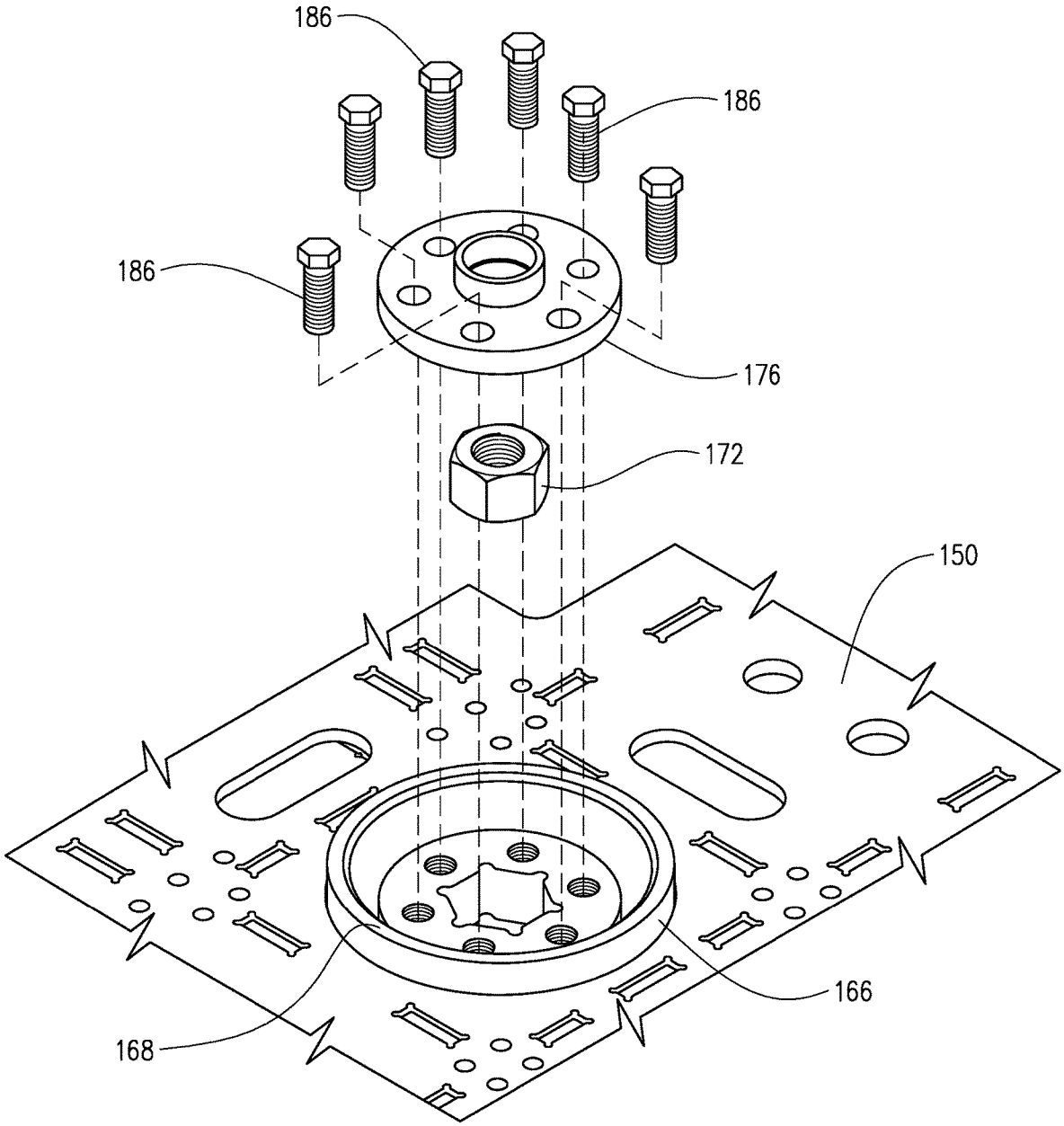
FIG. 37 is an enlarged and exploded perspective view of the structure of FIG. 33. The lock receiver of FIG. 34 and the blocking member of FIG. 35 are positioned above the structure, in preparation for installation.
Figure 25:
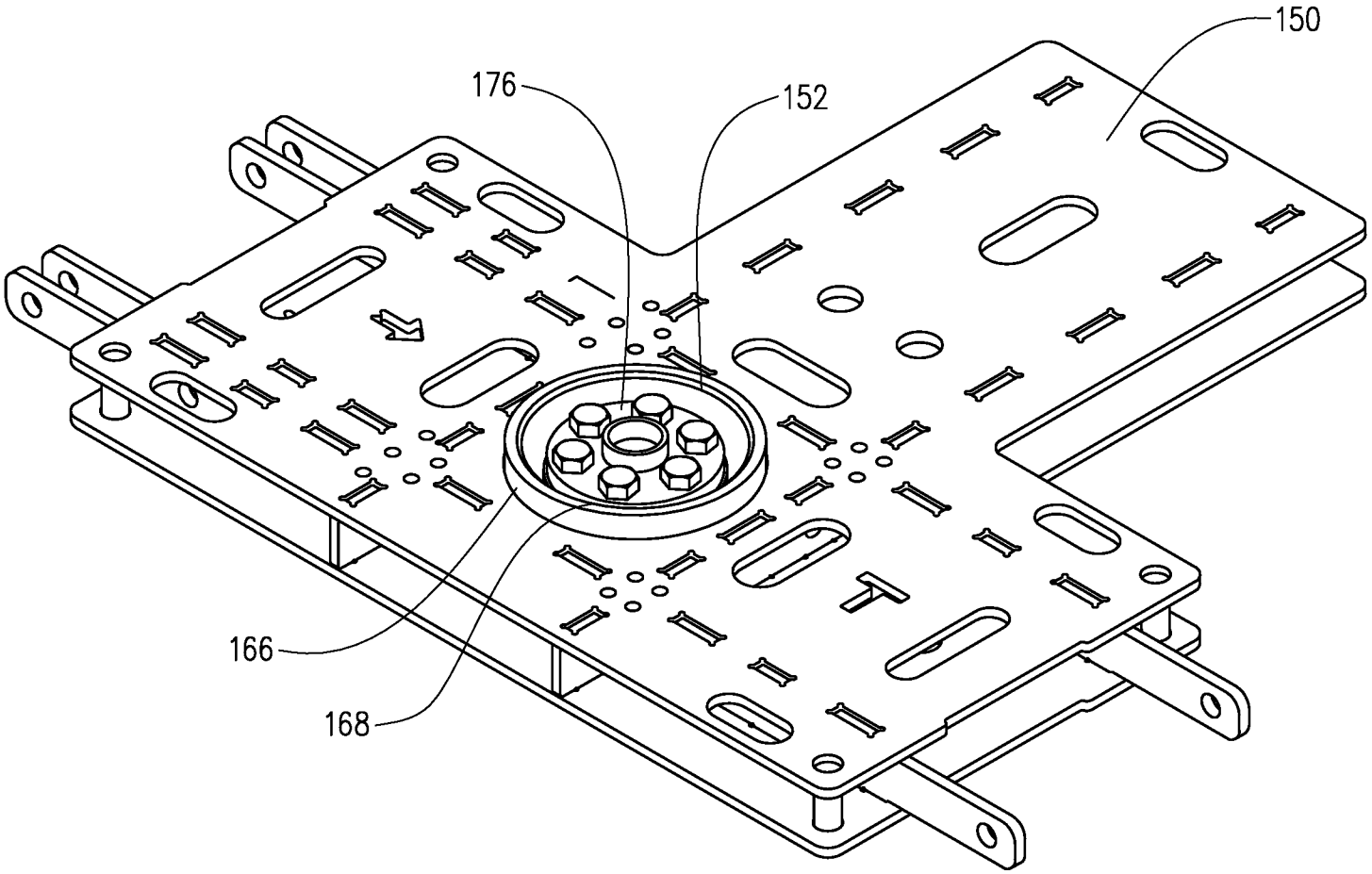

FIG. 37 shows how the lock receiver 172 and blocking member 176 are incorporated into the rest of the core assembly 154. The lock receiver 172 is first lowered into the recess 162. The blocking member 176 is then lowered into the shell 152 such that its core access opening 180 aligns with the opening 174 in the lock receiver 172. The attachment openings 182 are aligned with the underlying fastener openings 164, and a fastener 186 inserted into each of the aligned pairs of openings. The fasteners 186 are actuated to complete the connection. The resulting structure is shown in FIG. 38.

In the previously-described embodiment of the bollard assembly 144, the lock receiver 172 is a hex nut having a thickness of 2.4375 inches. Opposed sides of the nut have a separation distance of 3.88 inches. The plate 178 forming the blocking member 176 has a circular shape, with a diameter of 9.5 inches, and a thickness of 1 inch. The core access opening 180 has a circular cross-sectional shape, with a diameter of 2.75 inches. The attachment openings 182 likewise have a circular cross-sectional shape, with a diameter of 1.31 inches. The alignment boss 184 is a hollow cylinder having an external diameter of 3.5 inches and a height of 1.13 inches.

Figure 39:
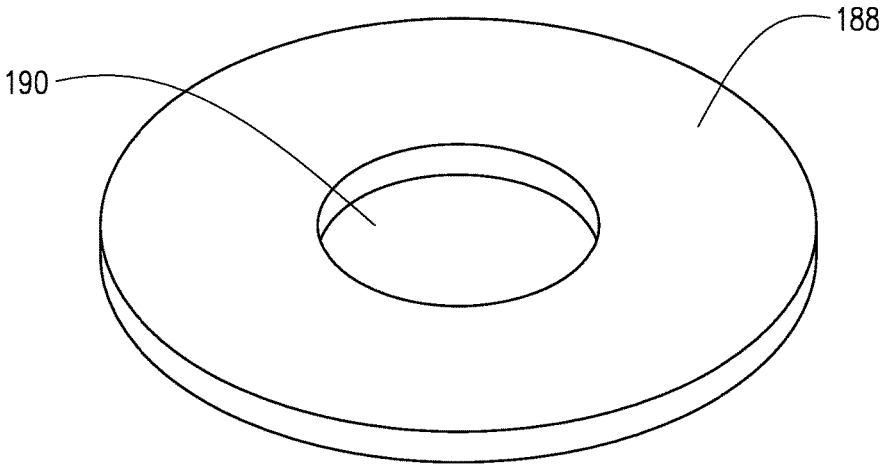
FIG. 39 is a perspective view of a push plate.

Further comprising the core assembly 154 is an externally flat and smooth push plate 188, shown in FIG. 39. The push plate 188 is sized to be received within the socket 166 and provides a smooth and stable surface against which the lift assembly presses as the bollard 148 is lifted. The push plate 188 preferably has a circular external shape, and is provided with a centrally-disposed core access opening 190.

Preferably, the push plate 188 is installed by placing it atop the core assembly 154 without otherwise attaching or fastening it. The alignment boss 184 partially extends through the core access opening 190, and helps to position the push plate 188 centrally in relation to the core assembly 154. In one embodiment, the alignment boss 184 projects inches above the upper end 168 of the socket 166.

Figure 41:
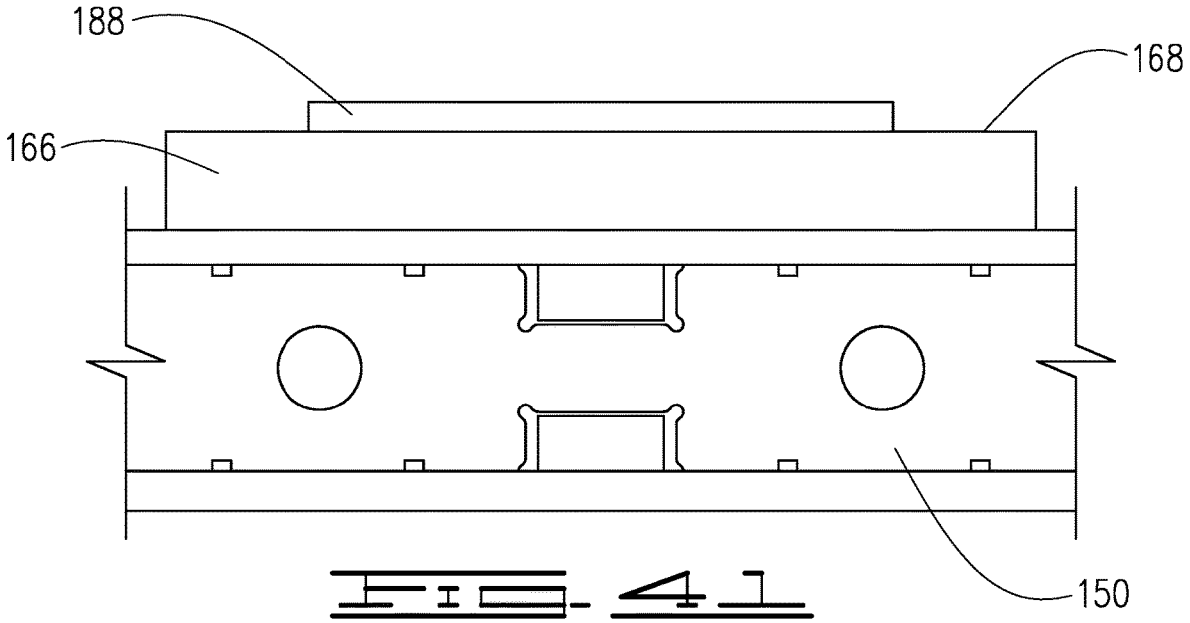
FIG. 41 is an enlarged front elevation view of a portion of the base of FIG. 40, showing the upper socket and push plate.
Figure 40:
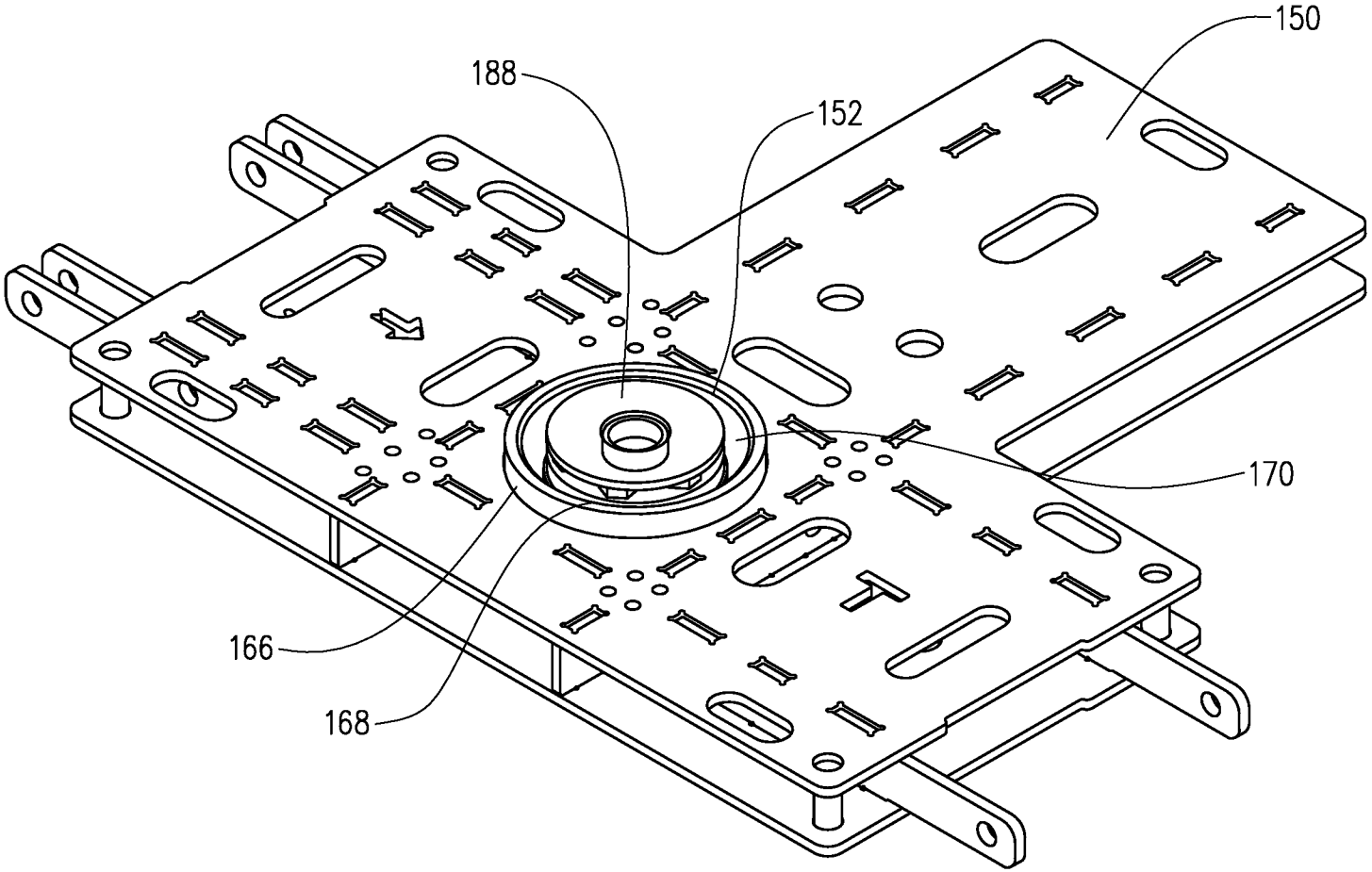
FIG. 40 is a perspective view of the base of the bollard assembly of FIG. 30. It has been formed by assembling the structure of FIG. 38 with the push plate of FIG. 39.

The structure that results from installation of the push plate 188 on the core 156 is shown in FIG. 40. As shown in FIG. 41, at least a portion of the installed push plate 188 projects above the upper end 168 of the socket 166. More preferably, the entirety of the push plate 188 is situated above the upper end 168. In the embodiment of the Figures, the extent of projection by the push plate 188 above the upper end 169 is a nonzero amount that is preferably greater than or equal to 0.25 inches, more preferably greater than 0.5 inches and most preferably equal to 0.5 inches.

In the previously-described embodiment of the bollard assembly 144, the push plate 188 has a diameter of 9.5 inches and a thickness of 0.5 inches. The core access opening 190 has a diameter of 3.75 inches.

Figure 42:
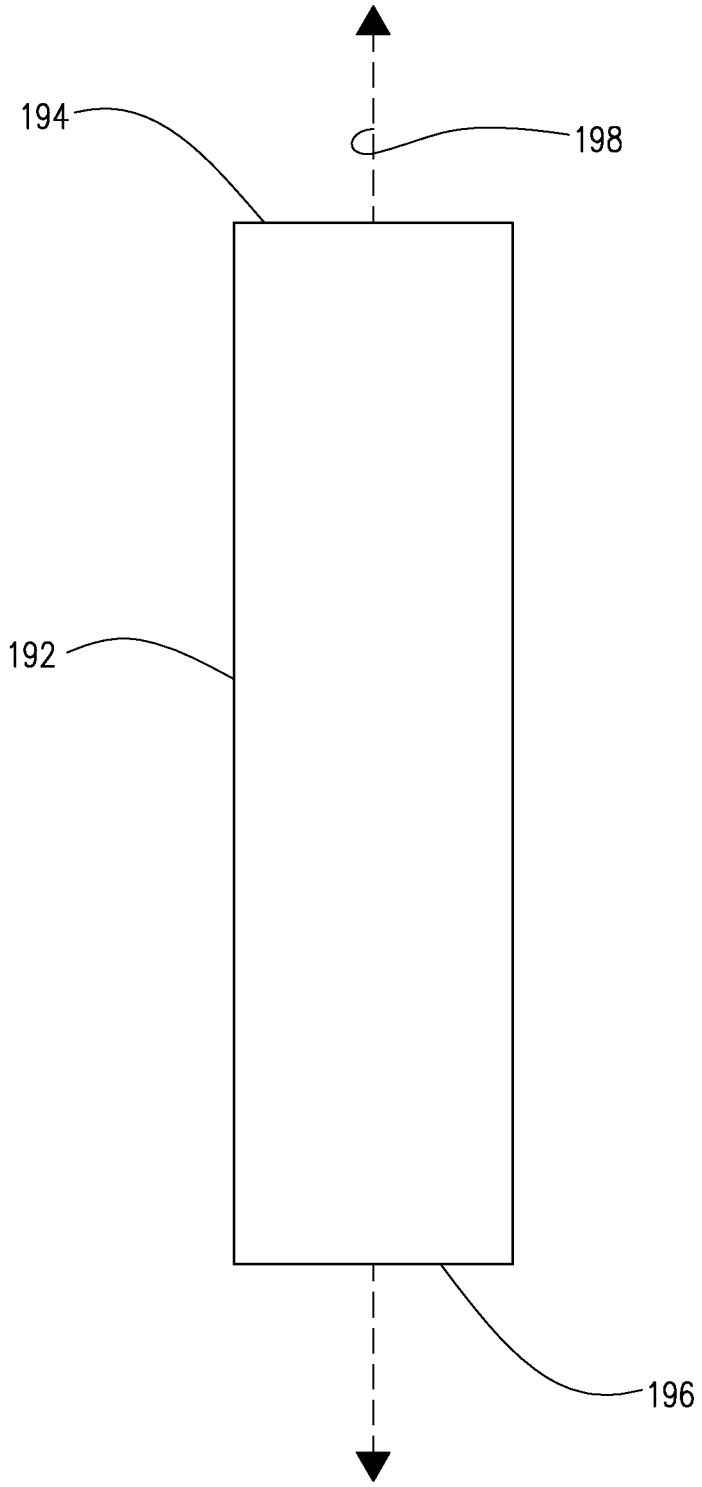
FIG. 42 is a front elevation view of a body.

The bollard 148 is formed from an elongate and hollow body 192 having an upper end 194, an opposed lower end 196, and a centrally-disposed longitudinal axis 198. The body 192, shown in FIG. 42, is a tubular structure characterized by a uniform cross-sectional shape along its length. Preferably, that cross-sectional shape is circular.

The body 192 is preferably formed from a strong and durable material, such as steel, and more preferably from the same material as the shell 152. The construction and shape of the body 192 are preferably identical to those described with reference to the body 42 of the embodiment of FIGS. 1-29.

In the previously-described embodiment of the bollard assembly 144, the body 192 is a hollow and cylindrical structure formed from steel tubing. The body 192 has a length of 44.875 inches, an external diameter of 12 inches, and a wall thickness of 1 inch.

Figure 43:
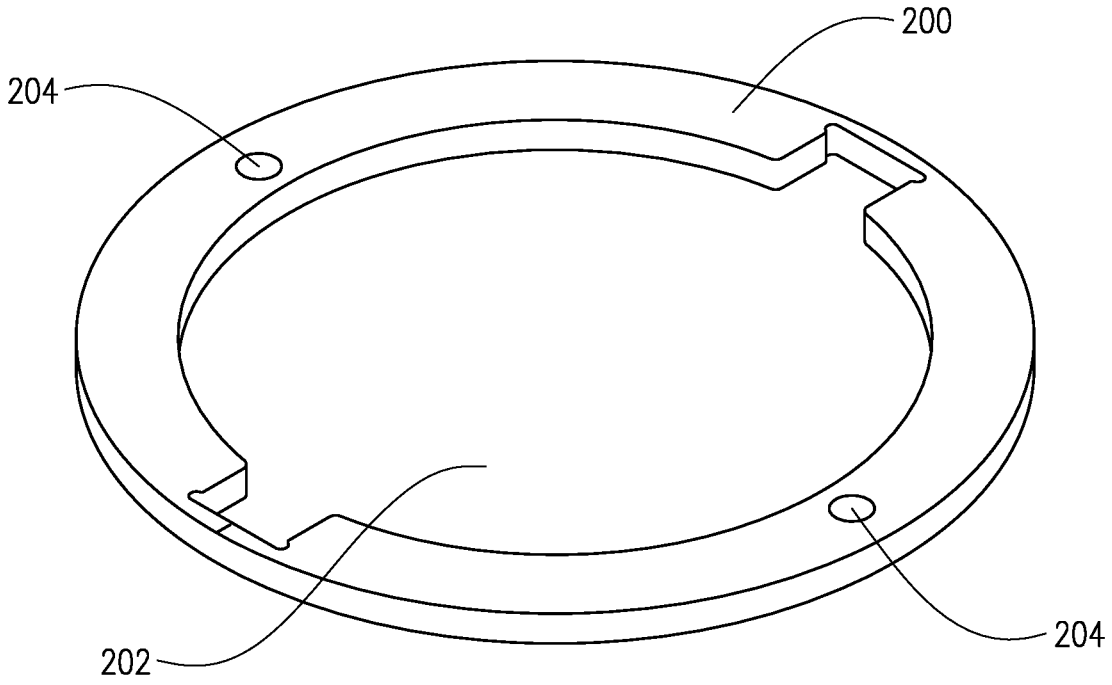
FIG. 43 is a perspective view of an upper support bracket.

Further comprising the bollard 148 is a rigid upper support bracket 200, shown in FIG. 43. The upper support bracket 200 is sized and shaped to be closely, but clearingly, received within the body 192, in coaxial relationship thereto.

The upper support bracket 200 has an external shape, preferably circular, that is shaped to conform to the internal shape of the body 192. More preferably, the upper support bracket 200 has an annular shape and is provided with a centrally-disposed opening 202. A pair of diametrically-opposed platform attachment openings 204 are formed about the periphery of the bracket 200.

Figure 44:
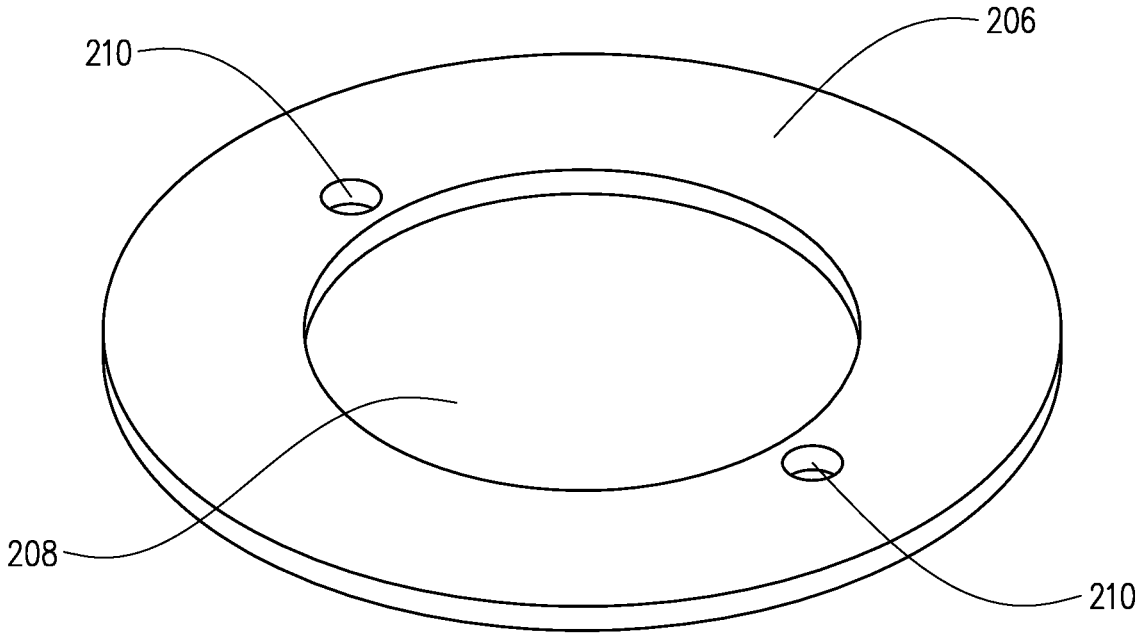
FIG. 44 is a perspective view of a medial support bracket.

Further comprising the bollard 148 is a rigid medial support bracket 206, shown in FIG. 44. The medial support bracket 206 is sized and shaped to be closely, but clearingly, received within the body 192, in coaxial relationship thereto.

The medial support bracket 206 has an external shape, preferably circular, that is shaped to conform to the internal shape of the body 192. More, preferably the medial support bracket 206 has an annular shape and is provided with a centrally disposed core access opening 208. A pair of diametrically-opposed brace openings 210 are formed about the periphery of the bracket 206.

Figure 45:
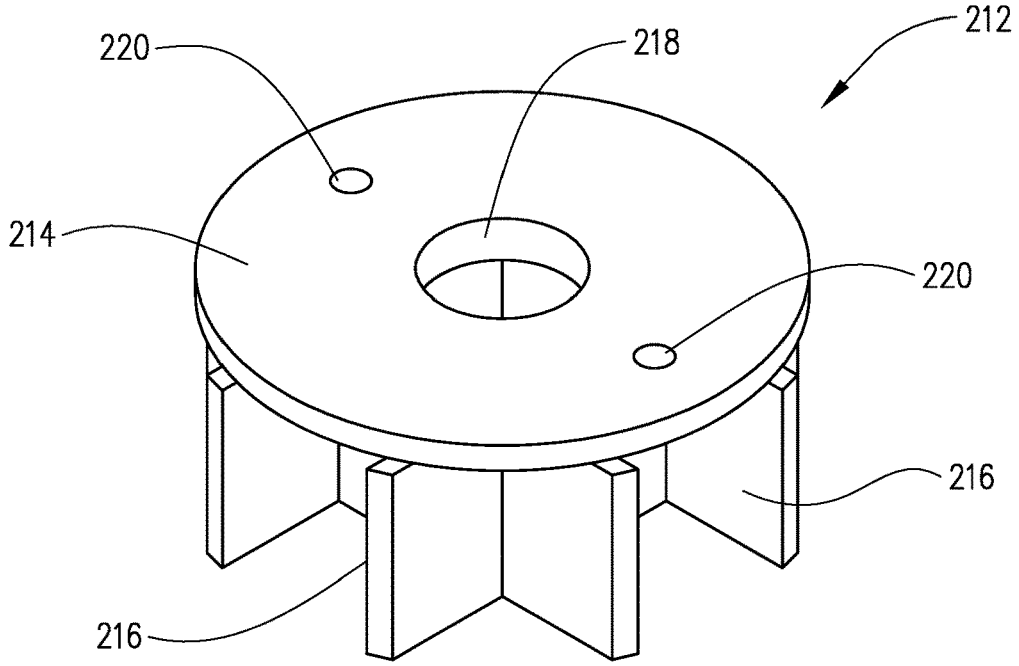
FIG. 45 is a perspective view of a lock support assembly.

Further comprising the bollard 148 is a lock support assembly 212, shown in FIG. 45. The lock support assembly 212 is formed from a rigid lock support platform 214 that is supported by an underlying framework 216. The lock support assembly 212 is sized and shaped to be closely, but clearingly, received within the body 192, in coaxial relationship thereto.

The lock support platform 214 is preferably flat, with a circular external shape. More preferably, the lock support platform 214 is of annular shape, and provided with a centrally-disposed core access opening 218. A pair of diametrically-opposed rod passages 220 are formed about the periphery of the platform 214.

Figure 46:
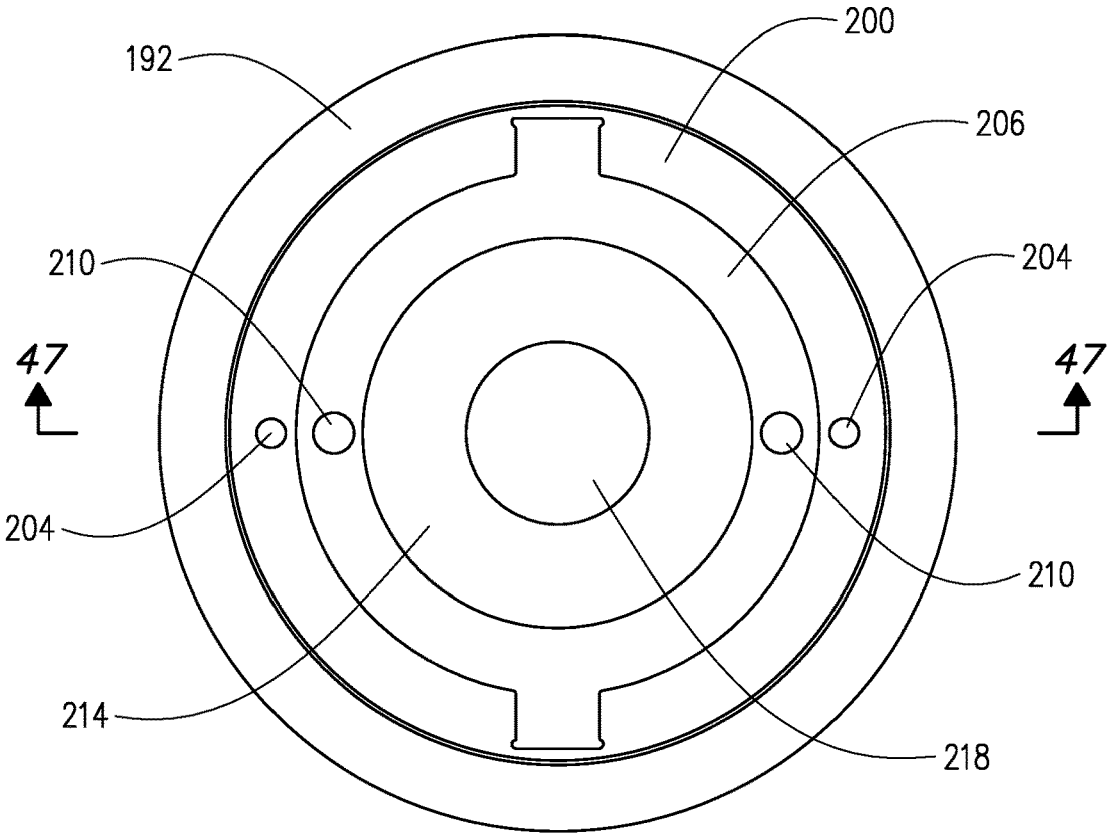
FIG. 46 is a top plan view of the structure formed by assembling the body of FIG. 42 with the upper support bracket of FIG. 43, the medial support bracket of FIG. 44 and the lock support assembly of FIG. 45.
Figure 46:
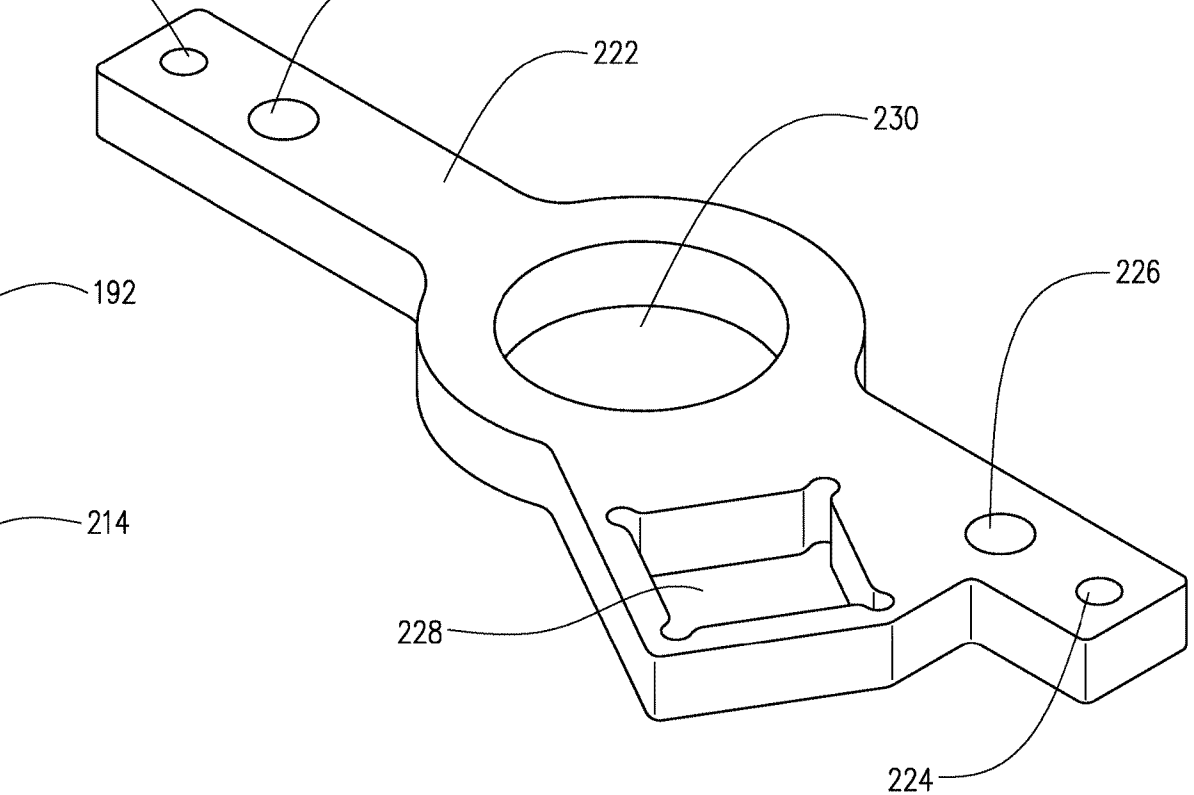
Figure 47:
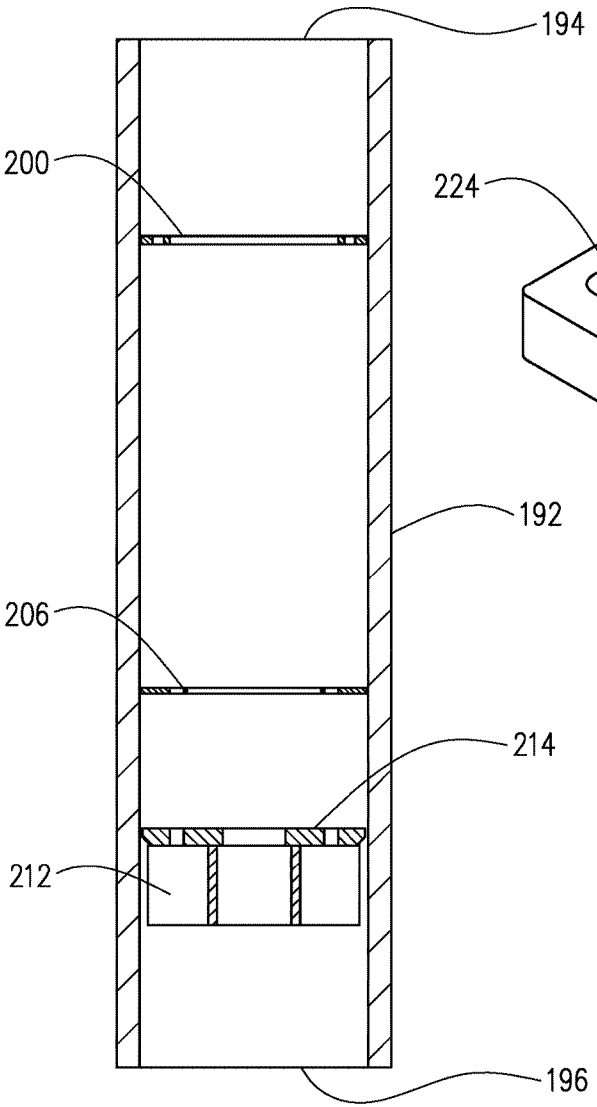
FIG. 47 is a front cross-sectional view of the structure of FIG. 46.

The upper support bracket 200, medial support bracket 206 and lock support assembly 212 are installed by inserting each component coaxially into the body 192. At multiple areas of contact, each component is permanently joined to the body 192, preferably by welding. The resulting structure is shown in FIGS. 46 and 47.

The upper support bracket 200 is installed nearest the upper end 194. The lock support assembly 212 is installed nearest the lower end 196. The medial support bracket 206 is installed between the upper support bracket 200 and the lock support assembly 212. When installed, each of the upper support bracket 200, medial support bracket 206 and the lock support platform 214 should extend transversely, and preferably orthogonally to the axis 198.

In the previously-described embodiment of the bollard assembly 144, the upper support bracket 200 has an annular shape with an outer diameter of 9.88 inches, a central opening 202 with a diameter of 7.88 inches, and a thickness of 0.38 inches. The separation distance of the platform attachment openings 204 is 8.63 inches. The medial support bracket 206 has an annular shape with an outer diameter of 9.88 inches, a core access opening 208 with a diameter of 5.88 inches, and a thickness of 0.25 inches.

The lock support platform 214 has an annular shape with an outer diameter of 9.75 inches, a core access opening 218 with a diameter of 2.75 inches, and a thickness of 0.75 inches. Including both the lock support platform 214 and its underlying framework 216, the lock support assembly 212 has a height of 4.25 inches.

In the same embodiment, the upper surface of the upper support bracket 200 is placed 8.5625 inches from the upper end 194 of the body 192. The lower surface of the medial support bracket 206 is placed 16.3125 inches from the lower end 196. The base of the lock support assembly 212 is placed 6.1875 inches from the lower end 196.

Further comprising the bollard 148 is a rigid utility platform 222, shown in FIG. 48. The utility platform 222 is a flat, elongate and irregularly-shaped structure sized to traverse all or substantially all of an internal diameter of the body 192. A plurality of openings are formed in the utility platform 222, including a pair of bracket engagement openings 224, a pair of brace openings 226, a tool extension opening 228, and a core access opening 230.

Preferably, the bracket engagement openings 224 are situated at opposite longitudinal extremities of the utility platform 222. The bracket engagement openings 224 should have approximately the same size and separation distance as the platform attachment openings 204. The brace openings 226 are preferably situated between the bracket engagement openings 224, with one brace opening 226 situated adjacent each bracket engagement opening 224. The core access opening 230 is preferably intermediate the brace openings 226, while the tool extension opening 228 occupies an offset position near the core access opening 230.

Figure 51:
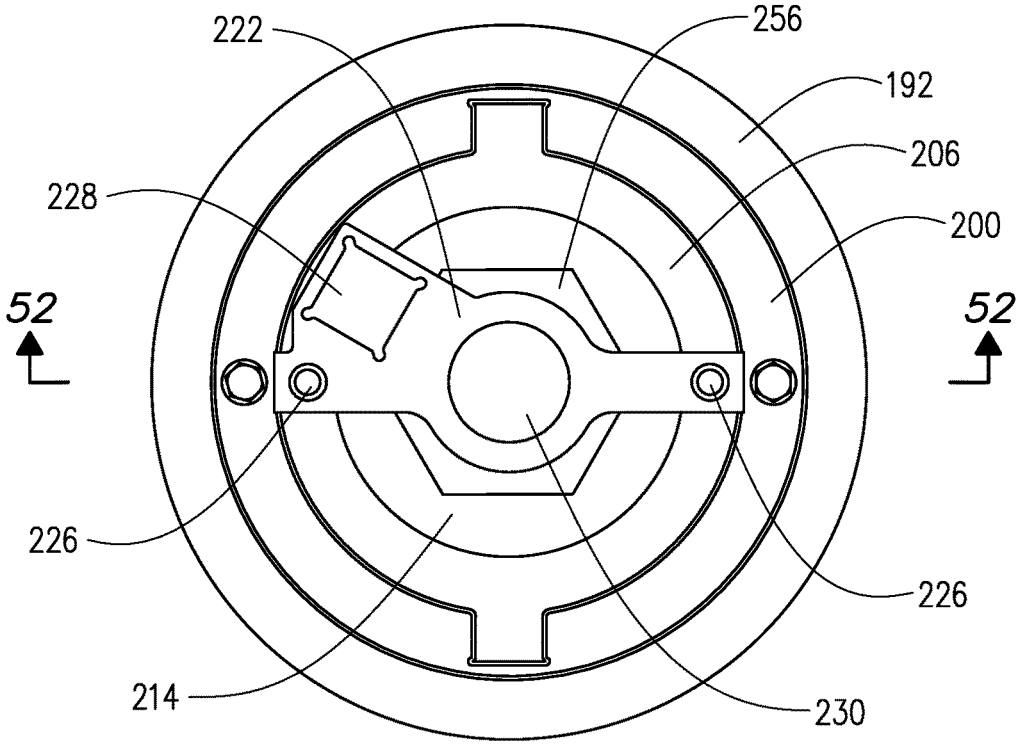
FIG. 51 is a top plan view of the structure formed by assembling the structure of FIG. 47 with the utility platform of FIG. 48, two lifting elements and the lower portion of the locking structure of FIG. 49.
Figure 52:
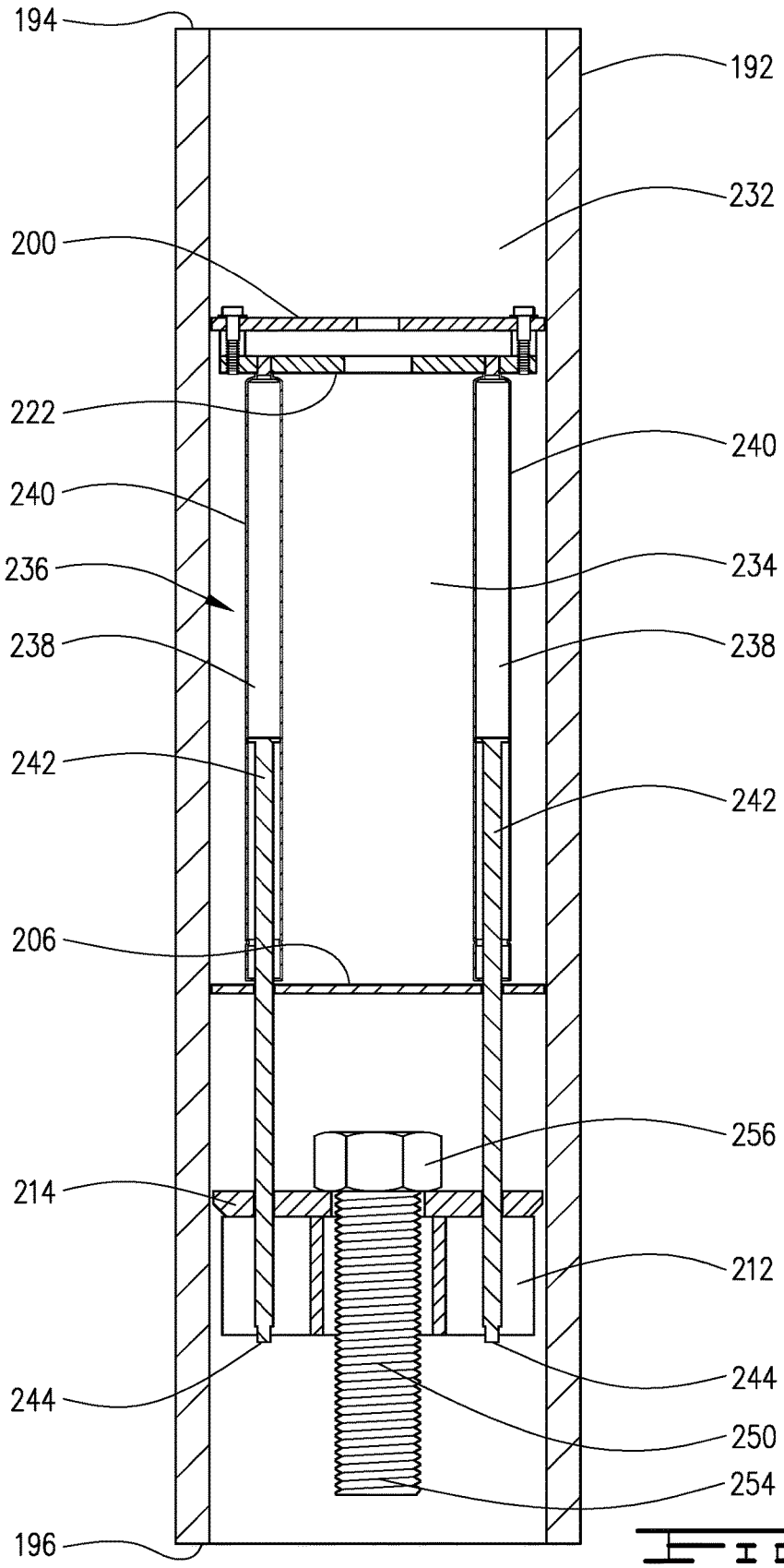
FIG. 52 is a front cross-sectional view of the structure of FIG. 51. The lifting elements are in their less extended states.
Figure 53:
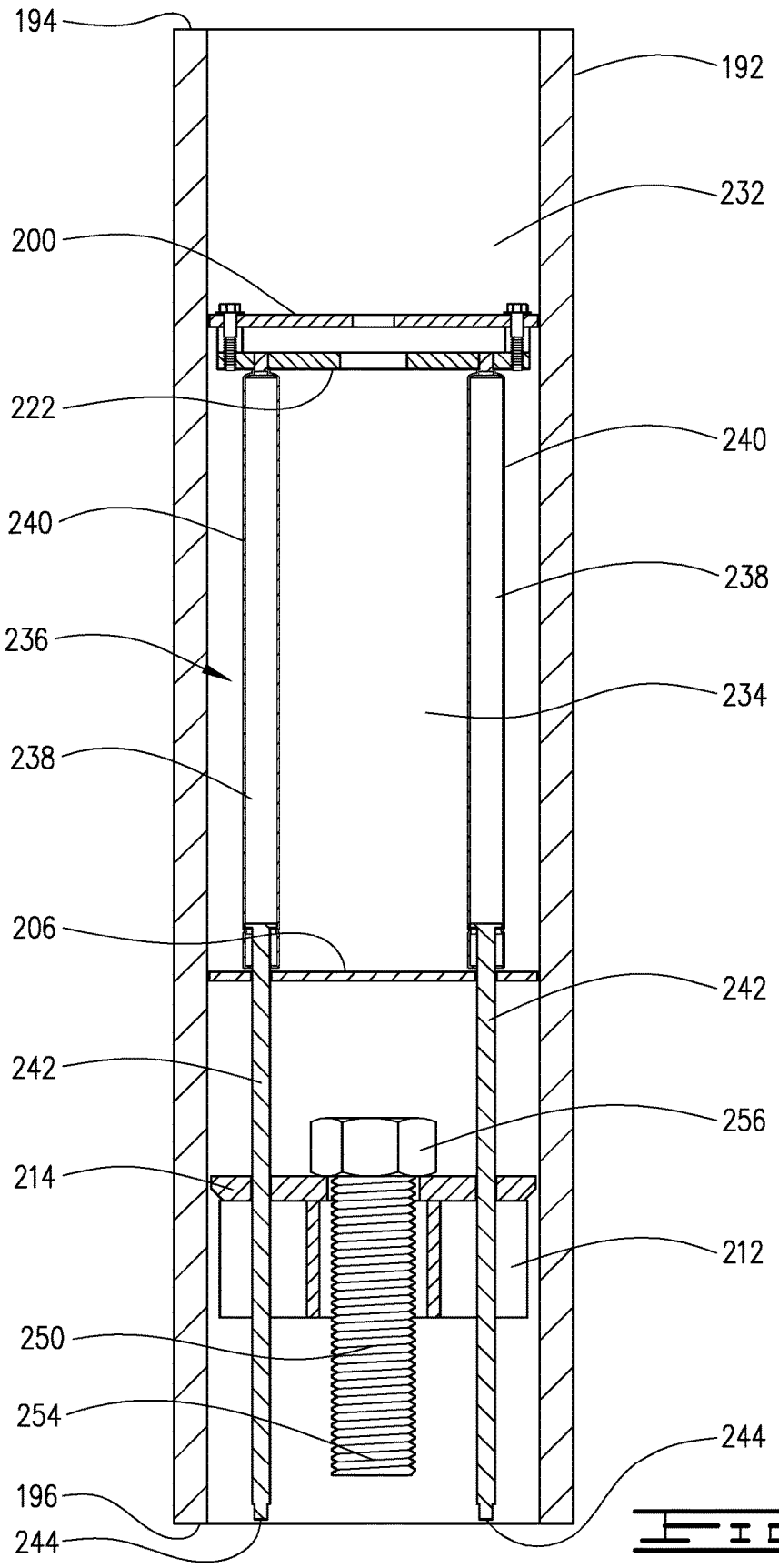
FIG. 53 is a front cross-sectional view similar to FIG. 52, differing in that the lifting elements are in their more extended states.

The utility platform 222 is installed by positioning it within the body 192 in parallel and underlying relationship to the upper support bracket 200. The platform attachment openings 204 and bracket engagement openings 224 are aligned, and a fastener inserted into each aligned pair of openings. The fasteners are actuated to complete the connection. The resulting structure is shown in FIGS. 51, 52 and 53. The installed utility platform 222 should extend transversely, and more preferably orthogonally, to the axis 198. Also preferably, the axis 198 coincides with the center of the core access opening 230.

Once assembled within the body 192, the utility platform 222 partially separates the interior of the body 192 into an upper compartment 232 and a lower compartment 234. Unlike the embodiment of FIGS. 1-29, the utility platform 222 does not fully separate the two compartments. The upper compartment 232 is accessible from the upper end 194 of the body 192. Optionally, the body 192 may be provided with a removable cap or closure at its upper end 194.

In the previously-described embodiment of the bollard assembly 144, the utility platform 222 has a maximum length of 9.38 inches, a maximum width of 4.13 inches and a thickness of 0.5 inches. The separation distance of the bracket engagement openings 224 is 8.63 inches, and the separation distance of the brace openings 226 is 6.75 inches. The tool extension opening 228 is square in shape, with sides of 1.38 inches. The core access opening 230 is circular in shape, with a diameter of 2 inches.

The bollard 148 further comprises a lift assembly 236 that is situated within the bollard 148 and engagable with the core 156, preferably at its upper surface 160. The lift assembly 86 has a less extended state, configured to urge increased axial separation between the body 192 and the core 156, and an extended state.

The lift assembly 236 is formed from at least one, and preferably a plurality of lifting elements 238, shown in FIGS. 52 and 53. In the embodiment of the Figures, the lift assembly 236 consists of two lifting elements 238. Each lifting element 238 preferably comprises a static cylinder 240, filled with a compressible gas, that receives a telescoping and movable piston rod 242. The rod 242 has a free end 244 that always remains outside the cylinder 240. The lifting element 238 preferably has the same construction as the lifting element 88 shown in FIG. 14.

In the unextended state of the lift assembly 236, the rod 242 of each lifting element 238 is retracted to the greatest extent possible within the cylinder 240. In the extended state of the lift assembly 236, the rod 242 of each lifting element 238 extends outside the cylinder 240. The lift assembly 236 has an internal bias in favor of its extended state.

Preferably, the lifting elements 238 are identical in size, shape and construction. More preferably, each lifting element 238 is a gas spring. In the previously-described embodiment of the bollard assembly 144, each lifting element 238 is a gas spring that produces 1,200 newtons of force, has a compressed length of 18.34 inches, and may be fully extended to a length of 34.09 inches.

The lift assembly 236 is assembled by inserting a lifting element 238 into the body 192 and positioning its cylinder 240, with the rod 242 oriented downward, between the utility platform 222 and the medial support bracket 206. The rod 242 is extended through the rod passage 220 of the lock support platform 214, through the framework 216, and toward the lower end 196. Each end of the cylinder 240 is fitted into a corresponding one of the brace openings 226 and 210, and secured in place with fasteners. These steps are repeated for each lifting element 238 forming the lift assembly 236. The resulting structure is shown in FIG. 52, in which the lifting elements 238 are in their unextended states. FIG. 53 shows the same structure with the lifting elements 238 in their extended states. In both its unextended and extended states of the lifting elements 238, the lift assembly 236 remains wholly contained within the body 192.

The bollard assembly 144 further comprises a locking system 246 that has two, and preferably only two, states. In a locked state, the locking system 246 restrains the lift assembly 236 in its unextended state. In an unlocked state, the locking system 246 releases the unextended lift assembly 236 from restraint.

Figure 49:
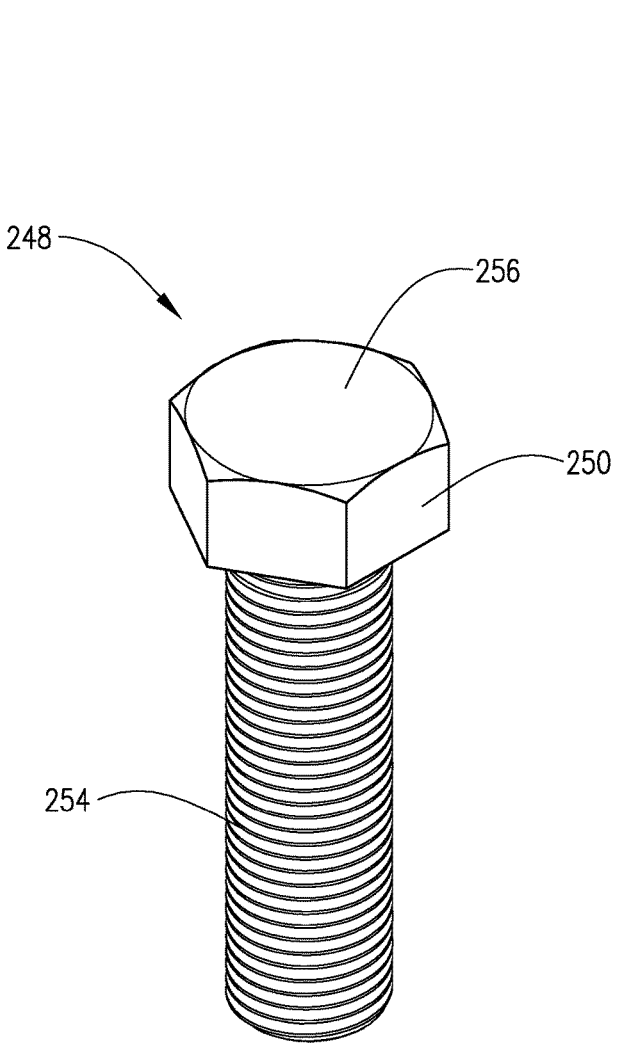
FIG. 49 is a perspective view of the lower portion of a locking structure.
Figure 50:
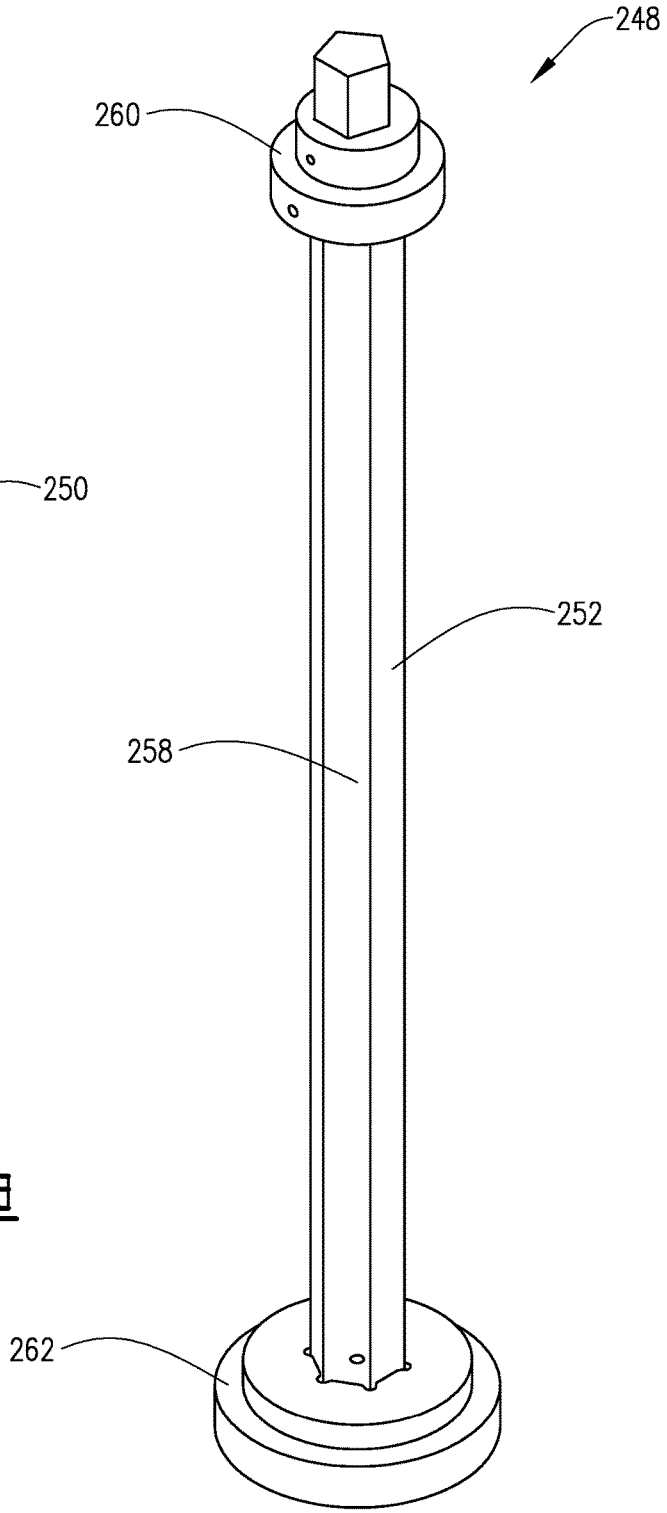
FIG. 50 is a perspective view of the upper portion of a locking structure.

The locking system 246 comprises the aforementioned lock receiver 172 and a rigid and elongate locking structure 248, shown in FIGS. 49 and 50. The locking structure 248 is a two-part structure, comprising a lower portion 250 and an upper portion 252. In other embodiments, the portions may be joined, and the locking structure formed as a single piece. Preferably, the locking structure 248 is rotatable, and is configured to produce the locked and unlocked states of the locking system 246 by such rotation.

The lower portion 250, shown in FIG. 49, comprises an elongate and rectilinear shaft 254 having an enlarged head 256 formed at one of its ends. The shaft 254 is sized to be receivable through each of the core access openings 180 and 218, and has sufficient length to reach within the opening 174 of the lock receiver 172 when the head 256 rests on the lock support platform 214. The shaft 254 has external threads that are matable with the internal threads formed in the opening 174. Preferably, the lower portion 250 comprises a large bolt.

The upper portion 252, shown in FIG. 50, is preferably formed from an elongate and rectilinear rod 258 having opposed upper and lower ends. The rod 258 is preferably characterized by a polygonal, and more preferably hexagonal, cross-sectional shape. At its upper end, the rod 258 is preferably provided, if necessary, with an upper adapter 260 that presents a projection having a polygonal cross-sectional shape drivable by the wrench to be described hereafter. Preferably, that polygonal shape is a pentagon. At its lower end, the rod 258 is preferably provided with a lower adapter 262 that presents a recess having a cross-sectional shape that conforms to the cross-sectional shape of the head 256. Preferably, that shape is an enlarged hexagon.

The rod 258 is sized to be receivable through each of the core access openings 208 and 230, and has sufficient length to permit the attached lower adapter 262 to engage the head 256 when the upper end of the rod 258 is positioned above the utility platform 222.

Preferably, the locking structure 248 includes a constricted portion and an enlarged portion. The constricted portion is sized to pass through the core access opening 218 in the lock support platform 214. The enlarged portion has cross-sectional dimensions greater than those of the constricted portion, and is sized not to pass through the same opening. In the embodiment of FIGS. 30-60, the head 256 is an enlarged portion, while the remainder of the locking structure 248, except for the adapters 260 and 262, is constricted.

The locking structure 248 is positionable within an elongate and rectilinear core access passage 264 situated within the body 192, and unblocked by any structure therein. The core access passage 264 interconnects the utility platform 222 and the lower end 196 of the body 192, passes through the core access openings 208, 218 and 230, and terminates above the lock receiver 172. Preferably, the core access passage 264 extends parallel to the axis 198. In the embodiment of FIGS. 30-60, the center of the core access passage 264 coincides with the axis 198.

The lower portion 250 of the locking structure 248 is installed by extending the shaft 254 through the core access opening 218 until the head 256 rests on the lock support platform 214. The upper portion 252 of the locking structure 248 is installed by extending the rod 258, without the lower adapter 262 attached, through the core access openings 230 and 208. The lower adapter 262 is then attached to the lower end of the rod 258. Once both portions 250 and 252 have been installed, the downward-facing recess in the lower adapter 262 is lowered into mating engagement with the head 256, so that the portions 250 and 252 can rotate as a unit.

With the assembled locking structure 248 resident in the core access passage 264, the locking system 246 may be placed into its locked state by rotating the locking structure 248 until threads on the shaft 254 mate with corresponding threads within the opening 174 of in the lock receiver 172. The locking structure 248 thereby becomes rigidly attached to the core 156. Upward movement of the body 192, urged by the lift assembly 236, is blocked by engagement between the head 256 and the lock support platform 214.

With the assembled locking structure 248 resident in the core access passage 264, the locking system 246 may be placed into its unlocked state by rotating the locking structure 248 in the opposite direction until the threaded shaft 254 disengages from the lock receiver 172. The locking structure 248 thereby becomes unattached from the core 156. Upward movement of the body 192, urged by the lift assembly 236, causes the body 192 to lift away from the core 156. At least a portion of the locking system 248, namely the lower and upper portions 250 and 252 of the locking structure 246, moves as a unit with the body 192 when the locking system 248 is placed in its unlocked state.

In the previously-described embodiment of the bollard assembly 144, the lower portion 250 is a bolt having a shaft 254 with a length of 9 inches, the head 256 has the shape of a hexagon in which opposed sides have a separation distance of 3.75 inches. The upper portion 252 is formed from a rod 258 having a length of 30.1875 inches. The rod 258 has cross-sectional shape of a hexagon in which opposed sides have a separation distance of 1.5 inches.

Figure 55:
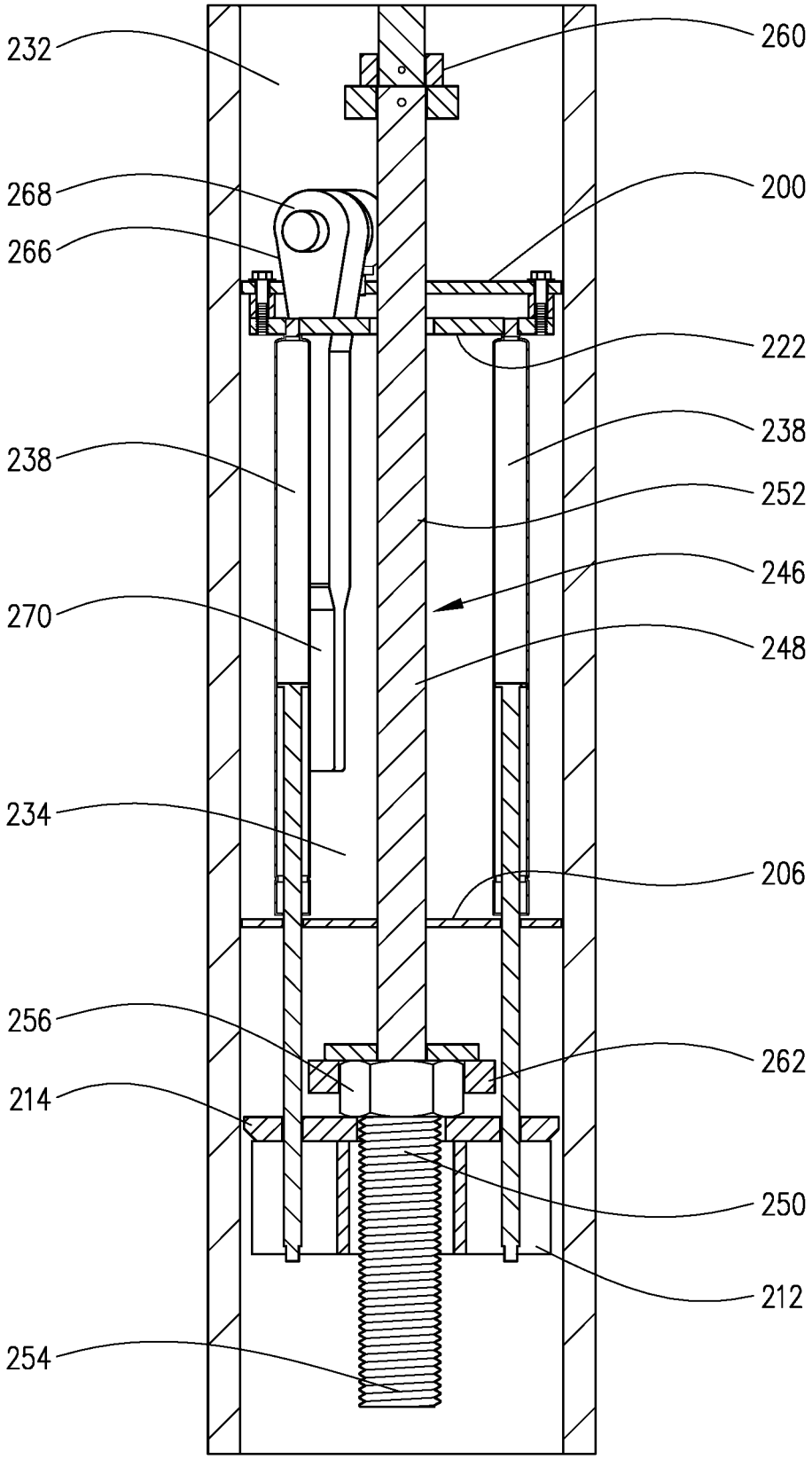
FIG. 55 is a front cross-sectional view of the bollard of FIG. 54.
Figure 55:
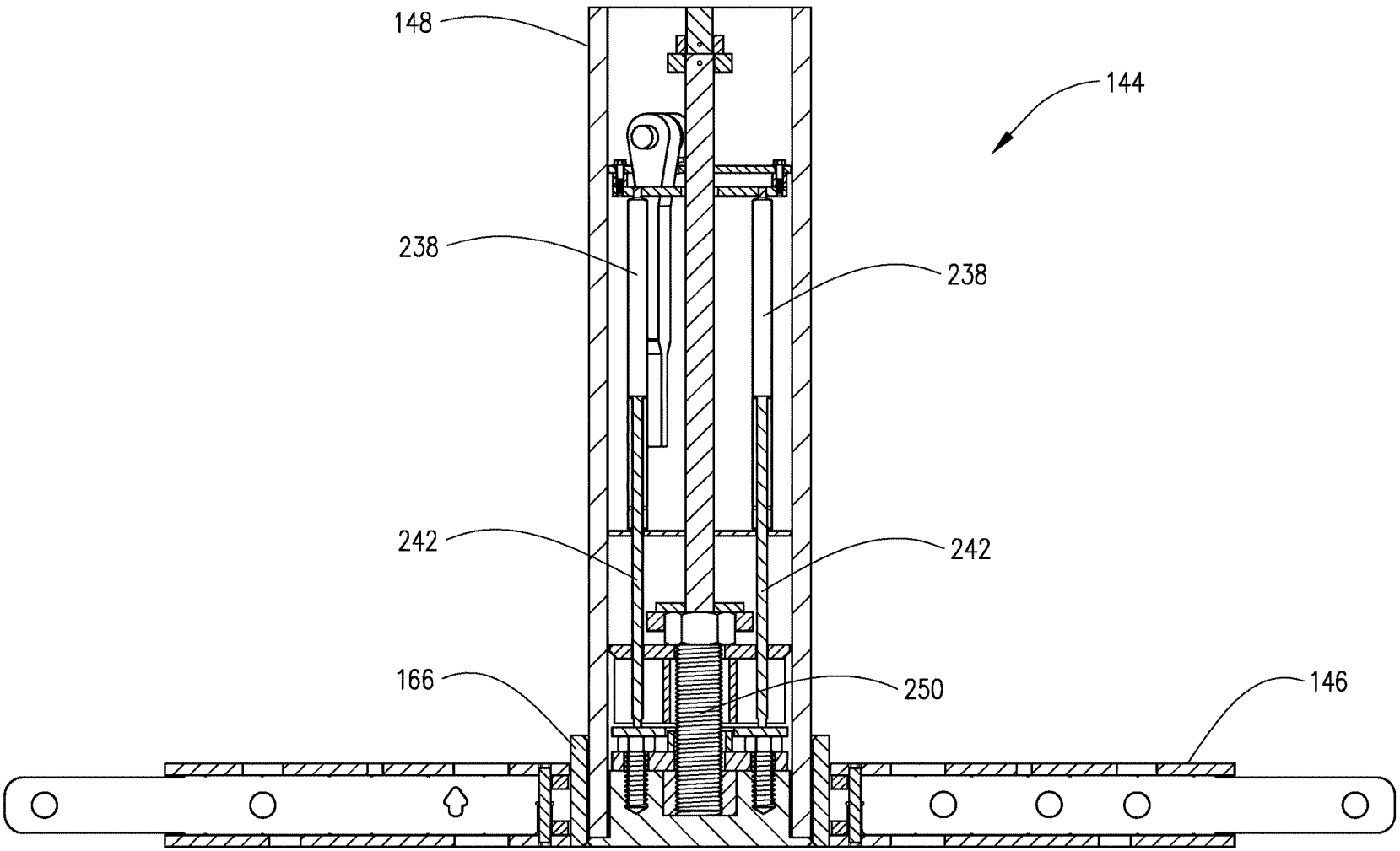

The bollard assembly 144 preferably further comprises a wrench 266, shown in FIG. 55. The wrench 266, which is preferably identical to the wrench 136 described with reference to FIG. 22, is configured to drive rotation of the locking structure 248.

The wrench 266 comprises a head 268 supported by an elongate handle 270. Preferably the head 268 has a shape configured to conform to the polygonal cross-sectional shape of an end of the locking structure 248. More preferably, that shape is pentagonal. In one embodiment, the wrench 266 is a standard fire department hydrant wrench.

The head 268 is sized to be wholly receivable within the upper compartment 232, while being too large to pass through the tool extension opening 228 in the utility platform 222. The wrench 266 is installed within the bollard 148 by passing its handle 270 through the tool extension opening 228 until the head 268 engages the utility platform 222. The handle 270 extends within the lower compartment 234, while the head 268 resides within the upper compartment 232.

In the previously-described embodiment of the bollard assembly 144, the wrench 266 has an overall length of 18 inches. The head 268 has a maximum cross-sectional dimension of 3.38 inches, while the handle 270 has a maximum cross-sectional dimension of 1.31 inches. The head 268 has a height of 1.81 inches.

Figure 54:
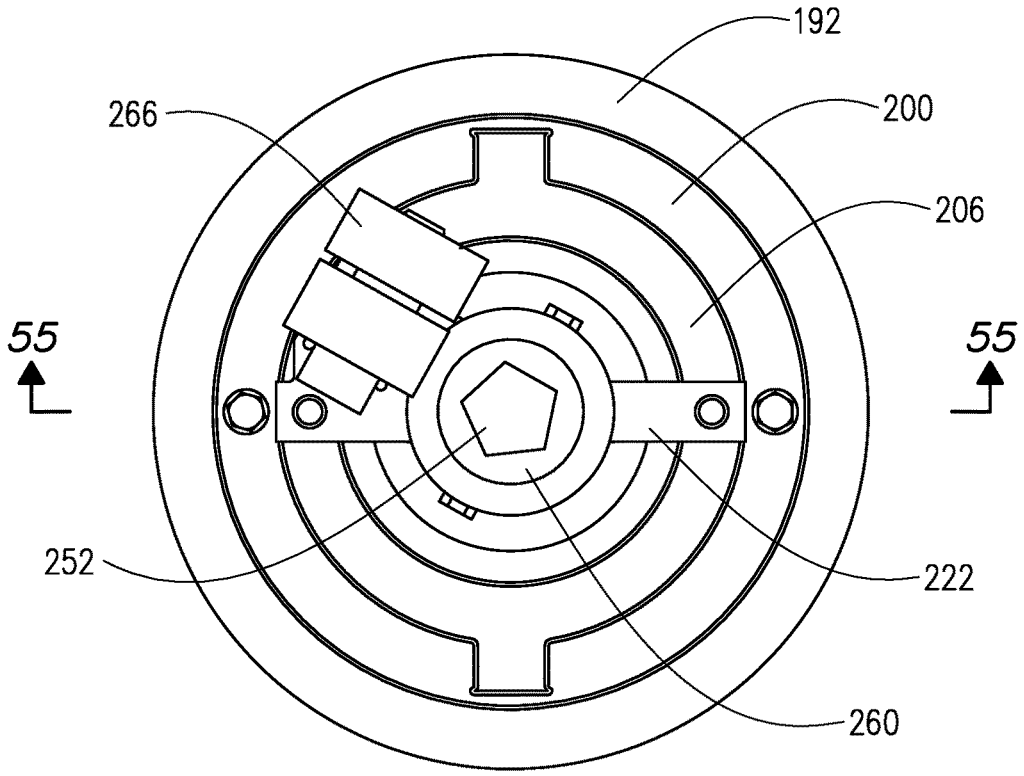
FIG. 54 is a top plan view of the bollard of the bollard assembly of FIG. 30. It has been formed by assembling the structure of FIG. 51 with the upper portion of the locking structure of FIG. 50 and a wrench. The lifting elements are in their less extended states.

FIGS. 54 and 55 show the complete bollard 148. It has been formed by assembling the structure of FIG. 51 with the upper portion 252 of the locking structure of FIG. 50 and a wrench 266.

Figure 30:
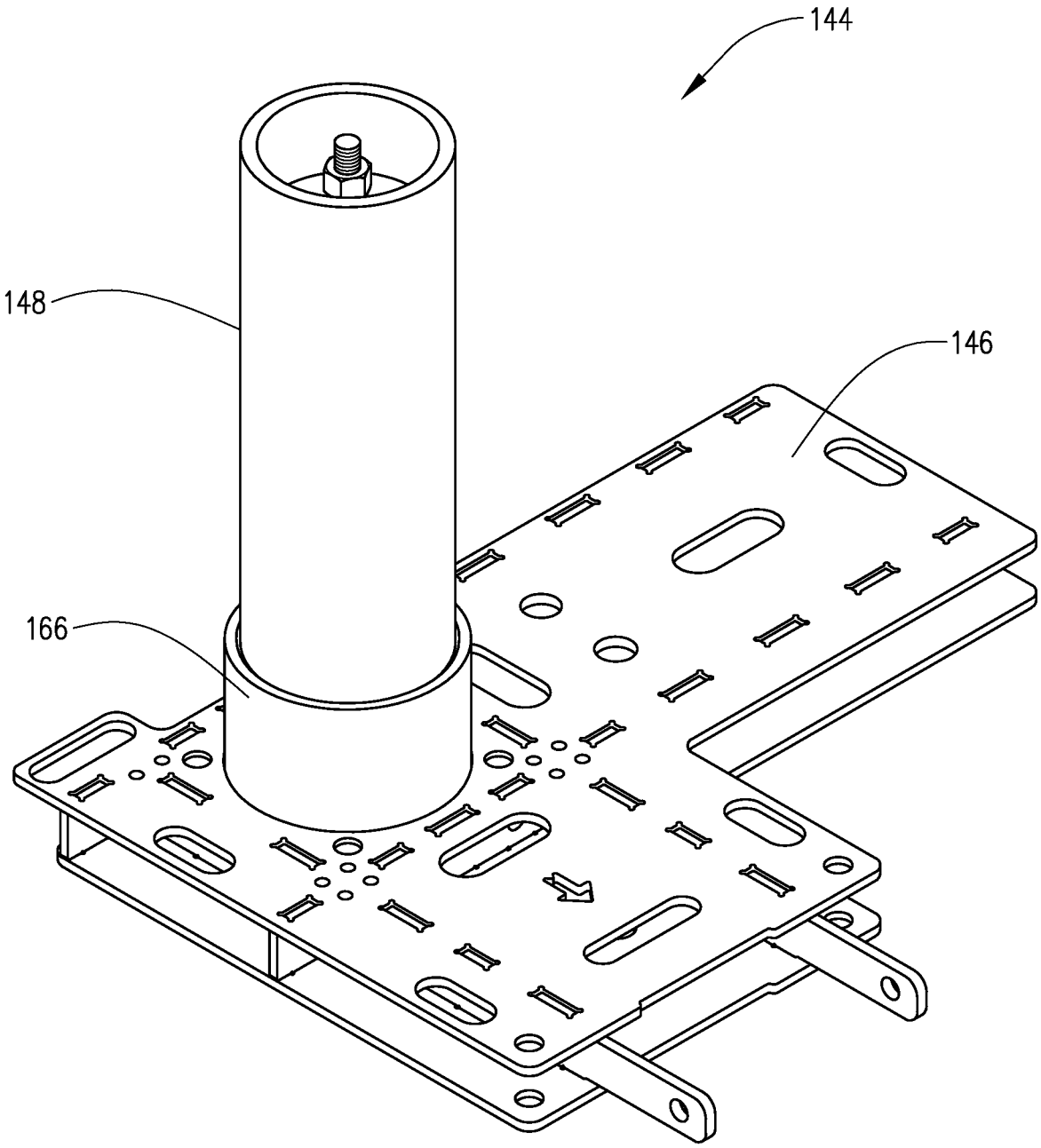
FIG. 30 is a perspective view of another embodiment of a bollard assembly.
Figure 57:
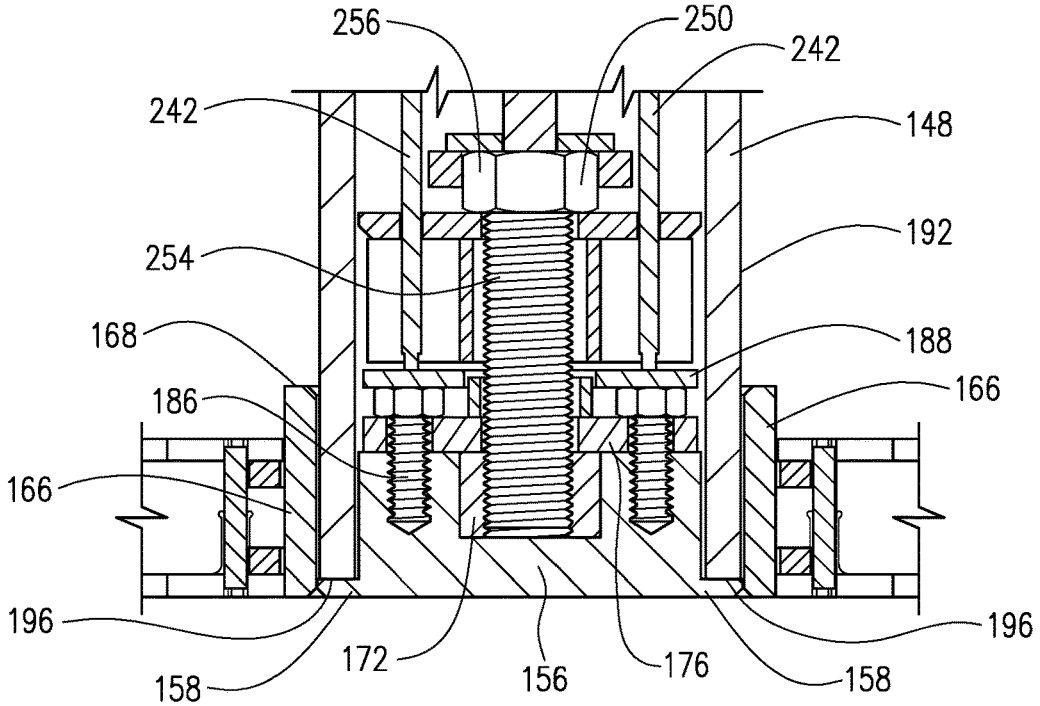
FIG. 57 is an enlarged and detailed view of the bollard assembly of FIG. 56, showing the lower end of the bollard and its interface with the socket.

The bollard assembly 144 is formed by inserting the bollard 148, shown in FIG. 55, into the annular recess 170 of the socket 166, shown in FIG. 40. The bollard 148 is pushed downward under pressure until the lower end 196 engages the socket base 158. The locking structure 248 is installed, if necessary, and rotated to place the locking system 246 in a locked state. Preferably, rotation of the locking structure 248 is driven by the wrench 266. The lift assembly 236 and core 156 are thereby joined. The resulting configuration of the bollard assembly 144 is shown in FIGS. 30, 56 and 57.

To remove the bollard 148 from the foundation 146, the installed locking structure 248 is rotated to place the locking system 246 in an unlocked state. Preferably, this rotation is driven by the wrench 266. The lift assembly 236 is thereby released from engagement with the core 156, and causes the body 192 to rise from the socket 166. As the lift assembly 236 extends, the lower portion 250 of the locking structure 248 is prevented from falling out of the lower compartment 234 of the body 192 by engagement between the head 256 and the lock support platform 214.

The lift assembly 236 acts on the core 156 by way of the free ends 244 of the rods 242 of the lifting elements 238. The free ends 244 press against the push plate 188, which is the uppermost portion of the core 156. The pressure applied by the lift assembly 236 causes the body 192 to rise from the socket 166 without external assistance.

Figure 58:
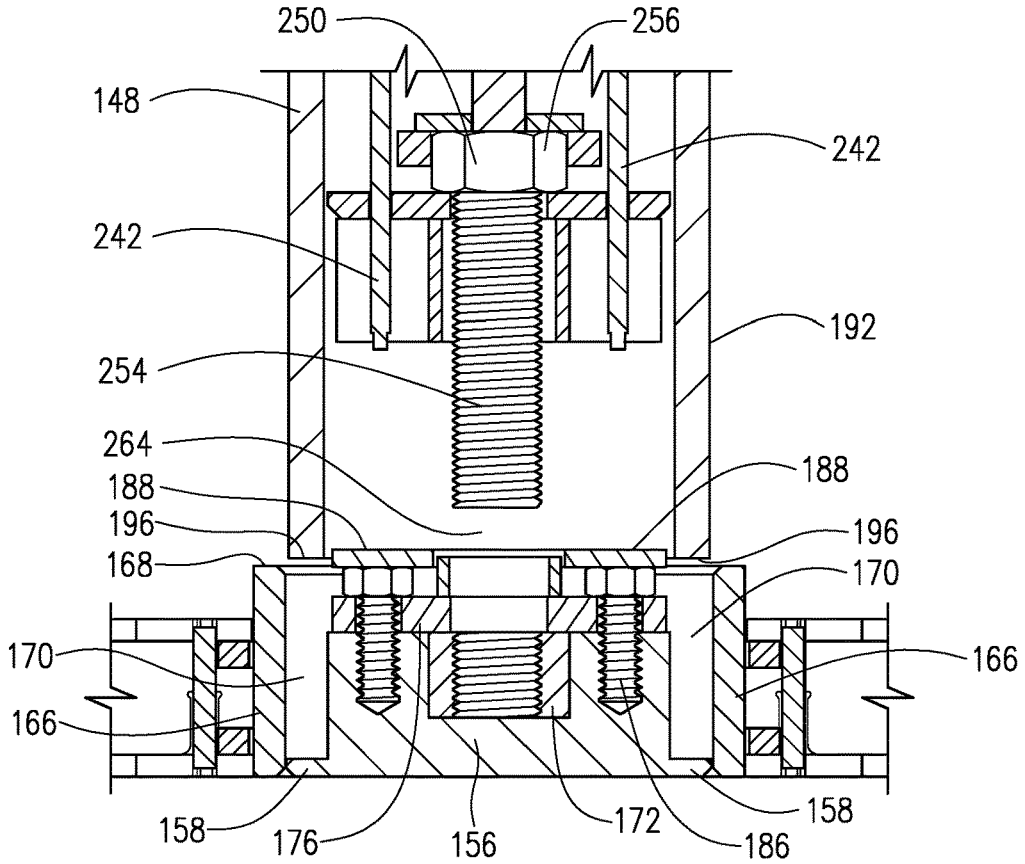
FIG. 58 is a front cross-sectional view similar to FIG. 56, differing in that the lifting elements are in their more extended states.
Figure 39:
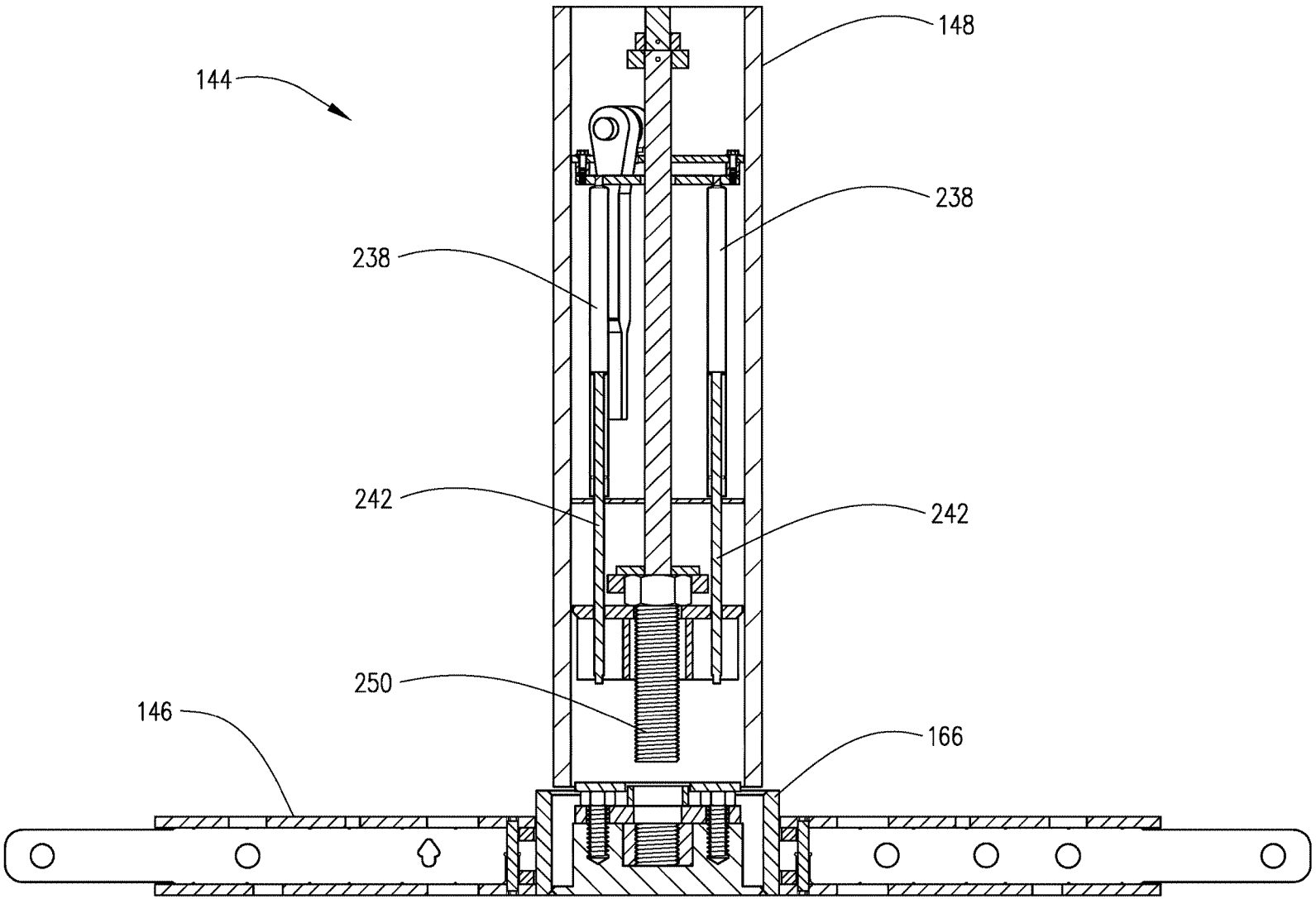
Figure 50:
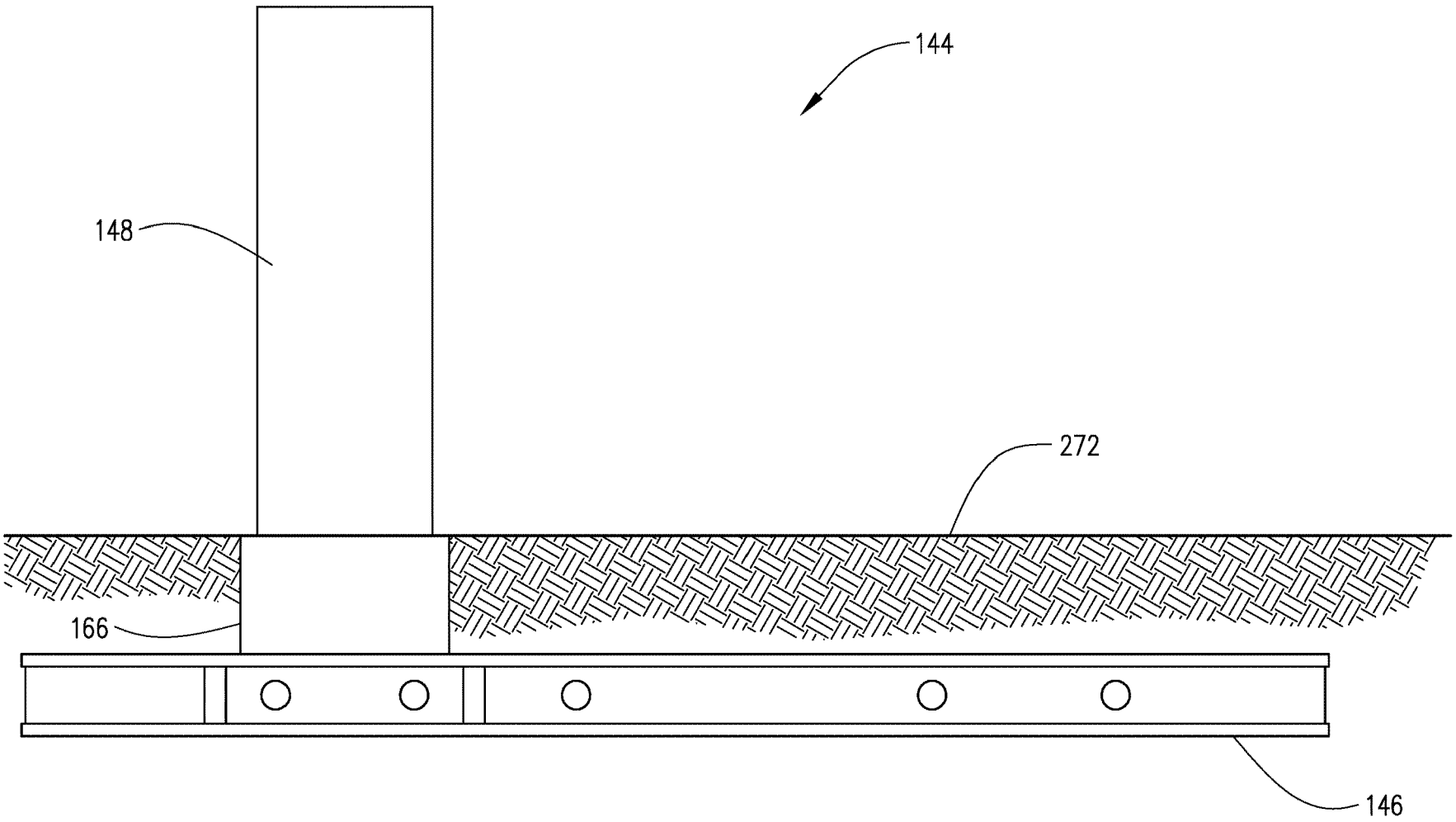

When the rods 242 of the lifting elements 238 reach their maximum extension, lifting of the body 192 ceases. Preferably, the lifting elements 238 are chosen and positioned within the body 192 such that, upon maximal extension of the rods 242, their free ends 244 will be approximately aligned with the lower end 196 of the body 192, such as within 0.125 inches or less. The resulting configuration of the bollard assembly 144 is shown in FIGS. 58 and 59. Because the lifted bollard 148 is unfastened to the foundation 146, it is easily removed from the site of the foundation 146, without need for special tools or external lifting equipment.

As noted previously, the push plate 188 sits atop the core 156, and projects outside the upper end 168 of the socket 166, as shown in FIG. 59. When lifting ceases, the lower end 196 is aligned with the push plate 188, and thus positioned slightly above and outside the socket 166. Such positioning assists in preventing the foundation 146 from interfering with removal.

The bollard assembly 144 may be installed in the ground area 272, as shown in FIG. 60. The ground area 272 may comprise soil or some other substrate, such as concrete. The socket 166 is at least partially buried within the ground area 272, and the bollard 148 received in the socket 166. More preferably, the foundation 146 is buried within the ground area 272, such that the upper end 168 of the socket 166 coincides with the ground surface. While the lift assembly 236 is unextended, the lower end of the bollard 148 resides below the ground surface. When the lift assembly 236 is extended, the bollard 148 sits slightly above the ground surface, where it may be removed.

Unless otherwise stated herein, any of the various parts, elements, steps and procedures that have been described should be regarded as optional, rather than as essential. Changes may be made in the construction, operation and arrangement of these parts, elements, steps and procedures without departing from the spirit and scope of the invention as described in the following claims.

The invention claimed is:

1. A bollard assembly, comprising:

a foundation having a socket, the socket comprising:

a hollow shell supported by a base;

a core supported by the base and coaxially disposed within the shell, the core having an upper surface spaced above the base; and an annular recess coaxially disposed between the shell and the core;

a bollard, comprising:

a body having opposed upper and lower ends and a body axis, the lower end of the body receivable within the recess and engagable with the base; and a lift assembly engagable with the upper surface of the core and having a less extended state configured to urge increased axial separation between the body and the core, and a more extended state; and a locking system having a locked state, in which the lift assembly is restrained in a less extended state, and an unlocked state in which the less extended lift assembly is released from restraint.

2. The bollard assembly of claim 1 in which the shell and the core have upper surfaces that are coplanar.

3. The bollard assembly of claim 1 in which the locking system comprises:

a lock receiver situated within the core; and an elongate locking structure having opposed ends, the locking structure engagable with the lock receiver adjacent one end.

4. The bollard assembly of claim 3 in which the core has an exposed upper surface within which the lock receiver is formed.

5. The bollard assembly of claim 3 in which the core has an exposed upper surface, and in which the lock receiver is situated below that upper surface.

6. The bollard assembly of claim 3 in which the lock receiver and locking structure are engagable at mating threads.

7. The bollard assembly of claim 3 in which the locking system further comprises:

a platform situated within the body and extending transversely to the body axis, the platform configured to blockingly engage the locking structure while the locking system is in its locked state.

8. The bollard assembly of claim 7 in which the platform has an opening formed therein, and in which the locking structure further comprises:

a constricted portion that can pass through the opening; and an enlarged portion that cannot pass through the opening.

9. The bollard assembly of claim 1 in which at least a portion of the locking system is movable as a unit with the body, while the locking system is in its unlocked state.

10. The bollard assembly of claim 1 in which the locking system comprises:

a rotatable and elongate locking structure configured to produce the locked and unlocked states of the locking system by such rotation;

in which the body further comprises:

an upper compartment accessible from the upper end, the upper compartment bounded in part by a utility plate situated intermediate the upper and lower ends and extending transversely to the body axis; and a lower compartment situated on the opposite side of the utility plate from the upper compartment;

and further comprising:

a wrench configured to drive rotation of the locking structure, comprising:

a head wholly receivable within the upper compartment; and an elongate handle that supports the head, the handle extendable within the lower compartment while the head resides within the upper compartment.

11. The bollard assembly of claim 10 in which the locking structure has opposed ends, at least one of which ends is characterized by a polygonal cross-sectional profile, and in which the head of the wrench is configured to conform to that cross-sectional profile.

12. The bollard assembly of claim 1 in which the lift assembly further comprises:

an extension fixture situated at an extremity of the lift assembly;

a stop element supported by the body and configured to limit extension of the lift assembly, while permitting passage of a minor portion, and no more than a minor portion, of the extension fixture therethrough.

13. A system, comprising:

a ground area; and the bollard assembly of claim 1 in which the socket is at least partially buried in the ground area and the bollard is received within the socket.

14. The system of claim 13 in which the bollard and socket are unfastened to one another.

* * * * *